US010568486B2

(12) United States Patent
Ishikawa

(10) Patent No.: US 10,568,486 B2
(45) Date of Patent: Feb. 25, 2020

(54) PRODUCTION METHOD AND PRODUCTION APPARATUS FOR CLEANING IMPLEMENT

(71) Applicant: UNI-CHARM CORPORATION, Ehime (JP)

(72) Inventor: Yoshihide Ishikawa, Kanonji (JP)

(73) Assignee: UNICHARM CORPORATION, Ehime (JP)

( * ) Notice: Subject to any disclaimer, the term of this patent is extended or adjusted under 35 U.S.C. 154(b) by 499 days.

(21) Appl. No.: 14/766,446

(22) PCT Filed: Feb. 7, 2014

(86) PCT No.: PCT/JP2014/052971
§ 371 (c)(1),
(2) Date: Aug. 6, 2015

(87) PCT Pub. No.: WO2014/123237
PCT Pub. Date: Aug. 14, 2014

(65) Prior Publication Data
US 2016/0000294 A1 Jan. 7, 2016

Related U.S. Application Data

(60) Provisional application No. 61/762,533, filed on Feb. 8, 2013.

(51) Int. Cl.
*A47L 13/20* (2006.01)
*A47L 13/16* (2006.01)
*A47L 13/38* (2006.01)

(52) U.S. Cl.
CPC ..... *A47L 13/20* (2013.01); *A47L 13/16* (2013.01); *A47L 13/38* (2013.01)

(58) Field of Classification Search
CPC ..... A47L 13/20; A47L 13/38; Y10T 156/1057
See application file for complete search history.

(56) References Cited

U.S. PATENT DOCUMENTS 6,554,937 B1 4/2003 Kenmochi et al.
8,062,459 B2 * 11/2011 Nakakado ..... B65H 20/04 156/250
2010/0154156 A1 6/2010 Takabayashi et al.

FOREIGN PATENT DOCUMENTS

EP 1992268 A1 11/2008
EP 2114234 A1 11/2009
(Continued)

OTHER PUBLICATIONS

Office Action in CN Application No. 201480007817.X, dated May 23, 2016.
(Continued)

*Primary Examiner* — Mark A Osele
*Assistant Examiner* — Christopher C Caillouet
(74) *Attorney, Agent, or Firm* — Hauptman Ham, LLP

(57) ABSTRACT

To provide a more logical construction technique relating to a production method and a production apparatus for a cleaning implement. Provided are a production method and a production apparatus for a cleaning implement having a cleaning sheet and a holder, the method including: a step of supplying a plurality of strip elements; a step of superimposing the plurality of strip elements; a step of supplying the superimposed strip elements to a bonding apparatus having a drum roll and a bonding process section; and a step of forming bonded zones in predetermined zones of the superimposed strip elements by the bonding apparatus.

19 Claims, 71 Drawing Sheets

(56) References Cited

FOREIGN PATENT DOCUMENTS

| | | | |
|---|---|---|---|
| JP | 5-245090 | A | 9/1993 |
| JP | 2000-296083 | A | 10/2000 |
| JP | 2002-369783 | A | 12/2002 |
| JP | 2008-119171 | A | 5/2008 |
| JP | 4738311 | B2 | 8/2011 |

OTHER PUBLICATIONS

Written Opinion in International Application No. PCT/JP2014/052971, dated May 13, 2014.
International Search Report dated May 13, 2014, corresponding to International application No. PCT/JP2014/052971.
Extended European Search Report in EP Application No. 14749170.8, dated Aug. 11, 2016.
Office Action in JP Application No. 2014-560830, dated Feb. 15, 2018, 3pp.
Office Action in ID Application No. P00201505476, dated Nov. 19, 2019, 4pp.

* cited by examiner

A301
A322
A200
A202
A310
A310
A302
A200Y
A311
A311
A320
A200X
A321
A321
A100Y
A321
A321
A321

PRODUCTION METHOD AND PRODUCTION APPARATUS FOR CLEANING IMPLEMENT

RELATED APPLICATIONS

The present application is a National Phase of International Application Number PCT/JP2014/052971, filed Feb. 7, 2014, and claims benefit of U.S. Application No. 61/762,533, filed on Feb. 8, 2013.

TECHNICAL FIELD

The present invention relates to a method and a device for manufacturing a cleaning tool for cleaning an object to be cleaned.

BACKGROUND ART

Japanese non-examined laid-open Patent Publication No. 2002-369783 discloses a cleaning tool having a cleaning sheet and a holder for holding the cleaning sheet. The cleaning sheet is formed by bonding a sheet part formed of nonwoven fabric or the like and a fiber assembly formed of filaments at a bonded part.

PRIOR ART DOCUMENT

Patent Documents

Patent Document 1: JP-A No. 2002-369783

SUMMARY OF THE INVENTION

Problem to be Solved by the Invention

When manufacturing the cleaning sheet disclosed in JP-A No. 2002-369783, first, a material for forming the sheet part and a material for forming the fiber assembly are fed. Next, the material for forming the sheet part and the material for forming the fiber assembly are superposed one on the other. Then the movement of the superposed materials are temporarily stopped. During the temporary stop, the superposed materials are bonded together. Upon completion of bonding the superposed materials, the temporary stop is released. Thereafter, the superposed materials are cut to obtain a desired cleaning sheet.

Specifically, when manufacturing the cleaning tool and the cleaning sheet which are disclosed in Japanese non-examined laid-open Patent Publication No. 2002-369783, a step of temporarily stopping the superposed materials is required. Therefore, it is difficult to realize high speed production.

Accordingly, it is an object of the present invention to provide a more rational constructing technique relating to a method and a device for manufacturing a cleaning tool.

Means for Solving the Problem

In order to solve the above-described problem, a preferred aspect of the present invention is provided relating to a method of manufacturing a cleaning tool having a cleaning sheet and a holder for holding the cleaning sheet.

The manufacturing method according to the present invention has a step of feeding a plurality of band-like elements for forming the cleaning sheet, a step of superposing the band-like elements, a step of feeding the superposed band-like elements to a bonding device having a drum roller and a bonding section, and a step of forming a bonded region in a prescribed region of the superposed band-like elements by the bonding device.

Thus, in the manufacturing method of the cleaning tool according to the present invention, the band-like element can be continuously conveyed when forming the bonded region in the superposed band-like elements. Therefore, high speed production of the cleaning tool can be realized.

According to a further aspect of the manufacturing method of the present invention, the bonding section has a bonded region forming section.

According to a further aspect of the manufacturing method of the present invention, the bonding section has a first bonded region forming section and a second bonded region forming section.

The first bonded region forming section forms a first bonded region in the prescribed region of the superposed band-like elements, and the second bonded region forming section forms a second bonded region in the prescribed region of the superposed band-like elements.

Specifically, the bonded region includes the first bonded region and the second bonded region, so that the bonded region can be configured to reliably bond the band-like elements.

According to a further aspect of the manufacturing method of the present invention, the first bonded region and the second bonded region overlap with each other. Therefore, the band-like elements can be reliably bonded by a region where the first bonded region and the second bonded region overlap with each other.

According to a further aspect of the manufacturing method of the present invention, the first bonded region and the second bonded region do not overlap with each other. By provision of such a structure, the bonded region can be formed having higher freedom of design.

According to a further aspect of the manufacturing method of the present invention, the first bonded region has a different area from the second bonded region. Therefore, the degree of freedom in forming the bonded region can be ensured.

According to a further aspect of the manufacturing method of the present invention, the first bonded region and the second bonded region have the same area. Therefore, the degree of freedom in forming the bonded region can be ensured.

According to a further aspect of the manufacturing method of the present invention, the bonding device has a plurality of bonding sections for a single drum roller. Therefore, in the bonding device having the single drum roller, the band-like elements can be bonded in various patterns of bonding. Further, by provision of the single drum roller, the cost of the manufacturing device can be reduced.

According to a further aspect of the manufacturing method of the present invention, the bonding device includes a first bonding device and a second bonding device. By provision of the first and second bonding devices, the band-like elements can be bonded in various patterns of bonding.

According to a further aspect of the manufacturing method of the present invention, the band-like elements each are a sheet material formed of nonwoven fabric.

According to a further aspect of the manufacturing method of the present invention, the band-like elements each are a fiber material formed of filaments.

According to a further aspect of the manufacturing method of the present invention, the superposed band-like elements are formed by a plurality of such sheet materials.

According to a further aspect of the manufacturing method of the present invention, the superposed band-like elements are formed by a plurality of such fiber materials.

According to a further aspect of the manufacturing method of the present invention, the superposed band-like elements are formed by the sheet material and the fiber material.

According to a further aspect of the manufacturing method of the present invention, the superposed band-like elements form a laminate.

According to a further aspect of the manufacturing method of the present invention, the bonding device forms the bonded region in the laminate, thereby forming a bonded part at which the band-like elements forming the laminate are bonded together.

According to a further aspect of the manufacturing method of the present invention, the laminate includes a first laminate and a second laminate.

According to a further aspect of the manufacturing method of the present invention, the first bonding device forms the bonded part in the first laminate, and the second bonding device forms the bonded part in the first laminate and the second laminate. Specifically, the laminate and a plurality of laminates can be provided with different bonded parts. Therefore, a desired cleaning tool can be obtained.

According to a further aspect of the manufacturing method of the present invention, the cleaning sheet has a sheet part and a fiber assembly.

According to a further aspect of the manufacturing method of the present invention, the sheet part is formed by cutting the sheet material.

According to a further aspect of the manufacturing method of the present invention, the fiber assembly is formed by cutting the fiber material.

According to a further aspect of the manufacturing method of the present invention, the cleaning sheet is configured such that the sheet part is formed to be shorter than the fiber assembly in a prescribed direction.

According to a further aspect of the manufacturing method of the present invention, the cleaning sheet is configured such that the fiber assembly is arranged on both sides of the sheet part.

In order to solve the above-described problem, a preferred aspect of the present invention is provided relating to a device for manufacturing a cleaning tool having a cleaning sheet and a holder for holding the cleaning sheet.

The manufacturing device of the cleaning tool includes a device for feeding a plurality of band-like elements for forming the cleaning sheet, a device for superposing the band-like elements, and a bonding device having a drum roller and a bonding section. Further, the bonding device forms a bonded region in a prescribed region of the superposed band-like elements.

Thus, in the manufacturing device of the cleaning tool according to the present invention, the band-like elements can be continuously conveyed when forming the bonded region in the superposed band-like elements. Therefore, high speed production of the cleaning tool can be realized.

Effect of the Invention

According to the present invention, a more rational constructing technique relating to a method and a device for manufacturing a cleaning tool can be provided.

BEST MODES FOR CARRYING OUT THE INVENTION (Summary of the Invention)

Figure 1:
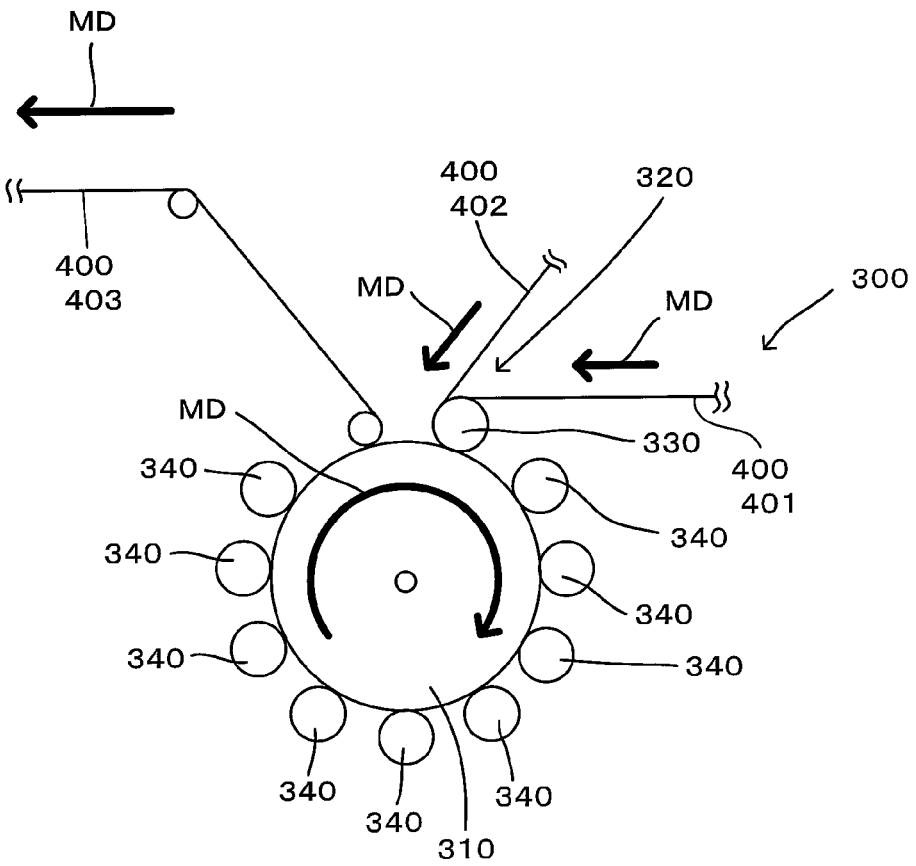
FIG. 1 schematically shows a bonding device according to the present invention.

An embodiment of the present invention is now explained with reference to FIGS. 1 to 93.

The present invention relates to a method and a device for manufacturing a cleaning tool A100 having a cleaning element A200 and a cleaning element holder A400 for holding the cleaning element A200.

The cleaning element A200, the cleaning element holder A400 and the cleaning tool A100 are example embodiments that correspond to the "cleaning sheet", the "holder" and the "cleaning tool", respectively, according to the present invention. The structures of the cleaning tool A100, the cleaning element A200 and the cleaning element holder A400 are described in detail below.

A method for manufacturing the cleaning tool A100 and a method for manufacturing the cleaning element A200 have a step of feeding a plurality of band-like elements 400 for forming the cleaning element A200, a step of superposing the band-like elements 400, a step of feeding the superposed band-like elements 400 to a bonding device 300 having a drum roller 310 and a bonding section 320, and a step of forming a bonded region 500 in a prescribed region of the superposed band-like elements 400 by the bonding device 300.

The band-like elements 400, the drum roller 310, the bonding section 320, the bonding device 300 and the bonded region 500 are example embodiments that correspond to the "band-like element", the "drum roller", the "bonding section", the "bonding device" and the "bonded region", respectively, according to the present invention.

(Outline of the Bonding Device)

The bonding device according to the present invention is now explained with reference to FIGS. 1 to 9. Several embodiments of the bonding devices are provided according to the present invention. First, an embodiment of the bonding device as shown in FIG. 1 is explained.

Figure 2:
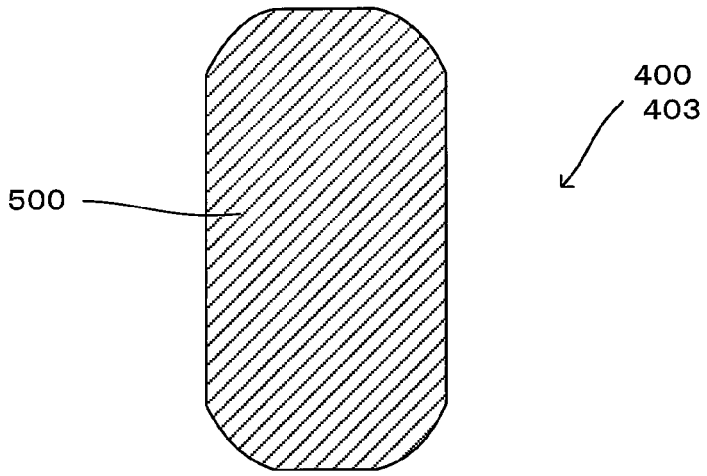
FIG. 2 schematically shows a bonded region according to the present invention.

The bonding device 300 has the drum roller 310 that is rotated in a machine direction MD, and the bonding section 320. A mechanism for rotationally driving the drum roller 310 is well known and therefore its further description is omitted. The bonding device 300 forms the bonded region 500 in the band-like elements 400. Specifically, a first band-like element 401 and a second band-like element 402 are conveyed in the machine direction MD and fed to the bonding device 300. At this time, the first and second band-like elements 401, 402 are superposed one on the other. In the bonding device 300, the bonded region 500 is provided in the superposed first and second band-like element 401, 402 by the drum roller 310 and the bonding section 320. As shown in FIG. 2, the bonded region 500 is provided in a prescribed region of the superposed first and second band-like elements 401, 402. The superposed first and second band-like elements 401, 402 are bonded at the prescribed region by the bonded region 500. Further, the bonded region 500 forms a bonded part A320 in the cleaning element A200 which is described below. The bonded part A320 is an example embodiment that corresponds to the "bonded part" according to the present invention. The first and second band-like elements 401, 402 bonded at the prescribed region form a third band-like element 403. The third band-like element 403 is conveyed in the machine direction MD to the next step. Further, the bonding device 300 has a plurality of pressing rollers 340 for fixing the band-like elements 400 (the first band-like element 401, the second band-like element 402, the third band-like element 403) to the drum roller 310.

Specifically, the band-like elements 400 are conveyed following rotation of the drum roller 310. Therefore, the bonding device 300 can form the bonded region 500 in the band-like elements 400 without stopping conveyance of the band-like elements 400.

The bonding section 320 is formed by a bonded region forming section 330. Specifically, the bonded region forming section 330 can be formed by an embossing roller. The bonded region forming section 330 is an example embodiment that corresponds to the "bonded region forming section" according to the present invention.

The embossing roller has a projection (not shown) for forming the bonded region 500 and a heating part (not shown) for heating the projection. Further, the projection and the heating part can be appropriately selected from the structures of well-known heat sealing devices, and therefore their detailed description is omitted. The projection and the heating part may be provided not in the embossing roller but in the drum roller 310. By the bonding section 320 having such a structure, the prescribed region of the band-like element 400 is thermally melted so that the bonded region 500 can be formed.

Further, the bonded region forming section 330 is not limited to the embossing roller, but known techniques disclosed, for example, in Japanese non-examined laid-open Patent Publication Nos. 2002-355270, 2005-205026, 2004-298413 and 2012-76342 can also be used.

The band-like element 400 is formed in an elongate form and conveyed in a rolled form into the device. The band-like element 400 can be a sheet material A340 formed of, for example, nonwoven fabric. Further, the band-like element 400 can also be a fiber material A230 formed of filaments.

The superposed band-like elements 400 can be formed by superposing a plurality of sheet materials A340. Further, the superposed band-like elements 400 can also be formed by a plurality of fiber materials A230. The superposed band-like elements 400 can also be formed by the sheet material A340 and the fiber material A230.

Further, the superposed band-like elements 400 form a laminate A500.

The sheet material A340, the fiber material A230 and the laminate A500 are described in further detail below.

The sheet material A340, the fiber material A230 and the laminate 500 are example embodiments that correspond to the "sheet material", the "fiber material" and the "laminate", respectively, according to the present invention.

Figure 3:
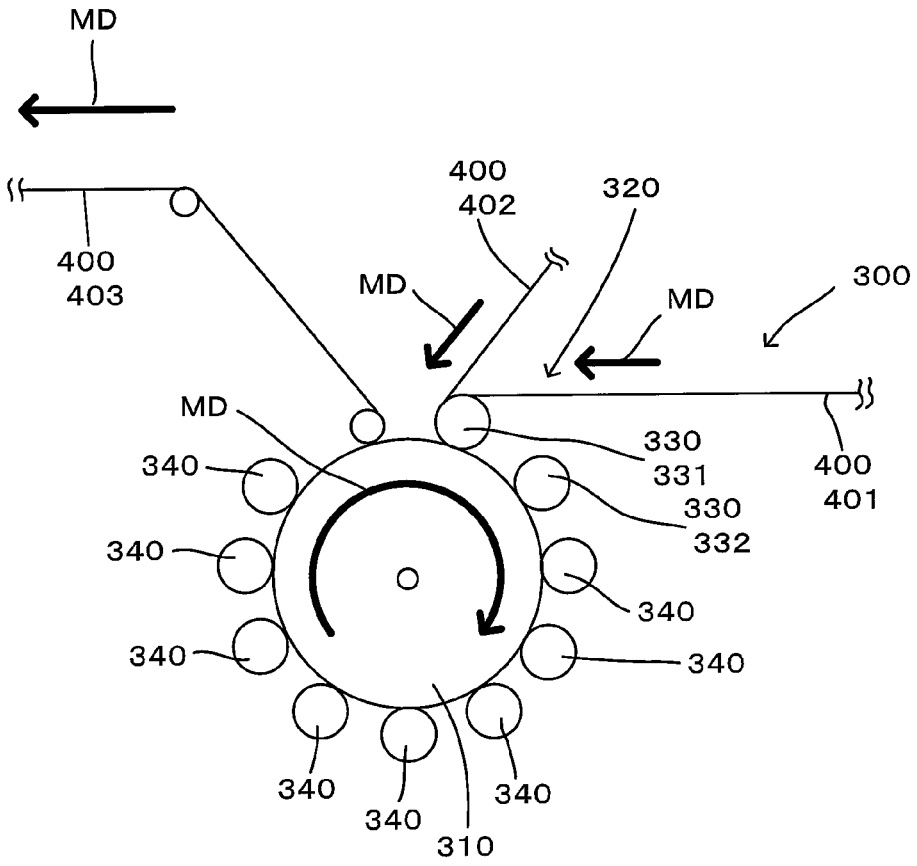
FIG. 3 schematically shows the bonding device according to the present invention.

Another embodiment of the bonding device 300 is now explained with reference to FIG. 3. The bonding device 300 shown in FIG. 3 has a single bonding section 320 for a single drum roller 310. The single bonding section 320 has a plurality of bonded region forming sections 330. In FIG. 3, the bonded region forming section 330 includes a first bonded region forming section 331 and a second bonded region forming section 332. Further, two or more bonded region forming sections 330 may be formed.

The first bonded region forming section 331 and the second bonded region forming section 332 are example embodiments that correspond to the "first bonded region forming section" and the "second bonded region forming section", respectively, according to the present invention.

The bonding device 300 having the drum roller 310 and the bonded region forming section 330 can form the bonded region 500 without temporarily stopping the band-like element 400, so that high-speed manufacturing can be realized by the bonding device 300. In high-speed manufacturing, the passing speed of the band-like element 400 increases. Therefore, heat necessary for forming the bonded region 500 may not be applied to the band-like element 400. On the other hand, if the temperature of the bonded region forming section 330 is raised, the band-like element 400 may be ruptured due to the high temperature.

The bonding device 300 shown in FIG. 3 is effective in solving such a problem. Specifically, a desired bonded region 500 is formed by a plurality of bonded region forming sections 330, so that it is not necessary to highly raise the temperature of each of the bonded region forming sections 330. Thus, the bonded region 500 can be reliably formed without rupture of the band-like element 400.

The first bonded region forming section 331 forms a first bonded region 501 in the band-like element 400 and the second bonded region forming section 332 forms a second bonded region 502 in the band-like element 400. The first bonded region 501 and the second bonded region 502 are example embodiments that correspond to the "first bonded region" and the "second bonded region", respectively, according to the present invention.

The first bonded region 501 and the second bonded region 502 can be identically shaped. Further, the first bonded region 501 and the second bonded region 502 can also be differently shaped.

Embodiments of the first bonded region 501 and the second bonded region 502 are explained with reference to FIGS. 4 to 7.

Figure 4:
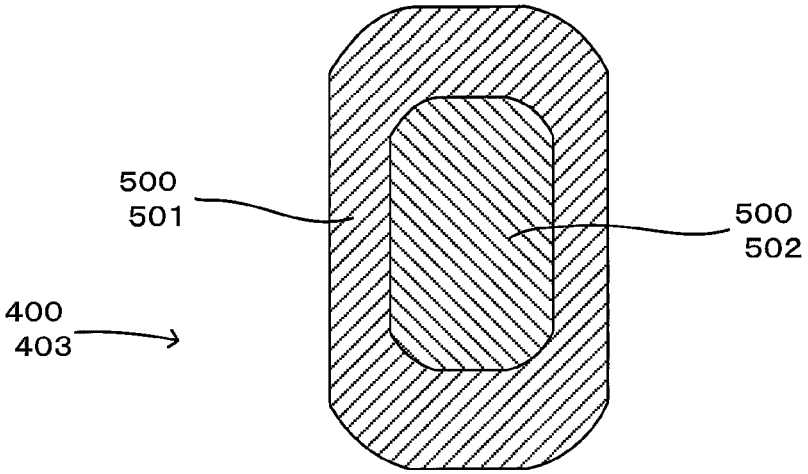
FIG. 4 schematically shows the bonded region according to the present invention.

FIG. 4 shows an embodiment in which the first bonded region 501 and the second bonded region 502 have different areas. Specifically, in the case shown in FIG. 4, the first bonded region 501 has a larger area than the second bonded region 502.

In this case, the second bonded region 502 entirely overlaps with the first bonded region 501, so that the band-like element 400 is reliably bonded at a region where the first bonded region 501 and the second bonded region 502 overlap with each other.

Figure 5:
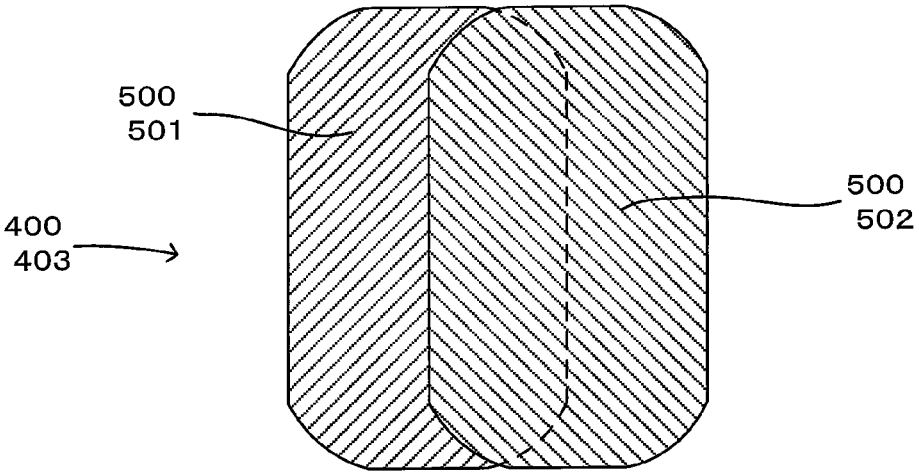
FIG. 5 schematically shows the bonded region according to the present invention.

FIG. 5 shows an embodiment in which the first bonded region 501 and the second bonded region 502 have the same area. In the embodiment shown in FIG. 5, the positions of the first bonded region 501 and the second bonded region 502 in the band-like element 400 are shifted from each other, so that an overlap of the first bonded region 501 and the second bonded region 502 can be formed. By provision of such a structure, the band-like element 400 is reliably bonded at a region where the first bonded region 501 and the second bonded region 502 overlap with each other.

Figure 6:
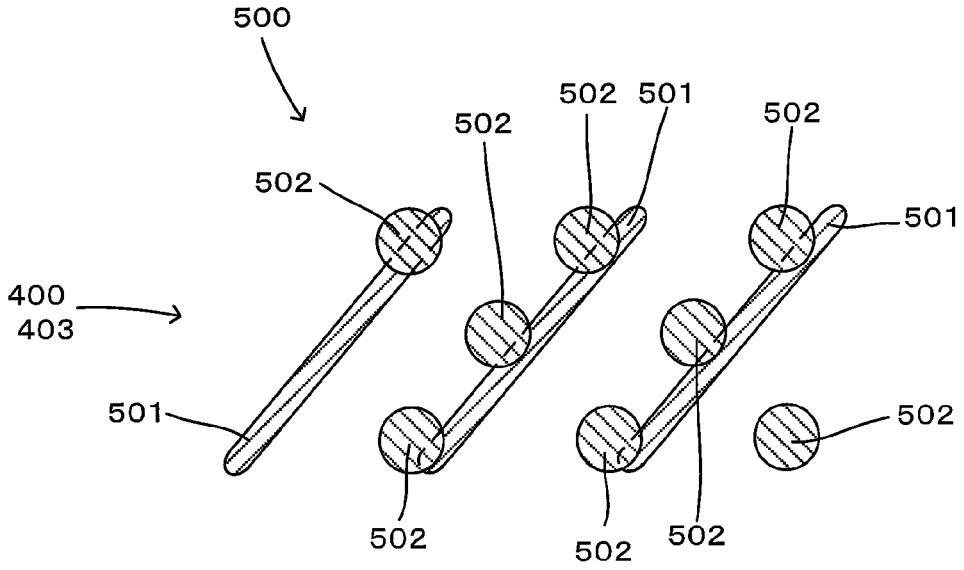
FIG. 6 schematically shows the bonded region according to the present invention.

FIG. 6 shows an embodiment in which the first bonded regions 501 have a different shape from the second bonded regions 502. In the embodiment shown in FIG. 6, the first bonded regions 501 have a linear shape and are spaced apart from each other. The second bonded regions 502 have a dot-like shape and are spaced apart from each other.

In the case shown in FIG. 6, the first bonded regions 501 and the second bonded regions 502 can also be arranged to overlap with each other. Therefore, the band-like element 400 is reliably bonded at the regions where the first bonded regions 501 and the second bonded regions 502 overlap with each other.

Figure 7:
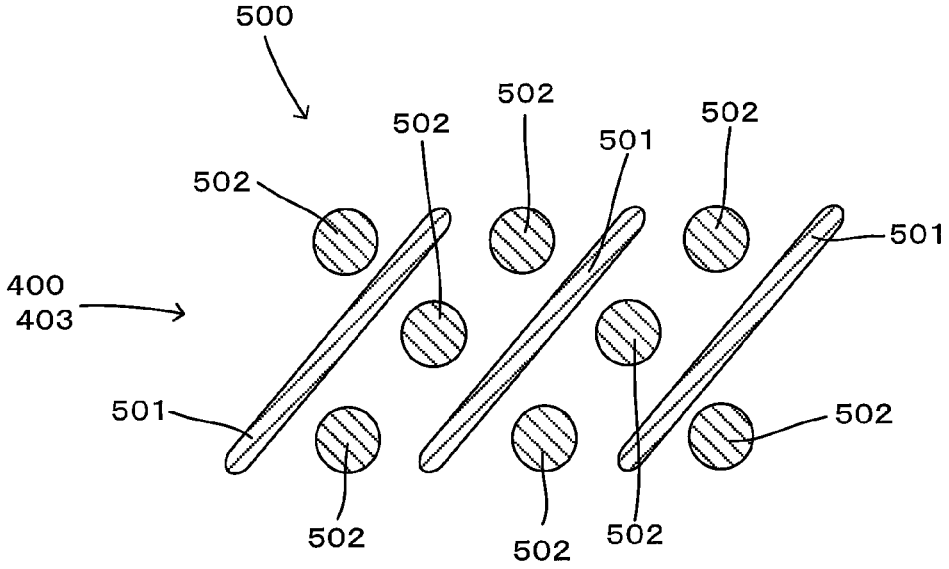
FIG. 7 schematically shows the bonded region according to the present invention.

FIG. 7 shows an embodiment in which the first bonded regions 501 and the second bonded regions 502 do not overlap with each other. In the embodiment shown in FIG. 7, the first bonded regions 501 have a linear shape and are spaced apart from each other, and the second bonded regions 502 have a dot-like shape and are spaced apart from each other. Further, the second bonded regions 502 are formed between adjacent ones of the first bonded regions 501 in the band-like element 400.

In the embodiment shown in FIG. 7, the first bonded region 501 and the second bonded region 502 do not overlap with each other. However, remaining heat generated when the first bonded region 501 is formed by the first bonded region forming section 331 remains in between the adjacent first bonded regions 501. Therefore, the regions between the adjacent first bonded regions 501 can be easily heated by the second bonded region forming section 332, so that the second bonded region 502 is reliably formed.

Figure 8:
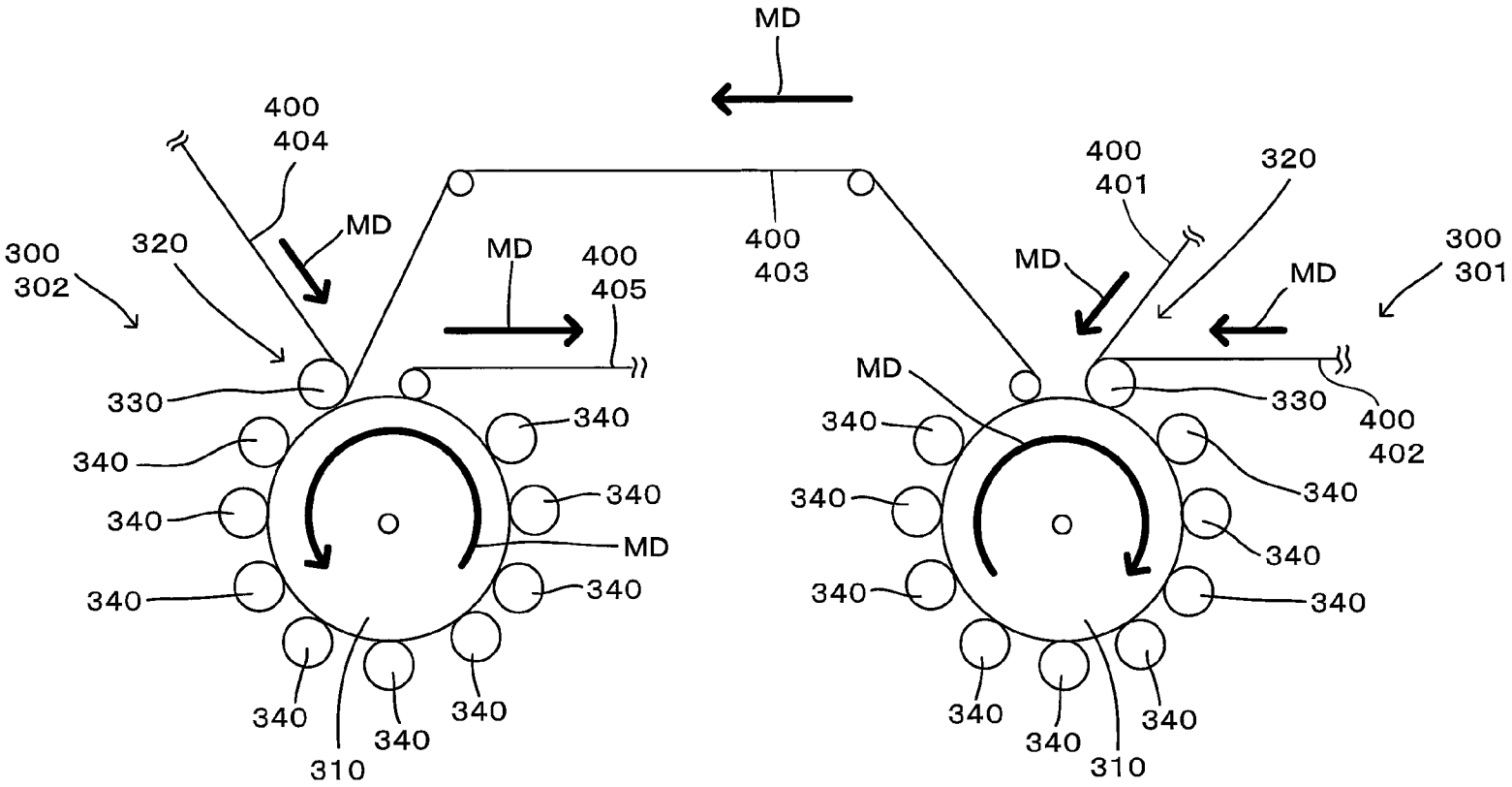
FIG. 8 schematically shows the bonding device according to the present invention.

FIG. 8 shows a different embodiment of the bonding device 300. A cleaning tool manufacturing device or a cleaning sheet manufacturing device can have a plurality of bonding devices 300. The bonding device 300 shown in FIG. 8 has a first bonding device 301 and a second bonding device 302. The first bonding device 301 and the second bonding device 302 are example embodiments that correspond to the "first bonding device" and the "second bonding device", respectively, according to the present invention. The cleaning tool manufacturing device or the cleaning sheet manufacturing device can also have more bonding devices 300.

By provision of such a structure, a greater variety of the bonded regions 500 can be obtained according to the superposed state of the band-like elements 400. Specifically, the first band-like element 401 and the second band-like element 402 are conveyed in the machine direction MD and fed to the first bonding device 301. The first band-like element 401 and the second band-like element 402 are bonded at the bonded region 500 by the first bonding device 301. The first band-like element 401 and the second band-like element 402 which are bonded together forms a third band-like element 403. The third band-like element 403 is conveyed in the machine direction MD and fed to the second bonding device 302. Further, a fourth band-like element 404 is fed to the second bonding device 302. At this time, the third band-like element 403 and the fourth band-like element 404 are superposed one on the other and bonded at the bonded region 500 by the second bonding device 302. When bonded together, the third band-like element 403 and the fourth band-like element 404 form a fifth band-like element 405. The fifth band-like element 405 is conveyed in the machine direction MD and fed to the other device.

Specifically, in the bonding device 300 shown in FIG. 8, the fifth band-like element 405 can be obtained. The fifth band-like element 405 has the bonded region 500 at which the first band-like element 401 and the second band-like element 402 are bonded together, and the bonded region 500 at which the third band-like element 403 (the first band-like element 401 and the second band-like element 402) and the fourth band-like element 404 are bonded together. In this manner, the bonding device 300 shown in FIG. 8 makes it possible to obtain the bonded regions 500 according to the laminated state of the band-like elements 400.

Figure 9:
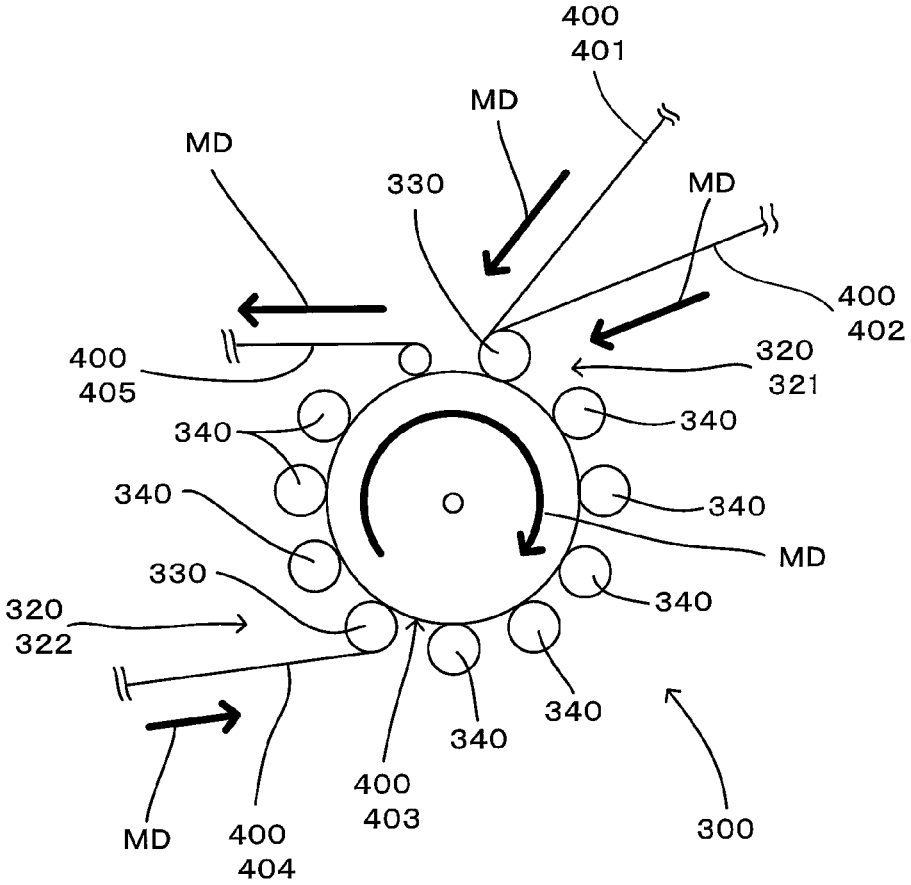
FIG. 9 schematically shows the bonding device according to the present invention.

FIG. 9 shows a different embodiment of the bonding device 300. The bonding device 300 can be provided with a plurality of bonding sections 320 for a single drum roller 310. The bonding device 300 shown in FIG. 9 has a first bonding section 321 and a second bonding section 322. The bonding device 300 can be provided with more bonding sections 320.

By provision of such a structure, a greater variety of the bonded regions 500 can be obtained according to the laminated state of the band-like element 400. Specifically, the first band-like element 401 and the second band-like element 402 are conveyed in the machine direction MD and fed to the bonding device 300. The first band-like element 401 and the second band-like element 402 are bonded at the bonded region 500 by the drum roller 310 and the first bonding section 321 and then form a third band-like element 403. The third band-like element 403 is conveyed and fed to the second bonding section 322 as the drum roller 310 is rotated in the machine direction MD. Further, a fourth band-like element 404 is fed to the second bonding section 322. At this time, the third band-like element 403 and the fourth band-like element 404 are superposed one on the other and bonded at the bonded region 500 by the drum roller 310 and the second bonding section 322. When bonded, the third band-like element 403 and the fourth band-like element 404 form a fifth band-like element 405. The fifth band-like element 405 is conveyed in the machine direction MD and fed to the other device.

Specifically, in the bonding device 300 shown in FIG. 9, the fifth band-like element 405 can be obtained. The fifth band-like element 405 has the bonded region 500 at which the first band-like element 401 and the second band-like element 402 are bonded together, and the bonded region 500 at which the third band-like element 403 (the first band-like element 401 and the second band-like element 402) and the fourth band-like element 404 are bonded together. In this manner, the bonding device 300 shown in FIG. 9 makes it possible to obtain the bonded regions 500 according to the laminated state of the band-like element 400. Further, by provision of the single drum roller 310, the manufacturing cost can be reduced.

(Structure of the Cleaning Tool)

An outline of the cleaning tool A100 according to the present invention is now explained with reference to FIGS. 10 to 15.

The cleaning tool A100 is a tool to clean objects to be cleaned. The objects to be cleaned typically include surfaces to be cleaned (floors, walls, windows, ceilings, external walls, furniture, clothes, curtains, bedding, lighting, home electric appliances, etc.) inside and outside of houses, apartments, buildings, factories, vehicles, etc. and surfaces of human body parts to be cleaned. The surfaces to be cleaned may be either flat or curved, uneven or stepped.

Figure 10:
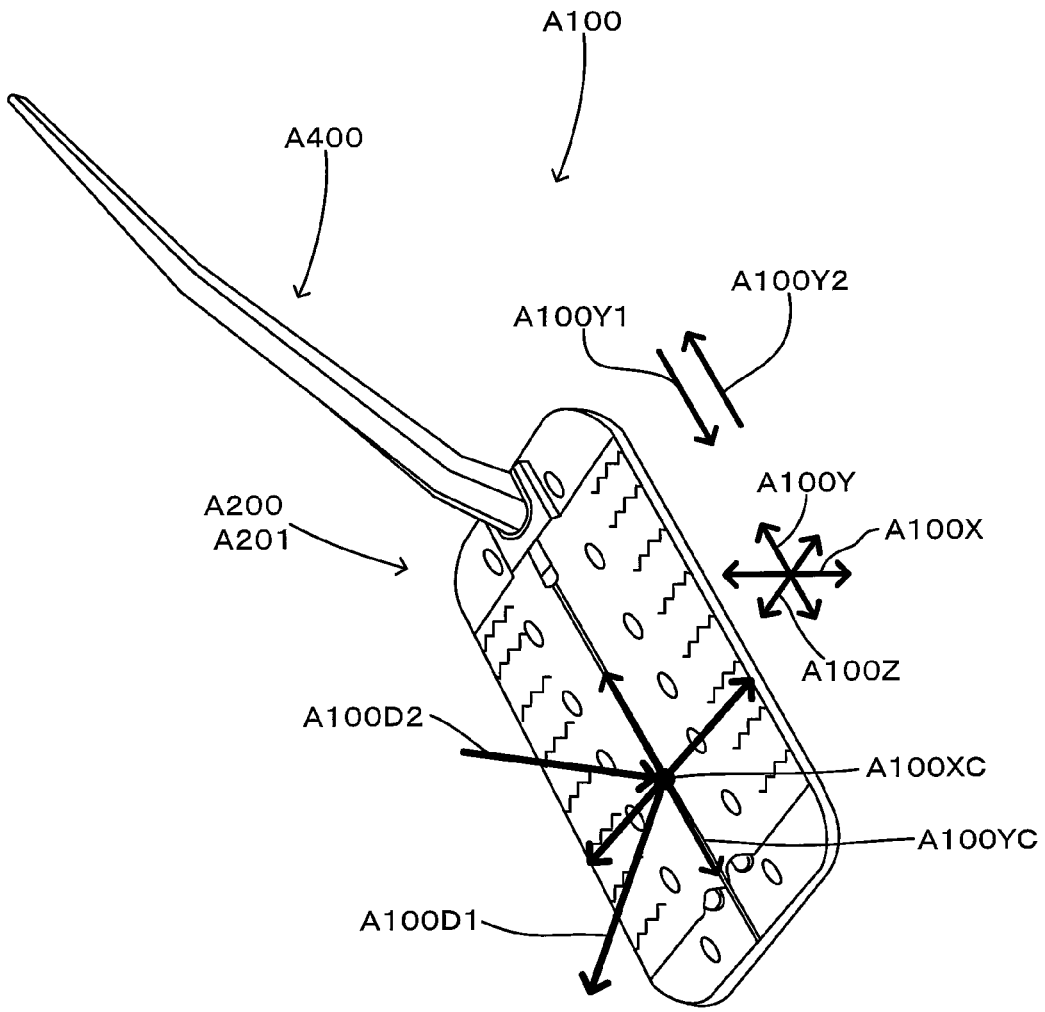
FIG. 10 is a perspective view showing a cleaning tool.

As shown in FIG. 10, the cleaning tool A100 includes the cleaning element holder A400 and the cleaning element A200. The cleaning element holder A400 is configured to be removably attached to the cleaning element A200 and to hold the cleaning element A200.

The cleaning tool A100 is configured to extend in a longitudinal direction A100Y and a transverse direction A100X which is defined by a direction crossing the longitudinal direction A100Y. The longitudinal direction A100Y is defined by a direction parallel to a direction of insertion of the cleaning element holder A400 into the cleaning element A200. The direction of insertion of the cleaning element holder A400 into the cleaning element A200 is defined as an inserting direction A100Y1, and a direction opposite to the inserting direction A100Y1 is defined as a pulling-out direction A100Y2.

A direction crossing the longitudinal direction A100Y and the transverse direction A100X is defined as a thickness direction A100Z. The term "crossing" as used in this specification means "perpendicularly crossing" unless otherwise specified.

A center point of the cleaning element A200 in the transverse direction A100X is defined as a transverse direction center point A100XC. The transverse direction center point A100XC can be formed on a line passing through any point on the cleaning element A200 in the transverse direction A100X.

A line passing through the transverse direction center point A100XC in parallel to the longitudinal direction A100Y is defined as a longitudinal direction center line A100YC.

A direction away from the transverse direction center point A100XC of the cleaning element A200 is defined as an outside direction A100D1, and a direction toward the transverse direction center point A100XC of the cleaning element A200 is defined as an inside direction A100D2.

(Structure of the Cleaning Element Holder)

Figure 11:
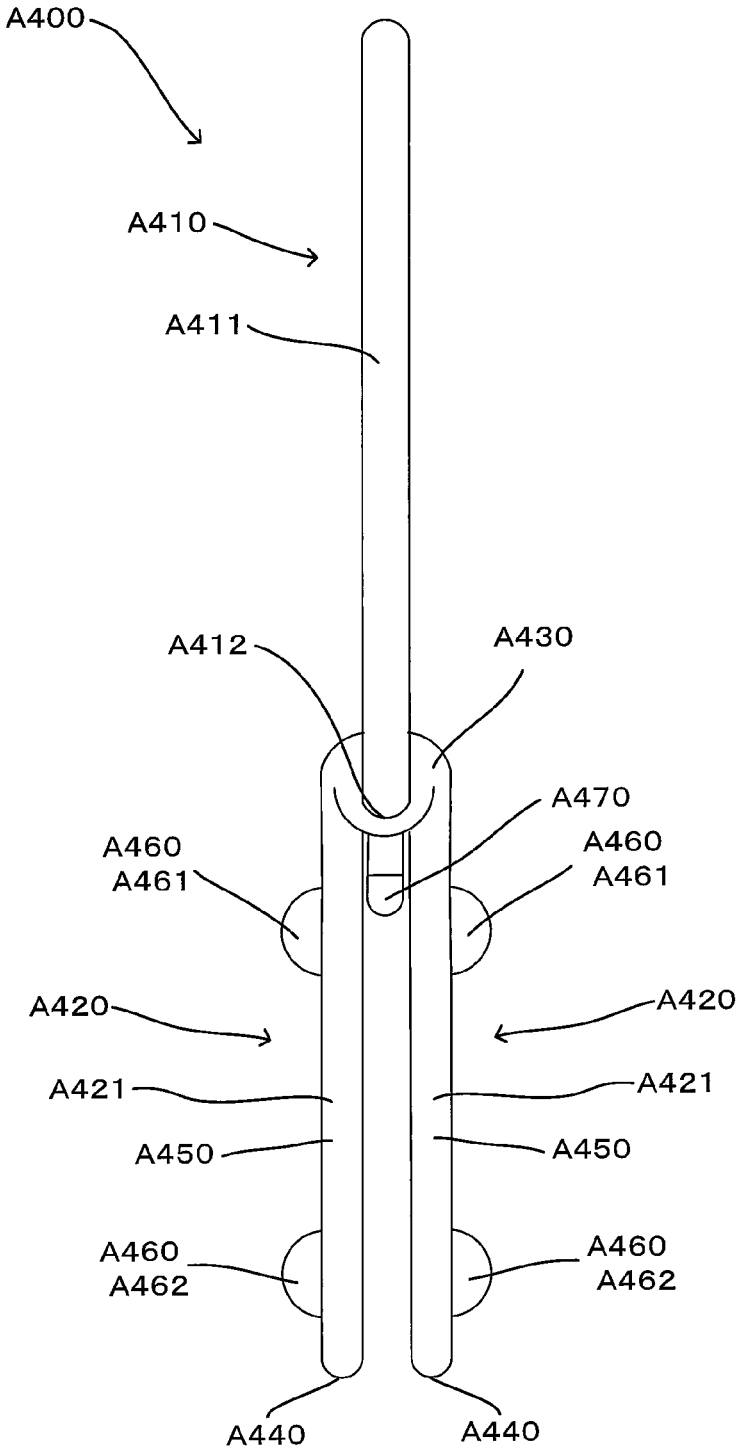
FIG. 11 shows a holder.

As shown in FIG. 11, the cleaning element holder A400 mainly includes a handle part A410 and a cleaning element holding part A420. The handle part A410 is an elongate member to be held by a user during cleaning. The handle part A410 has a handle A411 and a handle connecting part A412. The handle connecting part A412 is connected to a connection part A430 of the cleaning element holding part A420. The handle A411 extends in an elongate form from the handle connecting part A412.

The cleaning element holding part A420 is a member formed of resin material and is a configured to hold the cleaning element A200. The cleaning element holding part A420 mainly includes a pair of elongate holding members A421, a projection A460 and a retaining plate A470. Specifically, the cleaning element holding part A420 is formed by using polypropylene (PP). Further, the cleaning element holding part A420 can be formed by using an appropriately selected flexible resin material, such as polyethylene (PE), polyethylene terephthalate (PET), acrylonitrile-butadiene-styrene resin (ABS) and polyester thermoplastic elastomer.

Each of the holding members A421 extends from the connection part A430 in a direction opposite to the direction in which the handle A411 extends. Specifically, the holding member A421 has the connection part A430, a tip part A440 and an intermediate part A450 extending from the connection part A430 to the tip part A440. The tip part A440 of the holding member A421 is a free end.

The projection A460 is formed in the outside direction A100D1 in the intermediate part A450. The projection A460 includes a first projection A461 formed on the connection part A430 side and a second projection A462 formed on the tip part A440 side.

The retaining plate A470 protrudes from the connection part A430 and extends in parallel to the pair holding members A421 therebetween. The retaining plate A470 is a plate-like member convexly curved in a downward direction in FIG. 10, and further has an engagement lug (not shown) on the underside in FIG. 10.

(Structure of the Cleaning Element)

The cleaning element A200 is now explained. The cleaning element A200 has a sheet-like form and has a dirt collecting function of collecting dust or dirt on an object to be cleaned. As shown in FIG. 10, the cleaning element A200 is rectangular in plan view.

The cleaning element A200 may be of disposable type designed for single use, disposable type designed for multiple use which can be used several times, while holding dust or dirt collected from a surface of an object to be cleaned, or reusable type which can be reused by washing.

The cleaning element A200 can have various structures. As the cleaning element A200 according to the present invention, a first cleaning element A201, a second cleaning element A202 and a third cleaning element A203 are now described.

First, a basic structure of the cleaning element A200 is explained based on the first cleaning element A201. Further, as for the second cleaning element A202 and the third cleaning element A203 which are described below, components or elements which are substantially identical to those in the first cleaning element A201 are given like numerals and may not be described.

(Structure of the First Cleaning Element)

A structure of the first cleaning element A201 is explained with reference to FIGS. 12 to 15. The first cleaning element A201 has ends A200Y in the longitudinal direction A100Y and ends A200X in the transverse direction A100X.

The first cleaning element A201 has a sheet part A300 formed by the band-like element 400. The sheet part A300 includes a first sheet part A301, a second sheet part A302 and a third sheet part A303. The band-like element 400 forming the sheet part A300 is defined as a sheet material A340. The first sheet part A301, the second sheet part A302 and the third sheet part A303 are formed by a first sheet material A341, a second sheet material A342 and a third sheet material A343, respectively.

The sheet part A300 has one side A300A and the other side A300B. The one side A300A and the other side A300B may be defined as "one side A300A" and "the other side A300B", respectively.

A fiber assembly A220 is arranged on the one side A300A of the first sheet part A301. The second sheet part A302 is arranged on the other side A300B of the first sheet part A301.

The first sheet part A301, the fiber assembly A220 and the second sheet part A302 which are thus superposed one on the other extend in an elongate form in the longitudinal direction A100Y of the first cleaning element A201.

The fiber assembly A220 forms a brush part A210 having a dirt collecting function.

The fiber assembly A220 is formed by an assembly of fibers. In this invention, the fiber is a single fiber structure formed by typical fibers, a fiber structure having typical fibers aligned in the length direction and/or the radial direction (twist yarn, spun yarn, yarn to which a plurality of filaments are partially connected), or an assembly of the fiber structures. The "typical fibers" as used herein are components of yarn, textile or the like and are thin and flexible fibers having a substantially longer length compared with the thickness. Typically, a long continuous fiber is defined as a filament and a short fiber as a staple. The fibers contain thermoplastic fibers in part and can be fusion bonded (or welded).

The fiber assembly A220 is formed of fibers which are arranged side by side along a prescribed direction of fiber orientation and stacked in the thickness direction A100Z. In this embodiment, the direction of fiber orientation substantially coincides with the transverse direction A100X. The fibers are flexible and thus easily bent and deformed. Therefore, the direction of fiber orientation of the fibers refers to the fiber orientation in design of the product.

Figure 12:
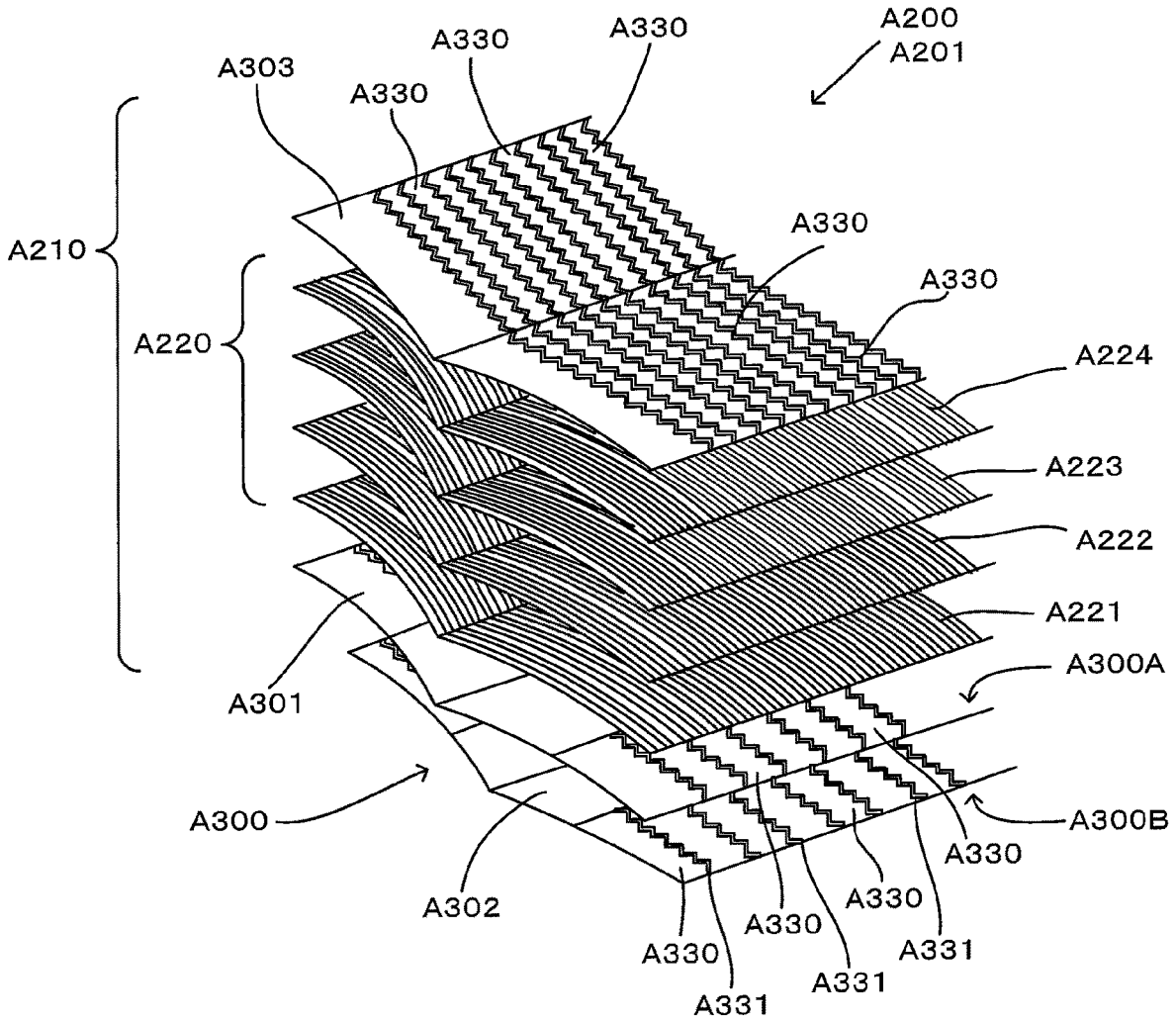
FIG. 12 is an exploded perspective view showing a cleaning element.

In FIG. 12, the fiber assembly A220 includes a first fiber assembly A221, a second fiber assembly A222, a third fiber assembly A223 and a fourth fiber assembly A224. The four fiber assemblies A221, A222, A223, A224 show the states of the fiber material A230 used in the manufacturing process. Specifically, the band-like element 400 forming the fiber assembly A220 is formed by the fiber material A230. The first fiber assembly A221, the second fiber assembly A222, the third fiber assembly A223 and the fourth fiber assembly A224 are formed by a first fiber material A231, a second fiber material A232, a third fiber material A233 and a fourth fiber material A234, respectively. In place of the four fiber assemblies A221, A222, A223, A224, a smaller or larger number of the fiber assemblies may be provided according to the use of the cleaning elements A200.

Preferably, the fiber assembly A220 has a planar structure having a prescribed flat or curved surface and has a three-dimensional form having a certain thickness or has a thin sheet-like form. The fiber assembly A220 is typically formed of polyethylene (PE), polypropylene (PP), polyethylene terephthalate (PET), nylon, rayon or the like. In practical use, an assembly of filaments formed by opening a tow is preferably used as the fiber assembly A220. It is particularly preferable that the fiber assembly A220 comprises conjugated fibers having a core of polypropylene (PP) or polyethylene terephthalate (PET) and a core covering sheath of polyethylene (PE). The fibers of the fiber assembly A220 preferably have a fineness of 1 to 50 dtex, more preferably 2 to 10 dtex. Each fiber assembly may contain fibers of substantially the same fineness, or it may contain fibers of different finenesses.

Further, in order to enhance the dirt collecting function in cleaning, oil is applied to the fiber assembly A220. The oil is mainly composed of liquid paraffin.

Further, in order to enhance the sweeping-out function in cleaning, it is preferred to use the fiber assembly A220 including the fibers having higher rigidity or the fibers having higher fineness. It is further preferred that the fiber assembly A220 has crimped fibers. Here, the crimped fibers are fibers subjected to a well-known crimping process and easily intertwined with each other. By provision of the crimped fibers, the fiber assembly A220 becomes bulkier than before the cleaning element holder A400 is attached to the cleaning element, and dust can be easily captured by the crimped portions. This structure can be realized especially by using crimped fibers opened from tows.

Figure 13:
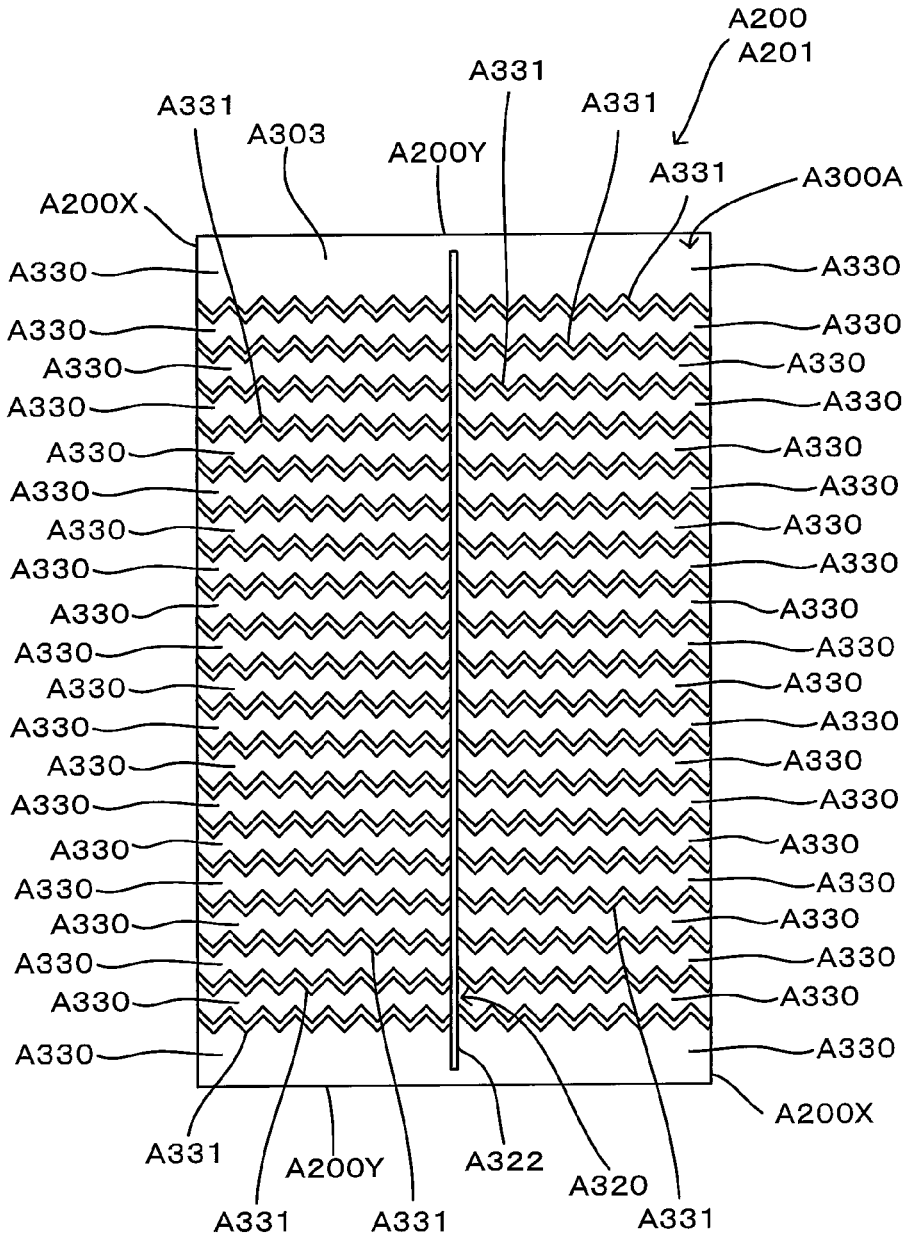
FIG. 13 is a view of a first cleaning element as viewed from one side.

FIG. 13 shows the first cleaning element A201 as viewed from the one side A300A. The third sheet part A303 is arranged on a top of the one side A300A in the first cleaning element A201. The third sheet part A303 has a plurality of cuts A331 and a plurality of strips A330 formed between pairs of cuts A331.

Figure 14:
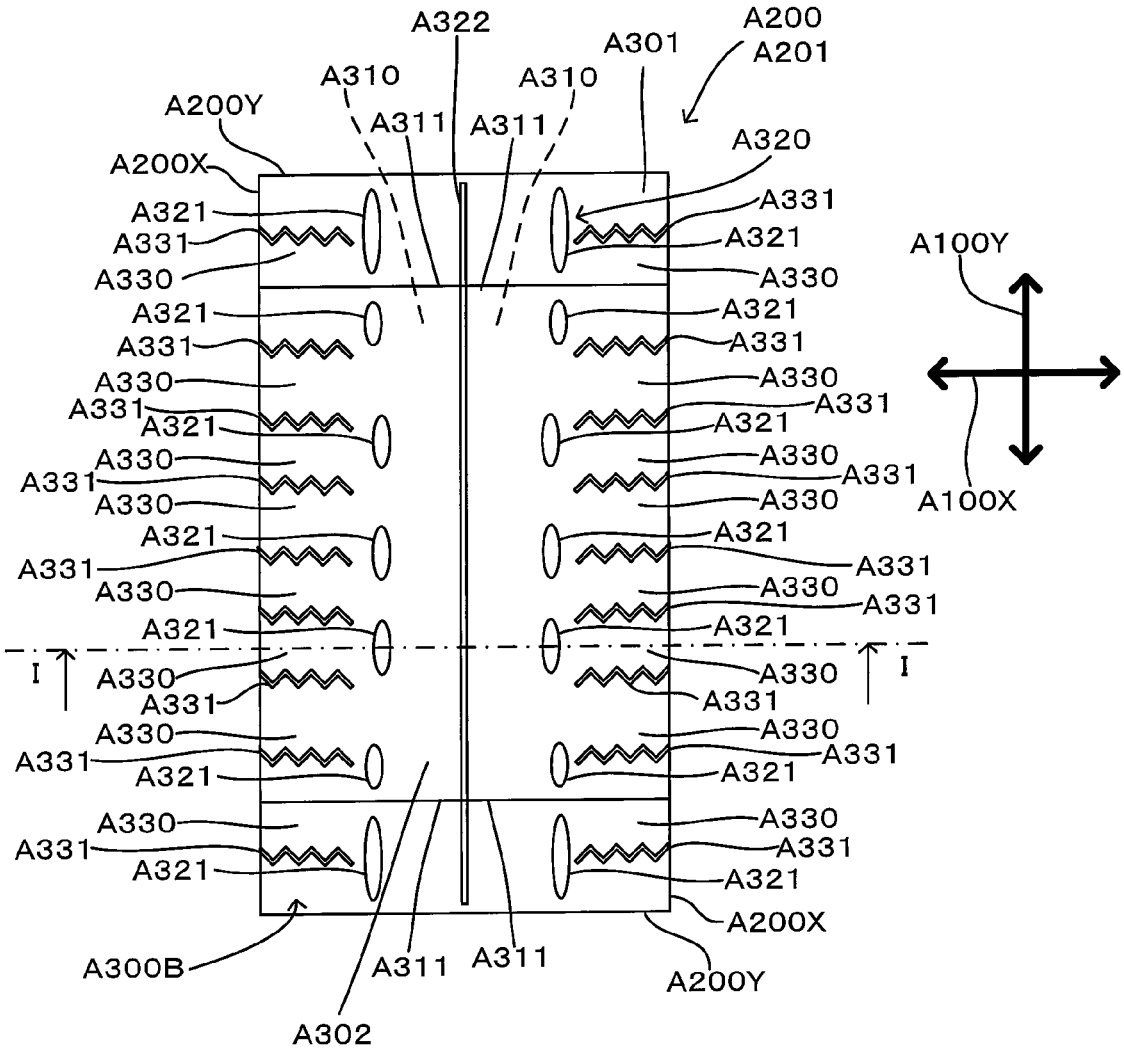
FIG. 14 is a view of the first cleaning element as viewed from the other side.
Figure 15:
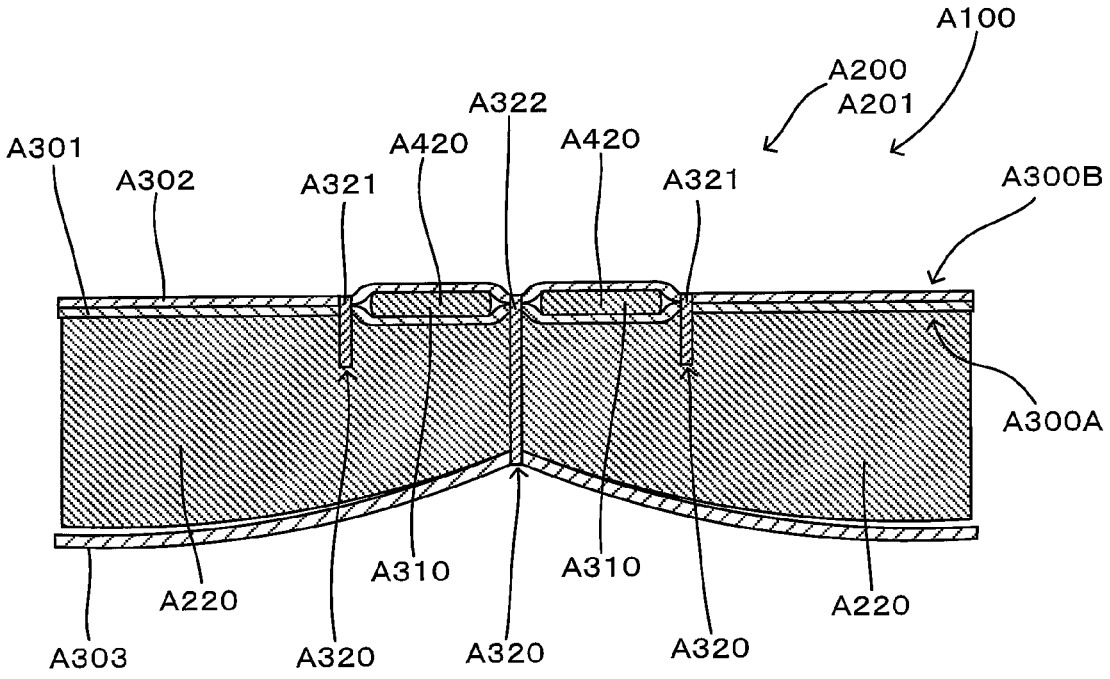
FIG. 15 is a sectional view taken along line I-I in FIG. 14.

FIG. 14 shows the first cleaning element A201 as viewed from the other side A300B.

As shown in FIG. 14, the second sheet part A302 is a rectangular nonwoven fabric sheet which is shorter than the first sheet part A301 in the longitudinal direction A100Y.

The first, second and third sheet parts A301, A302, A303 are typically formed of sheet-like nonwoven fabric comprising thermal melting fibers (thermoplastic fibers). Therefore, the first, second and third sheet parts A301, A302, A303 are also referred to as "nonwoven fabric sheet". Further, in order to enhance the sweeping-out function in cleaning, it is preferred to use the nonwoven fabric having higher rigidity.

Further, the nonwoven fabric is formed of synthetic fibers such as polyethylene (PE), polypropylene (PP) and polyethylene terephthalate (PET). The nonwoven fabric is manufactured by through-air bonding or spun bonding.

Not only the nonwoven fabric, however, cloth or synthetic resin film may also be used.

The first cleaning element A201 has the bonded part A320 formed by the bonded region 500. The bonded part A320 has a first bonded part A321 and a second bonded part A322.

Specifically, the second bonded part A322 extends along the longitudinal direction center line A100YC of the first cleaning element A201. A plurality of first bonded parts A321 are provided on both sides of the second bonded part A322.

The first sheet part A301, the second sheet part A302, the fiber assembly A220 and the third sheet part A303 are welded at the second bonded part A322. Further, the first sheet part A301, the second sheet part A302 and part of the fiber assembly A220 are welded at the first bonded parts A321. The first bonded parts A321 are located on the both end regions in the longitudinal direction A100Y where the second sheet part A302 does not exist. Therefore, the first bonded parts A321 located on the both end regions in the longitudinal direction A100Y bond only the first sheet part A301 and part of the fiber assembly A220.

A pair of holding spaces A310 are formed between the first sheet part A301 and the second sheet part A302 in a region between the first bonded parts A321 and the second bonded part A322 and extend in the longitudinal direction A100Y. Further, each of the holding spaces A310 has insertion openings A311 on the both ends in the longitudinal direction A100Y.

In other words, the holding spaces A310 are formed by a prescribed region of the first sheet part A301 and a prescribed region of the second sheet part A302 which extend between the pair first bonded parts A321 in the transverse direction A100X.

The first bonded parts A321 are continuously formed substantially along the longitudinal direction A100Y. It is not necessary for adjacent ones of the first bonded parts A321 in the longitudinal direction A100Y to be aligned in the longitudinal direction A100Y. The arrangement pattern of the first bonded parts A321 can be appropriately designed according to the designability and the shape of the cleaning element holding part A420. Naturally, the first bonded part A321 may also be formed in a continuous linear shape.

The first bonding parts A321 and the second bonded part A322 which are described above are formed by heat welding.

The bonded parts according to this invention may also be formed by ultrasonic welding, sewing or adhesives such as a hot-melt adhesive.

The first cleaning element A201 has strips A330. The strips A330 are formed between a plurality of cuts A331 in the end regions of the first, second and third sheet parts A301, A302, A303 in the transverse direction A100X.

Further, the cuts A331 are formed in zigzag. By provision of the zigzag strips A330, a structure having an excellent cleaning function, or particularly a function capable of easily catching and capturing dust or dirt can be realized. Further, the strips 150 may have a single kind or plural kinds of shapes appropriately selected from various shapes, such as zigzag, linear and curved shapes.

(Structure of the Manufacturing Device)

Figure 16:
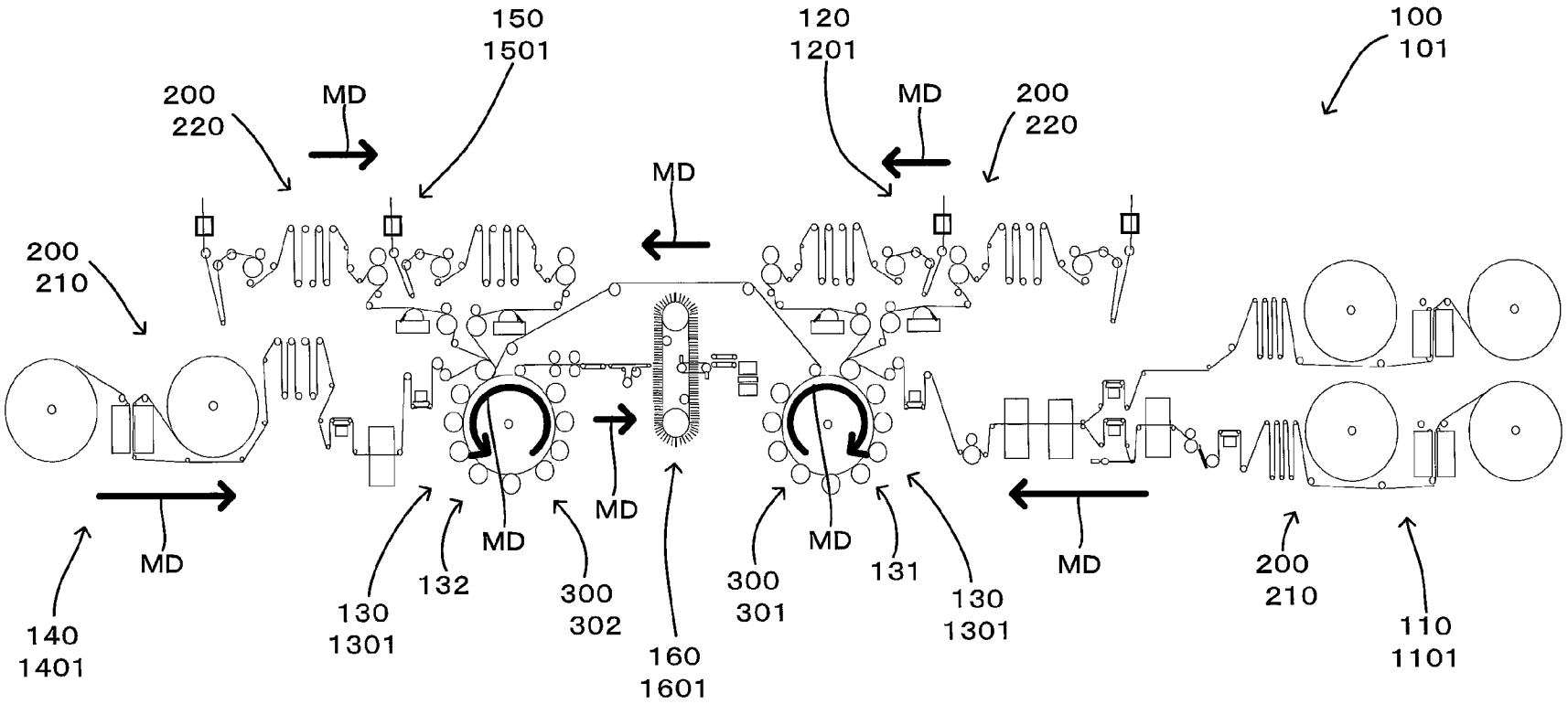
FIG. 16 is an explanatory drawing of a first manufacturing device according to the present invention.

A basic structure of the manufacturing device 100 for manufacturing the cleaning element A200 is now explained with reference to FIG. 16. The manufacturing device 100 has a bonding part 130 that bonds the laminate A500 formed by superposing the sheet materials A340 and the fiber material A230. The bonding part 130 includes a first bonding part 131 and a second bonding part 132.

The manufacturing device 100 has a laminate sheet material feeding part 110 that conveys a plurality of sheet materials A340 in the machine direction MD and superposes the sheet materials A340. The sheet materials A340 superposed by the laminate sheet material feeding part 110 forms a sheet laminate A501. The manufacturing device 100 has a first fiber material feeding part 120 that conveys the fiber material A230 in the machine direction MD.

The first bonding part 131 bonds the sheet materials A340 (the sheet laminate A501) conveyed and superposed by the laminate sheet material feeding part 110, and the fiber material A230 conveyed by the first fiber material feeding part 120. In the first bonding part 131, the sheet laminate A501 and the fiber material A340 are bonded together to form an intermediate laminate A510.

The manufacturing device 100 can have a sheet material feeding part 140 that conveys the sheet material A340 in the machine direction MD. Further, the sheet material feeding part 140 may not be used depending on the desired cleaning element A200. The manufacturing device 100 has a second fiber material feeding part 150 that conveys the fiber material A230 in the machine direction MD.

The second bonding part 132 bonds the intermediate laminate A510, the sheet material A340 conveyed by the sheet material feeding part 140, and the fiber material A230 conveyed by the second fiber material feeding part 150. In the second bonding part 132, the intermediate laminate A510, the sheet material A340 and the fiber material A230 are bonded together to form a final laminate A520.

The manufacturing device 100 has a final processing part 160 that cuts the final laminate A520 to obtain a desired cleaning element A200. The final processing part 160 can also have other devices required to package the cleaning element A200.

The manufacturing device 100 can have various structures depending on the cleaning element A200 to be manufactured. As the manufacturing device 100 of the present invention, a first manufacturing device 101, a second manufacturing device 102, a third manufacturing device 103 and a fourth manufacturing device 104 are explained below.

First, the first manufacturing device 101 is explained as a manufacturing device for manufacturing the cleaning element A200. Further, as for the second manufacturing device 102, the third manufacturing device 103 and the fourth manufacturing device 104 which are described below, components or elements which are substantially identical to those in the first manufacturing device 101 are given like numerals and may not be described.

Further, the sheet material A340 and the fiber material A230 in the form of the band-like element 400 are elongate. Therefore, the manufacturing device 100 has a device such as a roller for supporting the band-like element 400, and a device for applying tension to the band-like element 400. The roller for supporting the band-like element 400 and the device for applying tension to the band-like element 400 are well known, and therefore their further description is omitted.

(Structure of the First Manufacturing Device)

The structure of the first manufacturing device 101 is explained with reference to FIGS. 16 to 33. The first manufacturing device 101 is provided to manufacture the first cleaning element A201. The first manufacturing device 101 has a bonding part 1301 which includes the first bonding part 131 having the first bonding device 301 and the second bonding part 132 having the second bonding device 302.

The first manufacturing device 101 has a laminate sheet material feeding part 1101 that feeds the first sheet material A341 and the second sheet material A342, and a first fiber material feeding part 1201 that feeds the fiber material A230. The first manufacturing device 101 has the first bonding part 131 that bonds the first sheet material A341, the second sheet material A342 and the fiber material A230 fed by the first fiber material feeding part 1201 and thereby forms the intermediate laminate A510. The first manufacturing device 101 further has a sheet material feeding part 1401 that feeds the third sheet material A343, and a second fiber material feeding part 1501 that feeds the fiber material A230. The first manufacturing device 101 further has the second bonding part 132 that bonds the intermediate laminate A510, the third sheet material A343 and the fiber material A230 fed by the second fiber material feeding part 1501 and thereby forms the final laminate A520. The first manufacturing device 101 has a final processing part 1601 that cuts and packages the final laminate A520.

Specifically, the process of manufacturing the first cleaning element A201 by the first manufacturing device 101 has a step of feeding the first sheet material A341 and the second sheet material A342, and a step of feeding one of the fiber materials A230. The manufacturing process by the first manufacturing device 101 further has a step of bonding the first sheet material A341, the second sheet material A342 and the one fiber material A230 to form the intermediate laminate A510. The manufacturing process by the first manufacturing device 101 further has a step of feeding the third sheet material A343 and a step of feeding the other fiber material A230. The manufacturing process by the first manufacturing device 101 further has a step of bonding the intermediate laminate A510, the third sheet material A343 and the other fiber material A230 to form the final laminate A520. The manufacturing process by the first manufacturing device 101 further has a step of cutting and packaging the final laminate A520.

Figure 17:
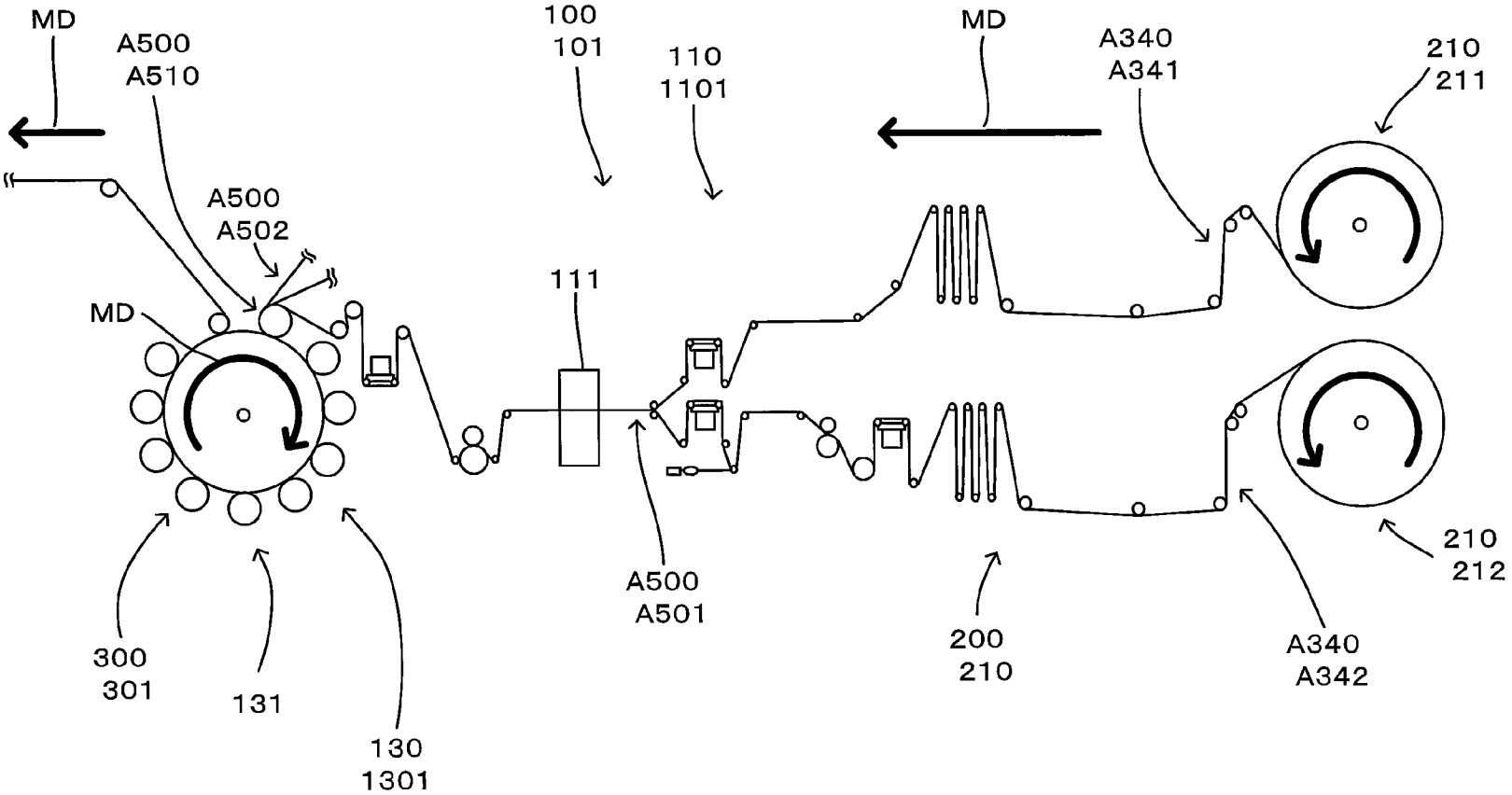
FIG. 17 is an explanatory drawing of a laminate sheet material feeding part in the first manufacturing device.

FIG. 17 shows the laminate sheet material feeding part 1101. The laminate sheet material feeding part 1101 has a sheet material feeding device 210. The sheet material feeding device 210 includes a first sheet material feeding device 211 for feeding the first sheet material A341, and a second sheet material feeding device 212 for feeding the second sheet material A342.

The first sheet material feeding device 211 conveys the first sheet material A341 in the machine direction MD. The second sheet material feeding device 212 conveys the second sheet material A342 in the machine direction MD. The first sheet material A341 and the second sheet material A342 are superposed to form the laminate A500. The laminate A500 of the first sheet material A341 and the second sheet material A342 is defined as the sheet laminate A501. The cuts A331 are formed in the sheet laminate A501 by a cutting device 111. The sheet laminate A501 having the cuts A331 is fed to the first bonding part 131 in the bonding part 1301.

Figure 18:
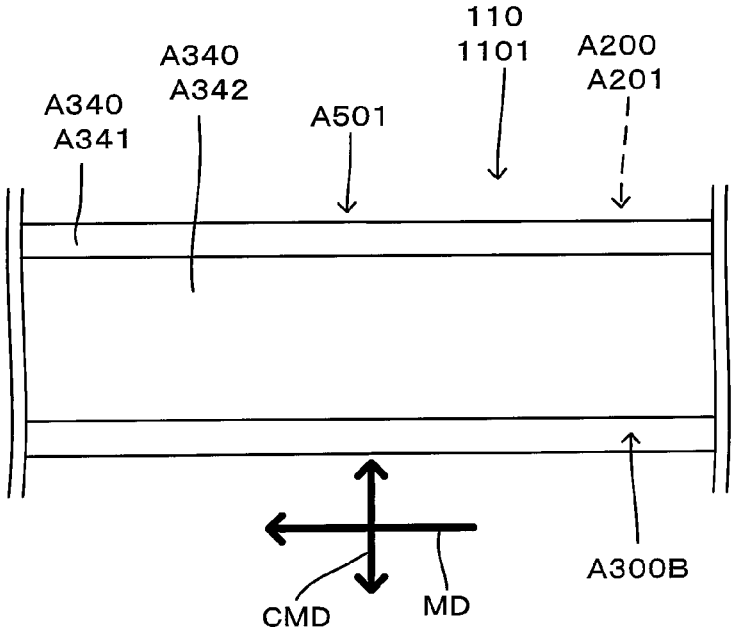
FIG. 18 is a view showing a state of a material in the laminate sheet material feeding part.

FIG. 18 shows the sheet laminate A501 which is not yet fed to the cutting device 111 in the laminate sheet material feeding part 1101. Here, a direction crossing the machine direction MD is defined as a machine transverse direction CMD. When the cleaning element A200 is formed, a direction parallel to the machine direction MD is the transverse direction A100X and a direction parallel to the machine transverse direction CMD is the longitudinal direction A100Y.

The second sheet material A342 is formed to be shorter than the first sheet material A341 in the machine transverse direction CMD. Therefore, the second sheet material A342 is not overlapped on both end regions of the first sheet material A341 in the machine transverse direction CMD.

Figure 19:
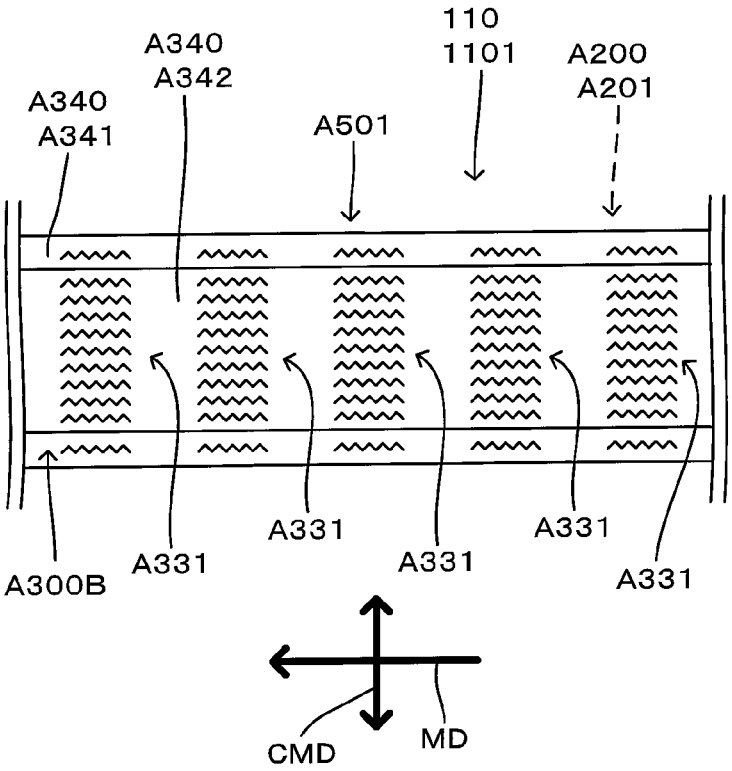
FIG. 19 is a view showing the state of the material in the laminate sheet material feeding part.

FIG. 19 shows the sheet laminate A501 fed to the cutting device 111 in the laminate sheet material feeding part 1101. A plurality of the cuts A331 are formed in the sheet laminate A501. A region between a pair of the cuts A331 forms a strip A330. Further, as the cutting device 111, a well-known structure such as a cutter may be used.

Figure 20:
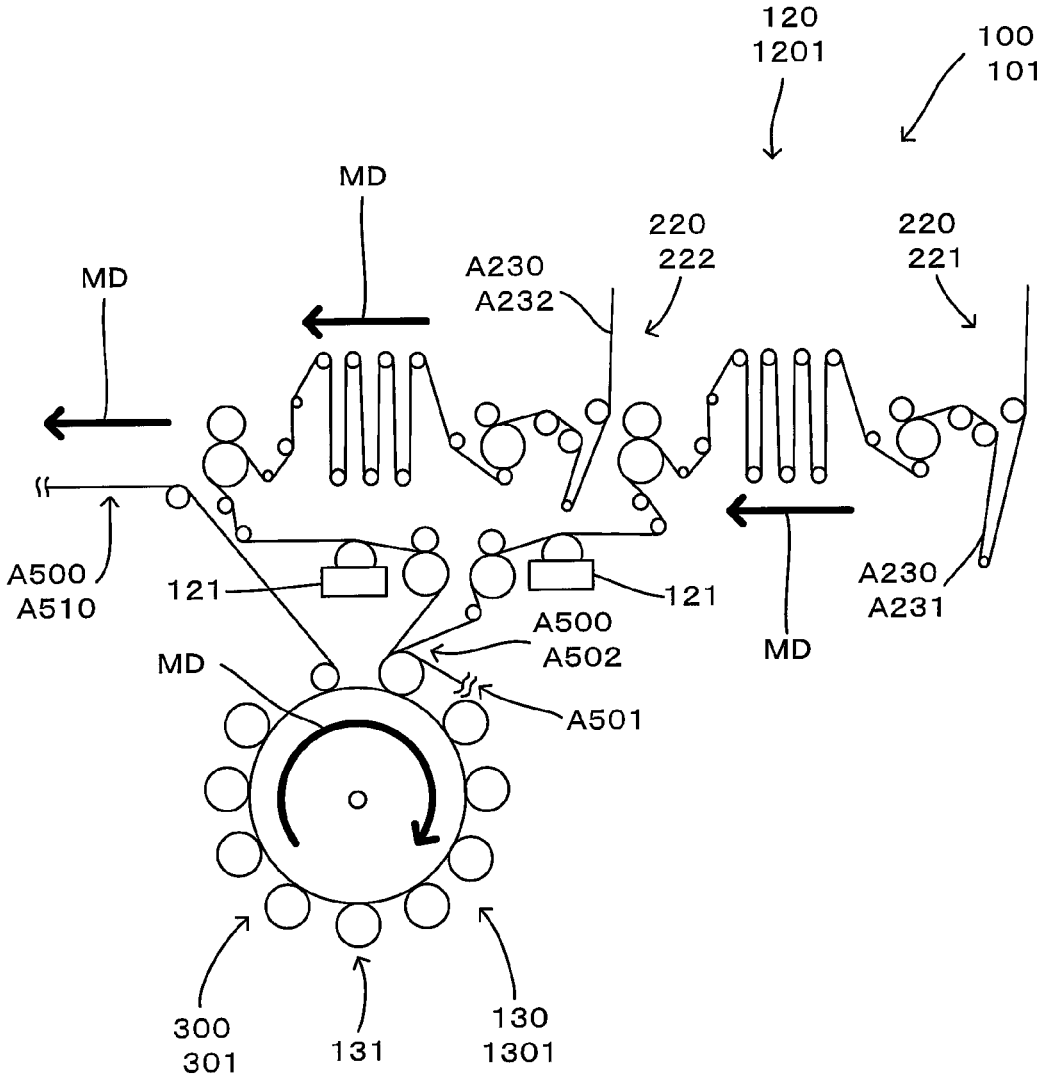
FIG. 20 is an explanatory drawing of a first fiber material feeding part in the first manufacturing device.

FIG. 20 shows the first fiber material feeding part 1201. The first fiber material feeding part 1201 has a fiber material feeding device 220. The fiber material feeding device 220 includes a first fiber material feeding device 221 for feeding the first fiber material A231 and a second fiber material feeding device 222 for feeding the second fiber material A232.

The first fiber material feeding device 221 conveys the first fiber material A231 in the machine direction MD. The second fiber material feeding device 222 conveys the second fiber material A232 in the machine direction MD. The first fiber material A231 and the second fiber material A232 are superposed to form the laminate A500. The laminate A500 of the first fiber material A231 and the second fiber material A232 is defined as a first fiber laminate A502. The first fiber laminate A502 is fed to the first bonding part 131 in the bonding part 1301. Further, dust adsorbent oil is supplied to the first fiber material A231 and the second fiber material A232 by an oil applicator 121. As the oil applicator 121, a well-known device such as an oil coater and a spray is used.

Further, the fiber material A230 is formed with opened tows. The direction in which the fiber tows extend substantially coincides with the machine direction MD.

Figure 21:
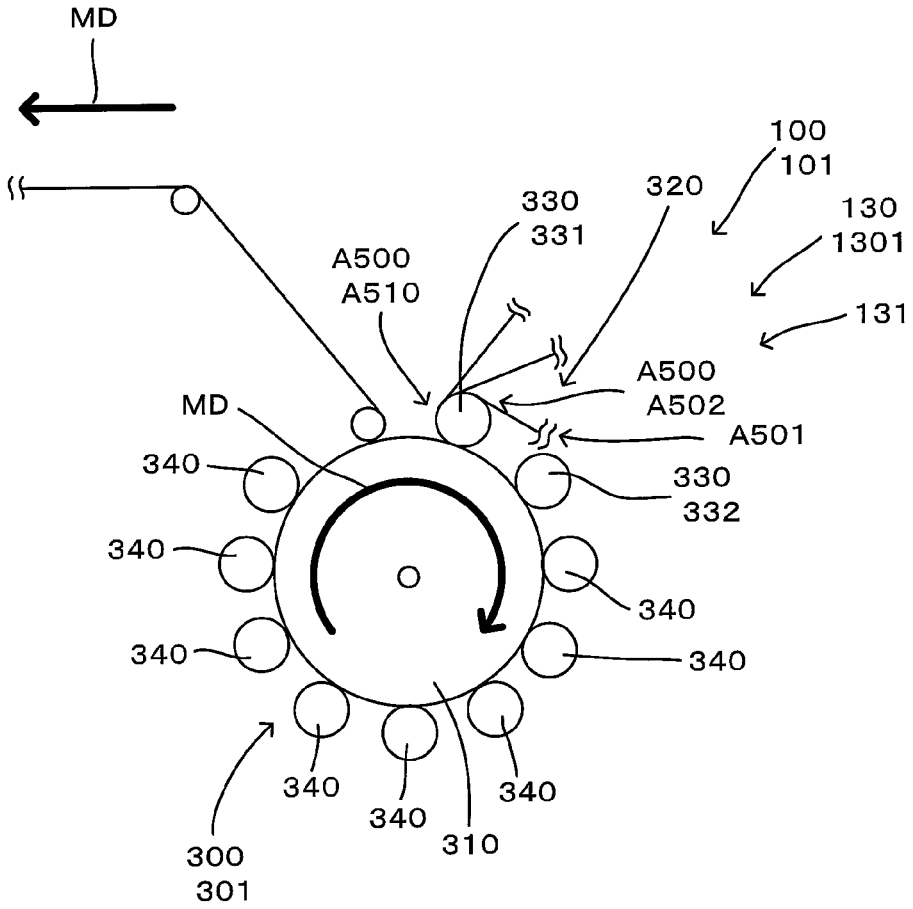
FIG. 21 is an explanatory drawing of a first bonding part in the first manufacturing device.

FIG. 21 shows the first bonding part 131 in the bonding part 1301. The first bonding part 131 has the first bonding device 301. The first bonding device 301 has the drum roller 310 and the bonding section 320. The bonding section 320 has the first bonded region forming section 331 and the second bonded region forming section 332.

The sheet laminate A501 and the first fiber laminate A502 are fed to the first bonding part 131. The first fiber laminate A502 is arranged on the one side A300A of the first sheet material A341 of the sheet laminate A501. Further, in the first bonding part 131, the sheet laminate A501 and the first fiber laminate A502 are bonded together at prescribed regions by the drum roller 310 and the bonding section 320 in order to form the bonded region 500. This bonded region 500 is defined as the bonded part A320 at which the prescribed regions of the sheet laminate A501 and the first fiber laminate A502 are bonded. The bonded part A320 formed by the first bonding part 131 forms the first bonded part A321 of the first cleaning element A201.

The sheet laminate A501 and the first fiber laminate A502 which are bonded at the bonded part A320 form the intermediate laminate A510. The intermediate laminate A510 is conveyed to the second bonding part 132 in the machine direction MD.

Figure 22:
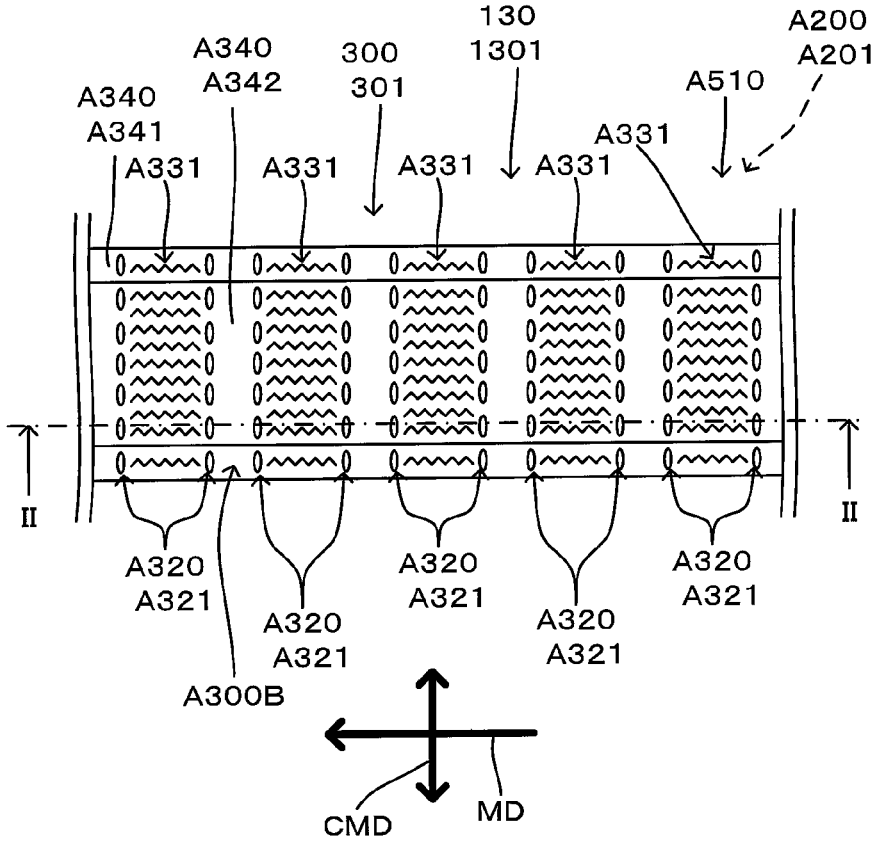
FIG. 22 is a view showing a state of a material in the first bonding part.
Figure 23:
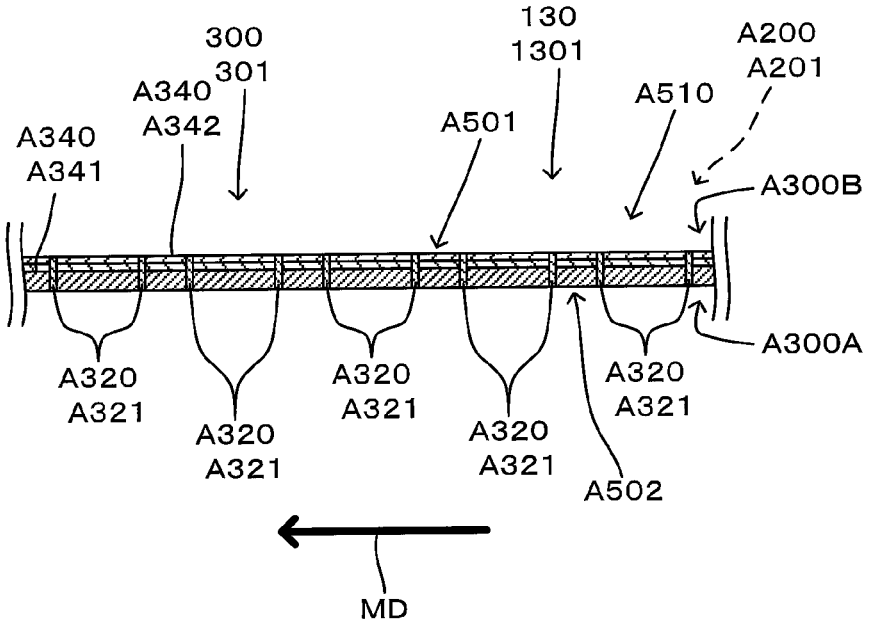
FIG. 23 is a sectional view taken along line II-II in FIG. 23.

FIGS. 22 and 23 show the intermediate laminate A510 having the first bonded part A321 formed in the first bonding part 131.

Figure 24:
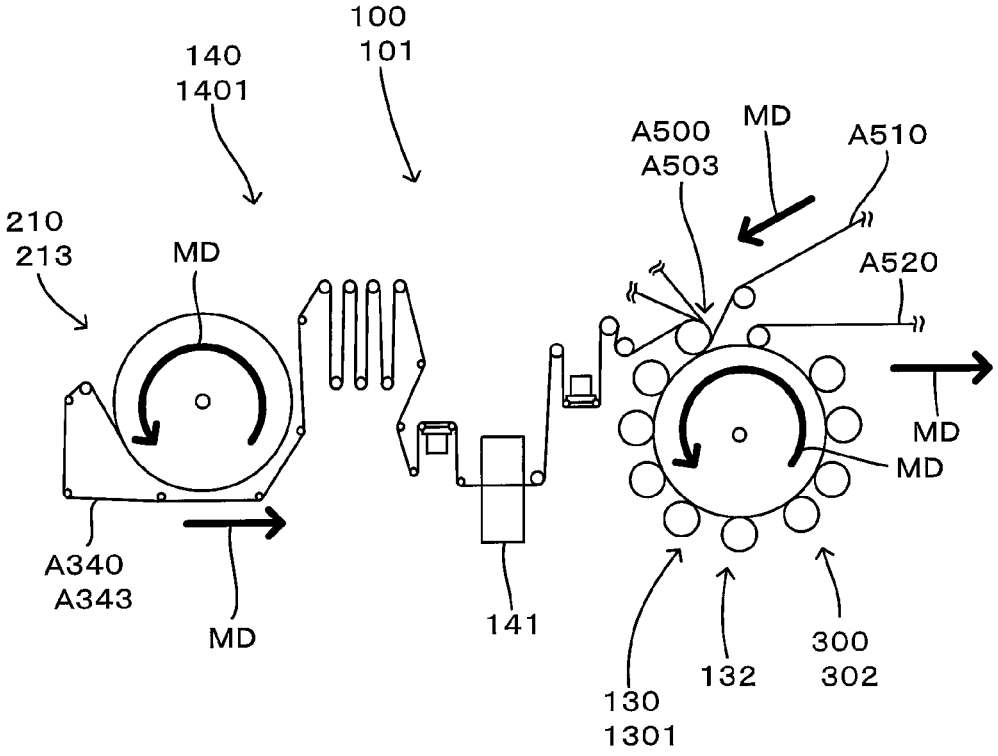
FIG. 24 is an explanatory drawing of a sheet material feeding part in the first manufacturing device.

FIG. 24 shows the sheet material feeding part 1401. The sheet material feeding part 1401 has the sheet material feeding device 210. The sheet material feeding device 210 forms a third sheet material feeding device 213 for feeding the third sheet material A343.

The third sheet material feeding device 213 conveys the third sheet material A343 in the machine direction MD. The cuts A331 are formed in the third sheet material A343 by a cutting device 141, and the third sheet material A343 having the cuts A331 is fed to the second bonding part 132 in the bonding part 1301.

Figure 25:
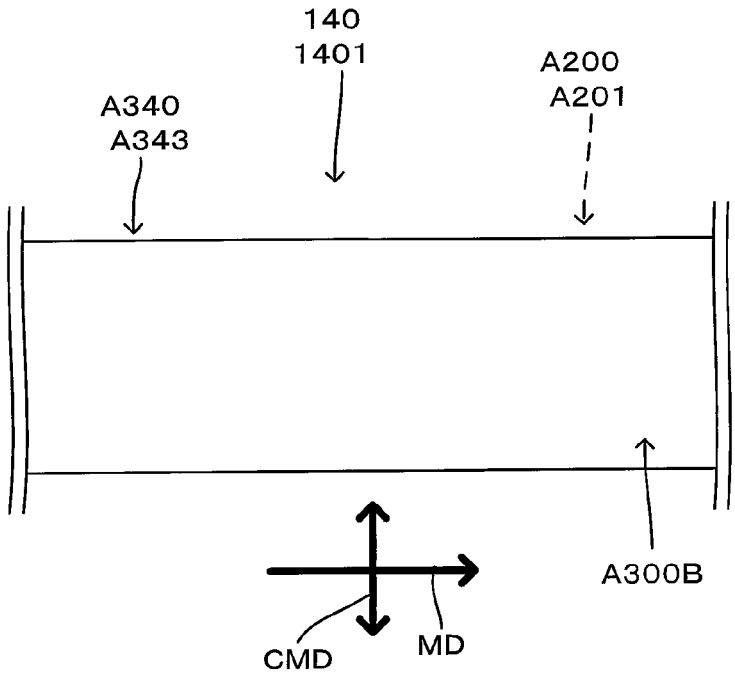
FIG. 25 is a view showing a state of a material in the sheet material feeding part.

FIG. 25 shows the third sheet material A343 which is not yet fed to the cutting device 141 in the sheet material feeding part 1401.

Figure 26:
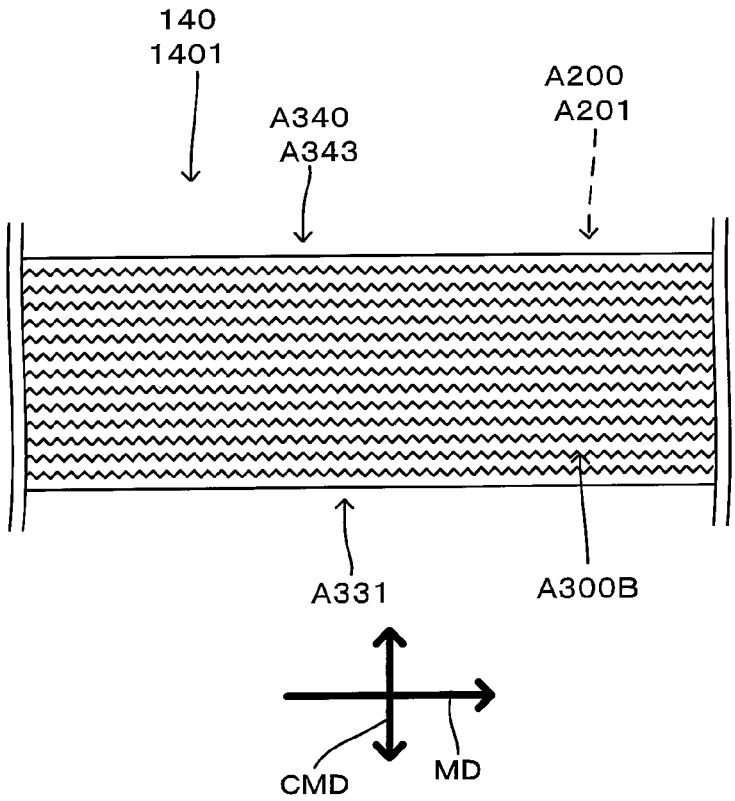
FIG. 26 is a view showing the state of the material in the sheet material feeding part.

FIG. 26 shows the third sheet material A343 fed to the cutting device 141 in the sheet material feeding part 1401. A plurality of the cuts A331 are formed in the third sheet material A343. A region between a pair of the cuts A331 forms a strip A330. Further, as the cutting device 141, a well-known structure such as a cutter may be used.

Figure 27:
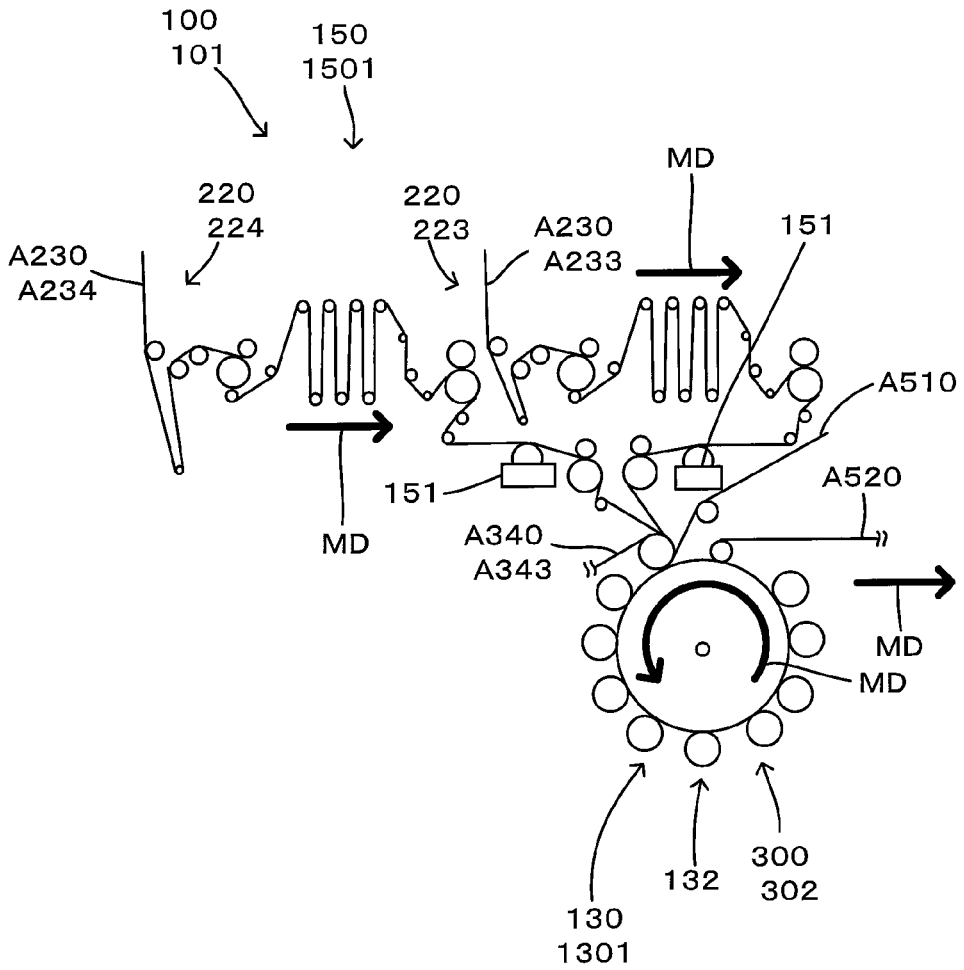
FIG. 27 is an explanatory drawing of a second fiber material feeding part in the first manufacturing device.

FIG. 27 shows the second fiber material feeding part 1501. The second fiber material feeding part 1501 has a fiber material feeding device 220. The fiber material feeding device 220 includes a third fiber material feeding device 223 for feeding the third fiber material A233 and a fourth fiber material feeding device 224 for feeding the fourth fiber material A234.

The third fiber material feeding device 223 conveys the third fiber material A233 in the machine direction MD. The fourth fiber material feeding device 224 conveys the fourth fiber material A234 in the machine direction MD. The third fiber material A233 and the fourth fiber material A234 are superposed to form the laminate A500. The laminate A500 of the third fiber material A233 and the fourth fiber material A234 is defined as a second fiber laminate A503. The second fiber laminate A503 is fed to the first bonding part 132 in the bonding part 1301. Further, dust adsorbent oil is supplied to the third fiber material A233 and the fourth fiber material A234 by an oil applicator 151. As the oil applicator 151, a well-known device such as an oil coater and a spray is used.

Figure 28:
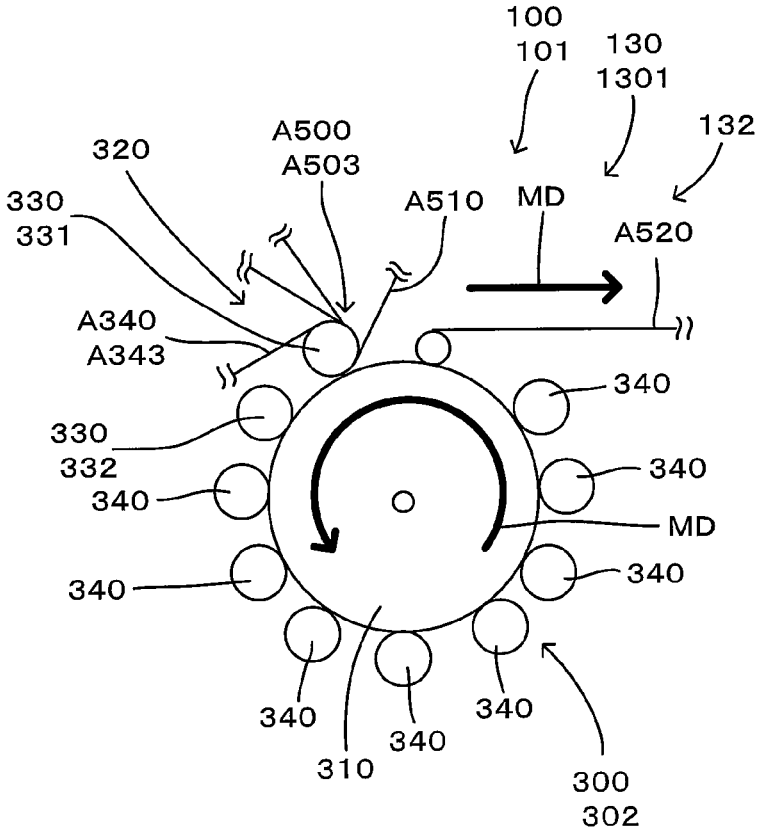
FIG. 28 is an explanatory drawing of a second bonding part in the first manufacturing device.

FIG. 28 shows the second bonding part 132 in the bonding part 1301. The second bonding part 132 has the second bonding device 302. The second bonding device 302 has the drum roller 310 and the bonding section 320. The bonding section 320 has the first bonded region forming section 331 and the second bonded region forming section 332.

The intermediate laminate A510, the second fiber laminate A503 and the third sheet material A343 are fed to the second bonding part 132. In this case, the second fiber laminate A503 is arranged on a surface of the first fiber laminate A502 of the intermediate laminate A510. The third sheet material A343 is arranged on a surface of the second fiber laminate A503 on the side opposite to the first fiber laminate A502.

Further, in the second bonding part 132, the intermediate laminate A510, the second fiber laminate A503 and the third sheet material A343 are bonded together at prescribed regions by the drum roller 310 and the bonding section 320 in order to form the bonded region 500. The bonded region 500 is defined as the bonded part A320 at which the prescribed regions of the intermediate laminate A510, the second fiber laminate A503 and the third sheet material A343 are bonded. The bonded part A320 formed by the second bonding part 132 forms the second bonded part A322 of the first cleaning element A201.

The intermediate laminate A510, the second fiber laminate A503 and the third sheet material A343 which are bonded at the bonded part A320 form the final laminate A520. The final laminate A520 is conveyed to the final processing part 1601 in the machine direction MD.

Figure 29:
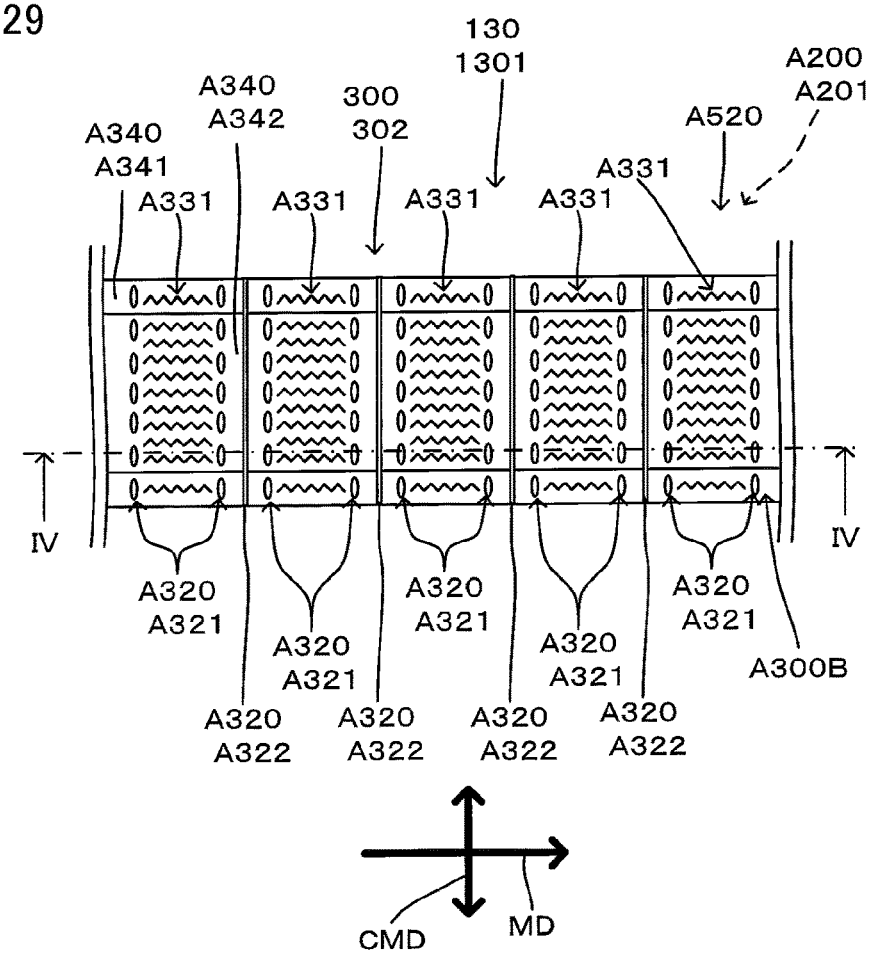
FIG. 29 is a view showing a state of a material in the second bonding part.
Figure 30:
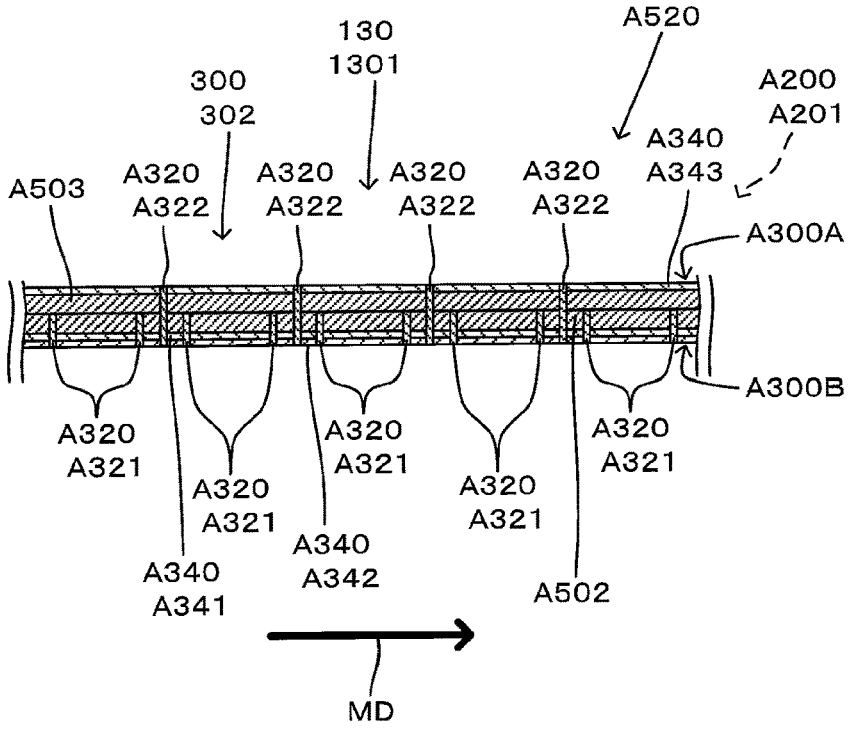
FIG. 30 is a sectional view taken along line III-III in FIG. 29.

FIGS. 29 and 30 show the final laminate A520 having the second bonded part A322 formed in the second bonding part 132. For the sake of convenience of explanation, FIG. 29 shows the final laminate A520 as viewed from an inner diameter side of the drum roller 310. The drum roller 310 is disposed on a lower side as viewed in FIG. 30. The holding space A310 is formed between the first sheet material A340 and the second sheet material A342 in a region between the first bonded part A321 and the second bonded part A322.

Figure 31:
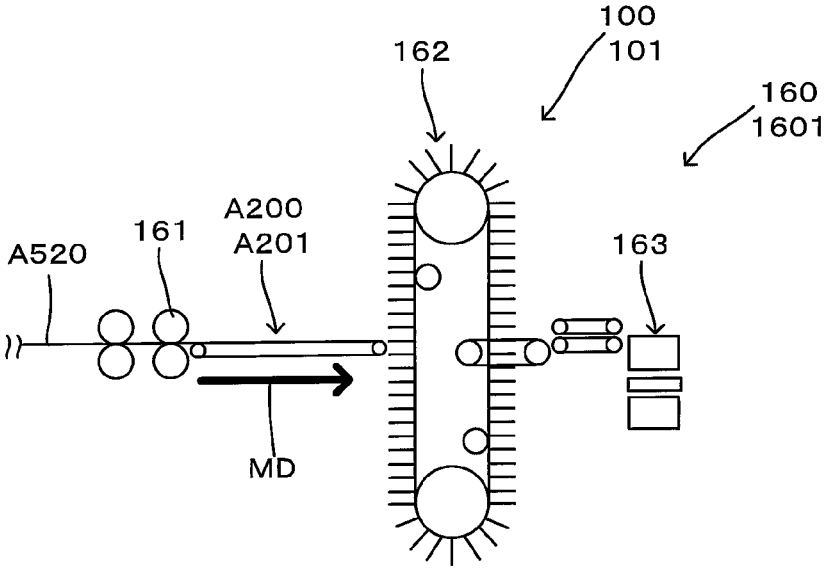
FIG. 31 is an explanatory drawing of a final processing part in the first manufacturing device.

FIG. 31 shows the final processing part 1601. The final processing part 1601 has a final cutting device 161 that cuts the final laminate A520 in the machine transverse direction CMD to obtain the first cleaning elements A201 from the final laminate A520. The final cutting device 161 further has a counting device 162 for counting the first cleaning elements A201 and a packaging device 163 for packaging the counted first cleaning elements A201.

As the final cutting device 161, the counting device 162 and the packaging device 163, well-known structures may be appropriately used.

Figure 32:
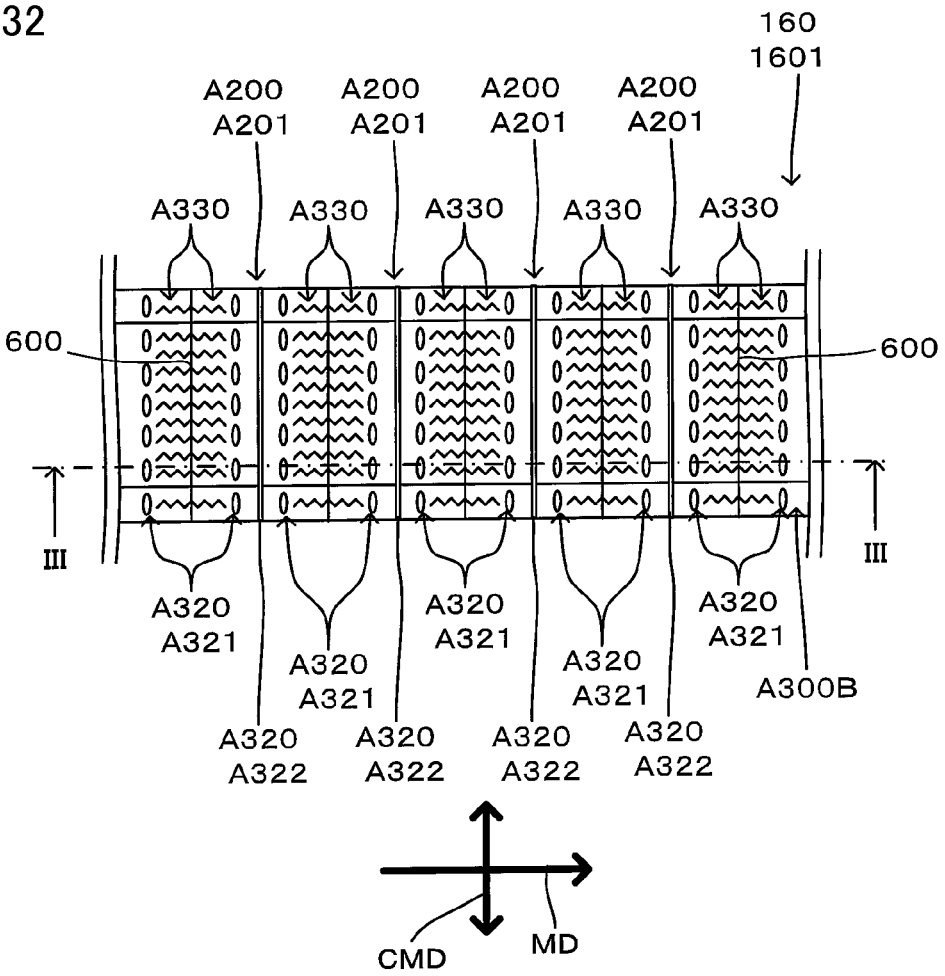
FIG. 32 is a view showing a state of a material in the final processing part.
Figure 33:
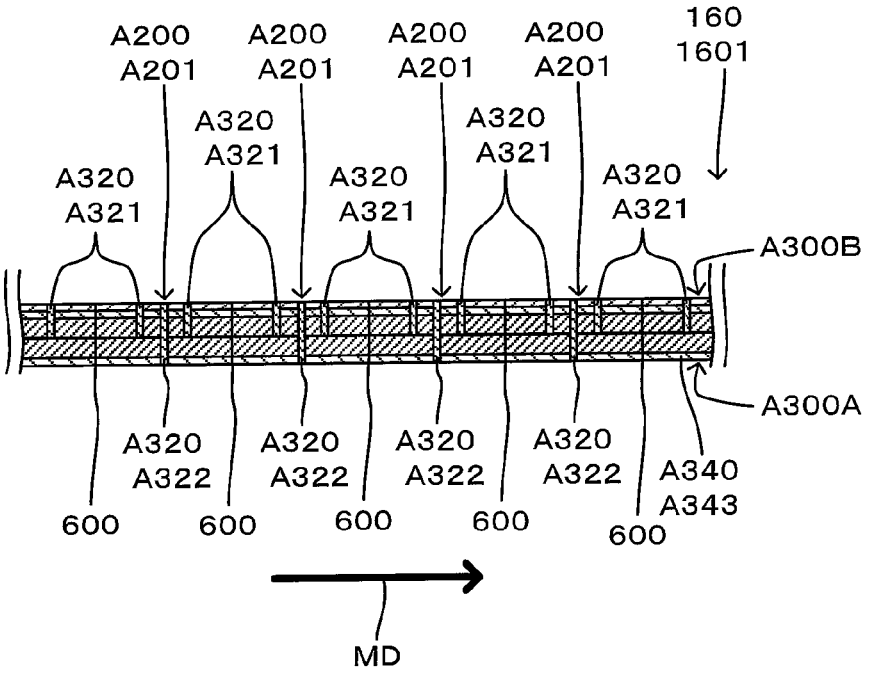
FIG. 33 is a sectional view taken along line IV-IV in FIG. 32.
Figure 34:
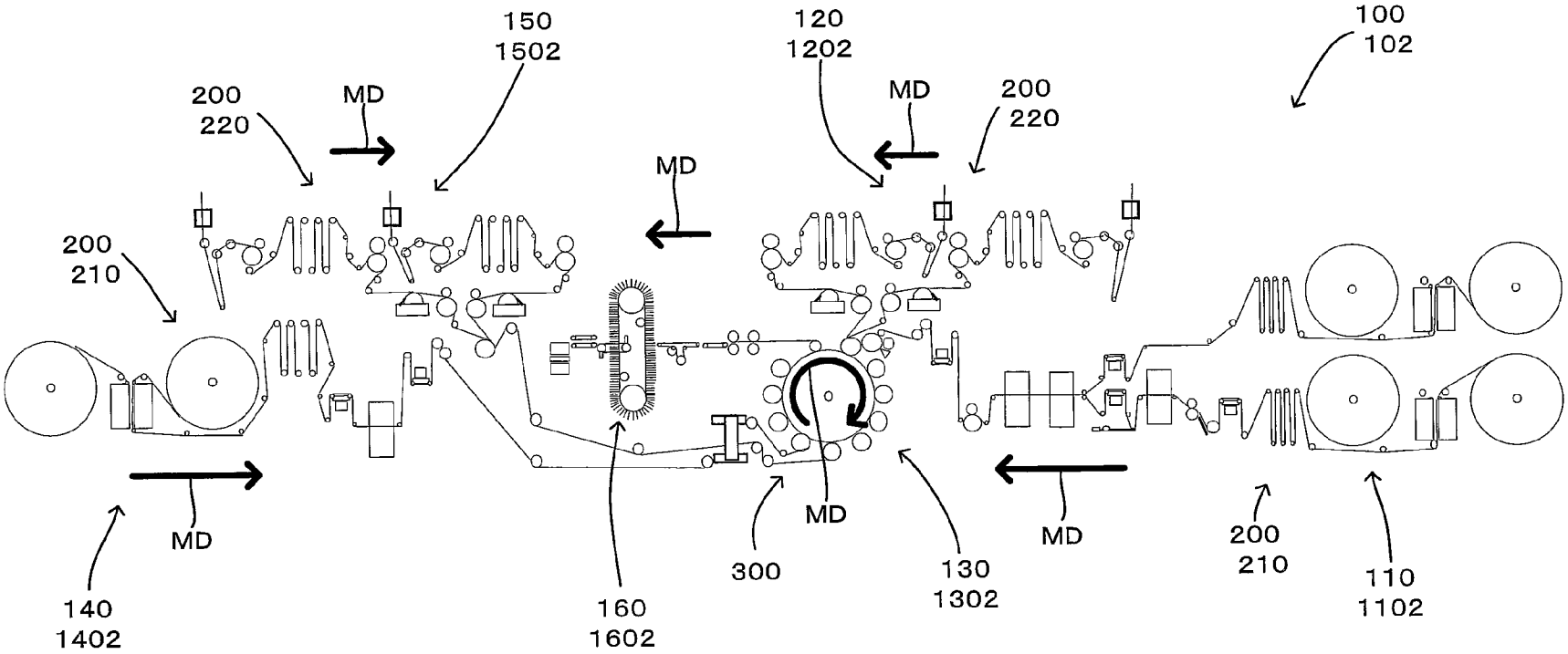
FIG. 34 is an explanatory drawing of a second manufacturing device according to the present invention.

FIGS. 32 and 33 show the final laminate A520 cut by the final cutting device 161. The final laminate A520 is cut along cutting parts 600 and forms the first cleaning elements A201.

The first manufacturing device 101 manufactures the first cleaning element A201 through the above-described devices and steps.

(Structure of the Second Manufacturing Device)

The structure of the second manufacturing device 102 is explained with reference to FIGS. 34 to 50. The second manufacturing device 102 manufactures the first cleaning element A201. The second manufacturing device 102 has the bonding device 300 in which a first bonding section 321 and a second bonding section 322 are provided on the single drum roller 310 in a bonding part 1302.

The second manufacturing device 102 has a laminate sheet material feeding part 1102 that feeds the first sheet material A341 and the second sheet material A342, and a first fiber material feeding part 1202 that feeds the fiber material A230. The second manufacturing device 102 further has a sheet material feeding part 1402 that feeds the third sheet material A343, and a second fiber material feeding part 1502 that feeds the fiber material A230. The second manufacturing device 102 further has the bonding part 1302. The bonding part 1302 bonds the first sheet material A341, the second sheet material A342 and the fiber material A230 fed by the first fiber material feeding part 1202 and thereby forms the intermediate laminate A510. The bonding part 1302 further bonds the intermediate laminate A510, the third sheet material A343 and the fiber material A230 fed by the second fiber material feeding part 1502 and thereby forms the final laminate A520. The second manufacturing device 102 further has a final processing part 1602 that cuts and packages the final laminate A520.

Specifically, the process of manufacturing the first cleaning element A201 by the second manufacturing device 102 has a step of feeding the first sheet material A341 and the second sheet material A342, and a step of feeding one of the fiber materials A230. The manufacturing process by the second manufacturing device 102 further has a step of feeding the third sheet material A343 and the step of feeding the other fiber material A230. The manufacturing process by the second manufacturing device 102 further has a step of bonding the first sheet material A341, the second sheet material A342 and the one fiber material A230 by the drum roller 310 and the first bonding section 321 to form the intermediate laminate A510. The manufacturing process by the second manufacturing device 102 further has a step of bonding the intermediate laminate A510, the third sheet material A343 and the other fiber material A230 by the drum roller 310 and the second bonding section 322 to form the final laminate A520. The manufacturing process by the second manufacturing device 102 further has a step of cutting and packaging the final laminate A520.

Figure 35:
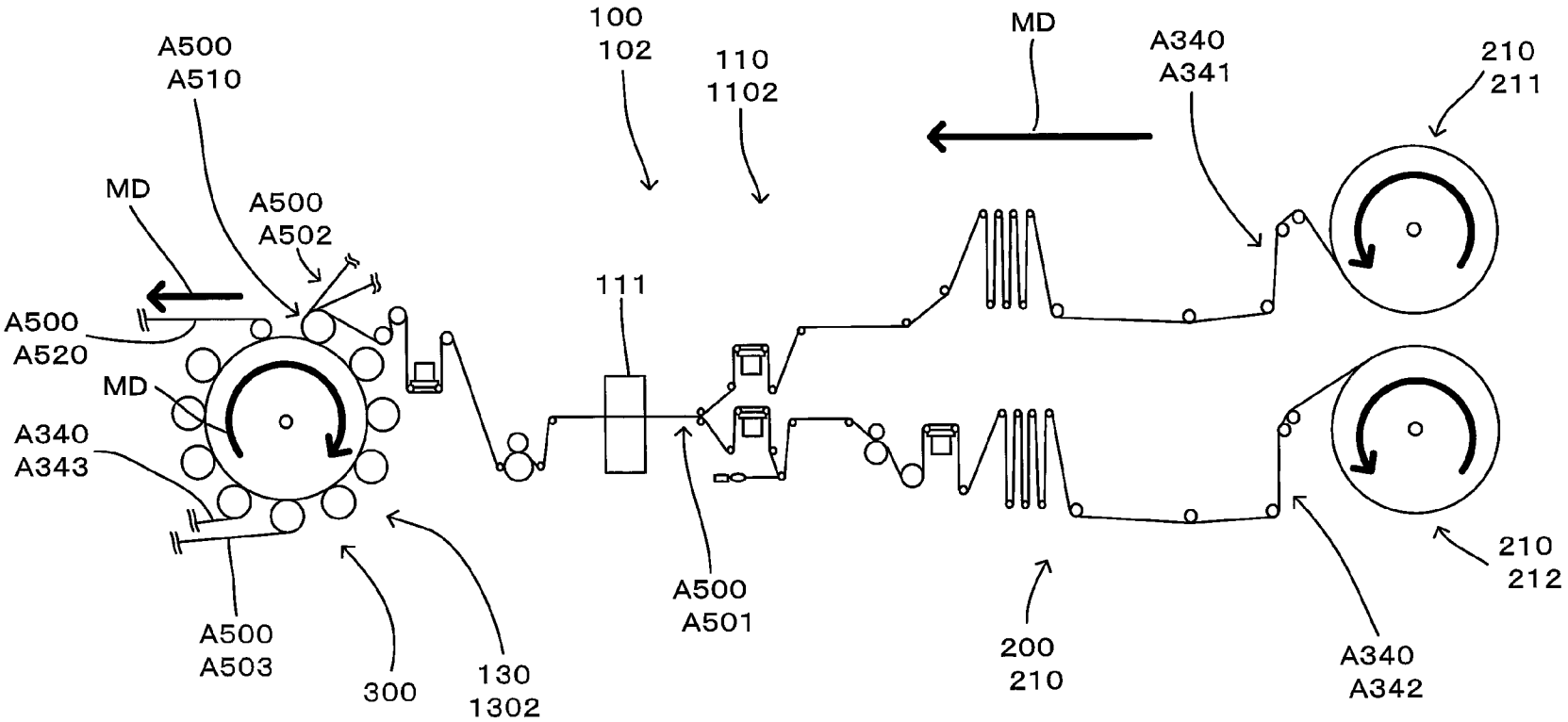
FIG. 35 is an explanatory drawing of a laminate sheet material feeding part in the second manufacturing device.

FIG. 35 shows the laminate sheet material feeding part 1102. The laminate sheet material feeding part 1102 has the sheet material feeding device 210. The sheet material feeding device 210 includes the first sheet material feeding device 211 for feeding the first sheet material A341, and the second sheet material feeding device 212 for feeding the second sheet material A342.

The first sheet material feeding device 211 conveys the first sheet material A341 in the machine direction MD. The second sheet material feeding device 212 conveys the second sheet material A342 in the machine direction MD. The first sheet material A341 and the second sheet material A342 are superposed to form the laminate A500. The laminate A500 of the first sheet material A341 and the second sheet material A342 is defined as the sheet laminate A501. The cuts A331 are formed in the sheet laminate A501 by the cutting device 111. The sheet laminate A501 having the cuts A331 is fed to the bonding part 1302.

Figure 36:
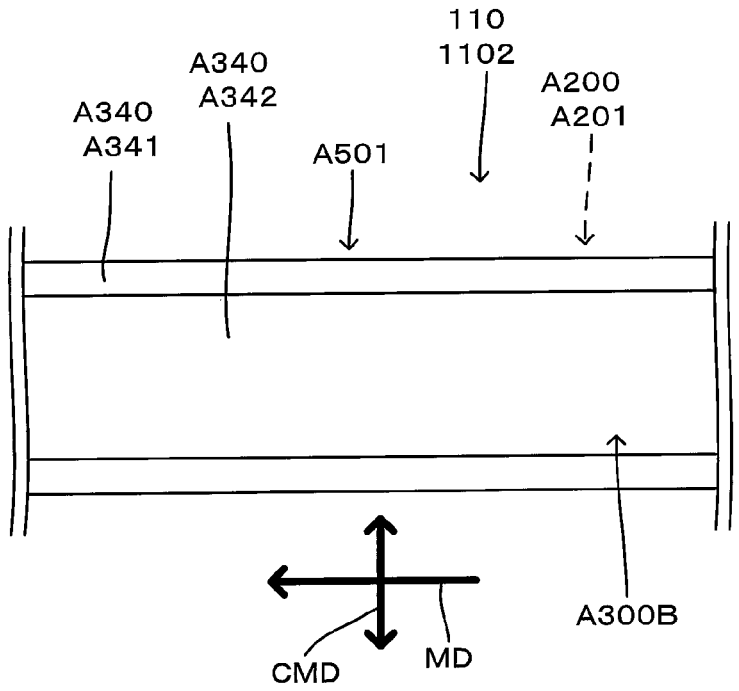
FIG. 36 is a view showing a state of a material in the laminate sheet material feeding part.

FIG. 36 shows the sheet laminate A501 which is not yet fed to the cutting device 111 in the laminate sheet material feeding part 1102.

The second sheet material A342 is formed to be shorter than the first sheet material A341 in the machine transverse direction CMD. Therefore, the second sheet material A342 is not overlapped on the both end regions of the first sheet material A341 in the machine transverse direction CMD.

Figure 37:
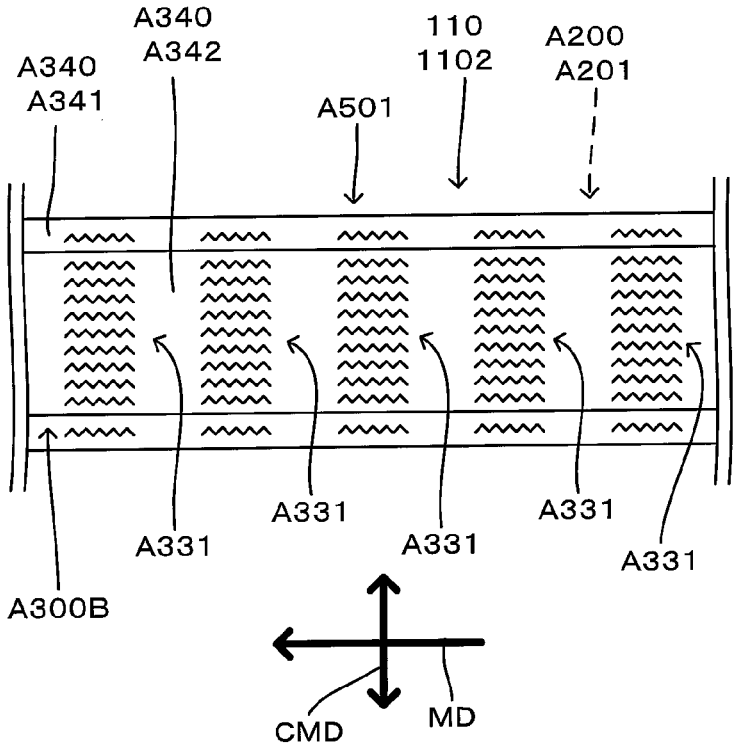
FIG. 37 is a view showing the state of the material in the laminate sheet material feeding part.

FIG. 37 shows the sheet laminate A501 fed to the cutting device 111 in the laminate sheet material feeding part 1102. A plurality of the cuts A331 are provided in the sheet laminate A501. A region between a pair of the cuts A331 forms a strip A330.

Figure 38:
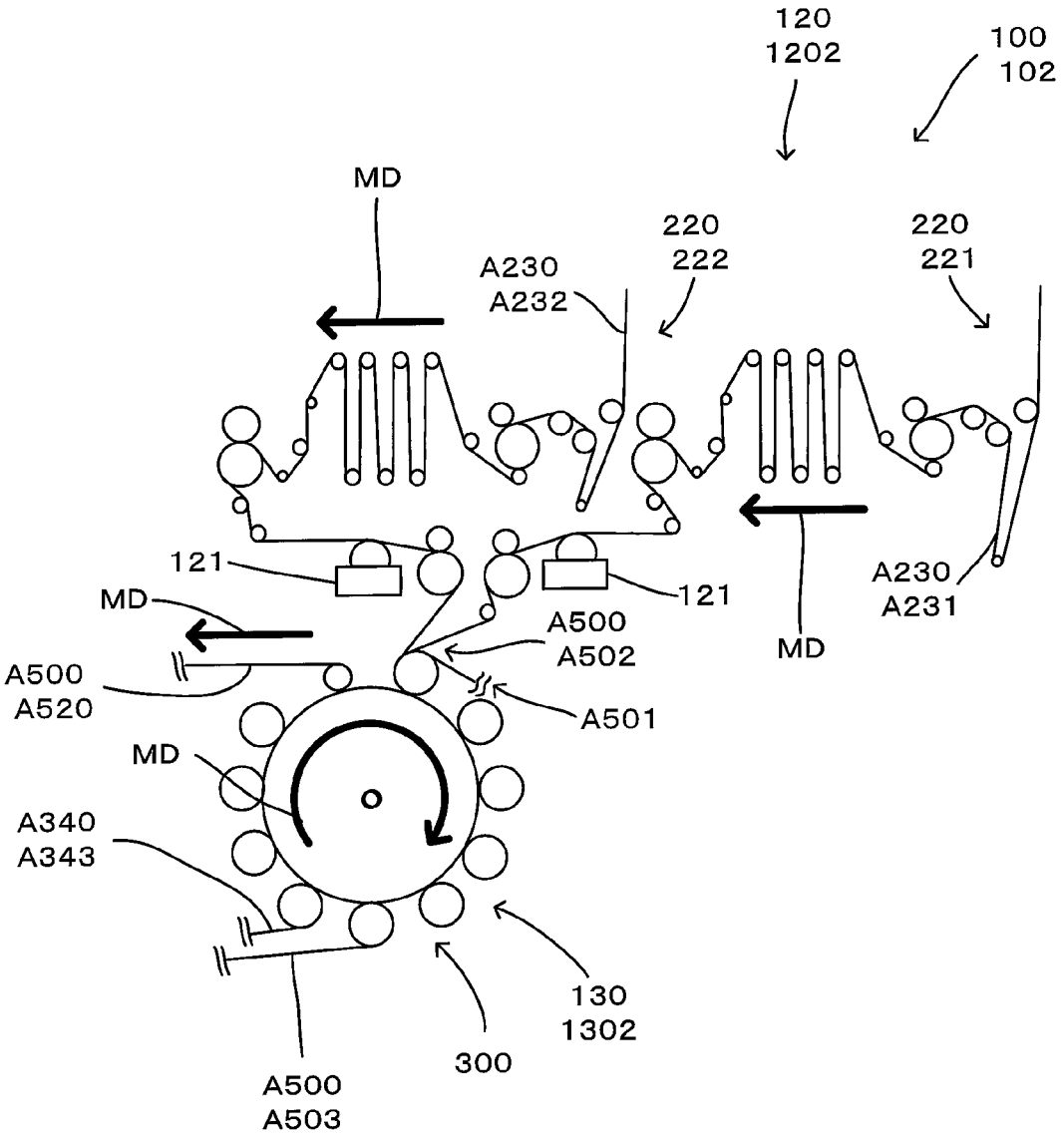
FIG. 38 is an explanatory drawing of a first fiber material feeding part in the second manufacturing device.

FIG. 38 shows the first fiber material feeding part 1202. The first fiber material feeding part 1202 has a fiber material feeding device 220. The fiber material feeding device 220 includes a first fiber material feeding device 221 for feeding the first fiber material A231 and the second fiber material feeding device 222 for feeding the second fiber material A232.

The first fiber material feeding device 221 conveys the first fiber material A231 in the machine direction MD. The second fiber material feeding device 222 conveys the second fiber material A232 in the machine direction MD. The first fiber material A231 and the second fiber material A232 are superposed to form the laminate A500. The laminate A500 of the first fiber material A231 and the second fiber material A232 is defined as the first fiber laminate A502. The first fiber laminate A502 is fed to the bonding part 1302. Further, dust adsorbent oil is supplied to the first fiber material A231 and the second fiber material A232 by the oil applicator 121.

Further, the fiber material A230 is formed of opened tows. The direction in which the fiber tows extend substantially coincides with the machine direction MD.

Figure 39:
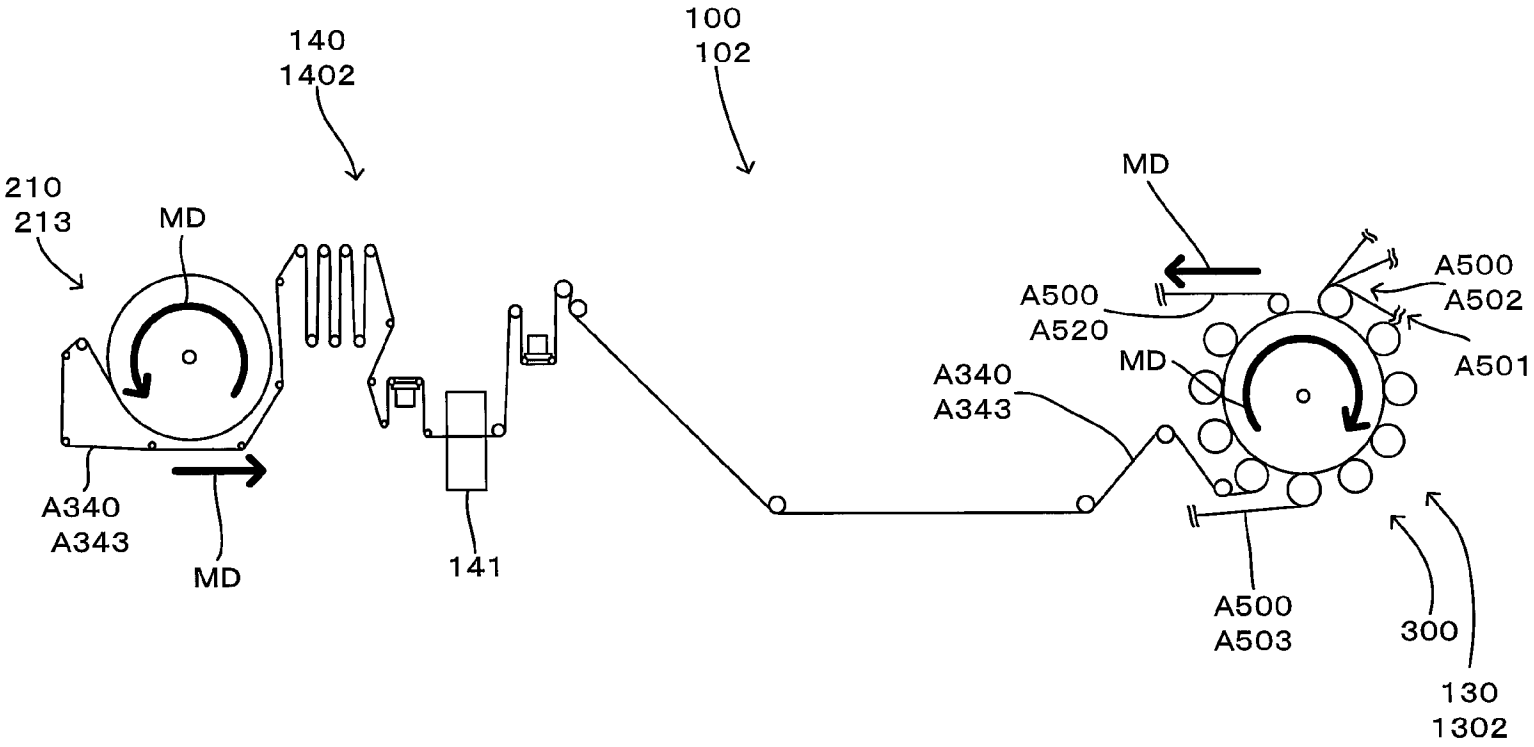
FIG. 39 is an explanatory drawing of a sheet material feeding part in the second manufacturing device.

FIG. 39 shows the sheet material feeding part 1402. The sheet material feeding part 1402 has the sheet material feeding device 210. The sheet material feeding device 210 forms the third sheet material feeding device 213 that feeds the third sheet material A343.

The third sheet material feeding device 213 conveys the third sheet material A343 in the machine direction MD. The cuts A331 are formed in the third sheet material A343 by the cutting device 141, and the third sheet material A343 having the cuts A331 is fed to the bonding part 1302.

Figure 40:
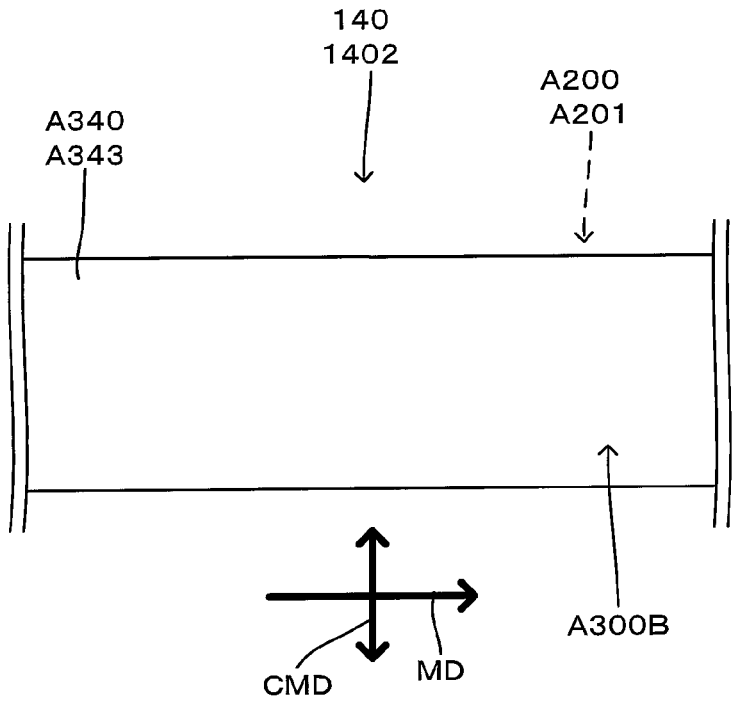
FIG. 40 is a view showing a state of a material in the sheet material feeding part.

FIG. 40 shows the third sheet material A343 which is not yet fed to the cutting device 141 in the sheet material feeding part 1402.

Figure 41:
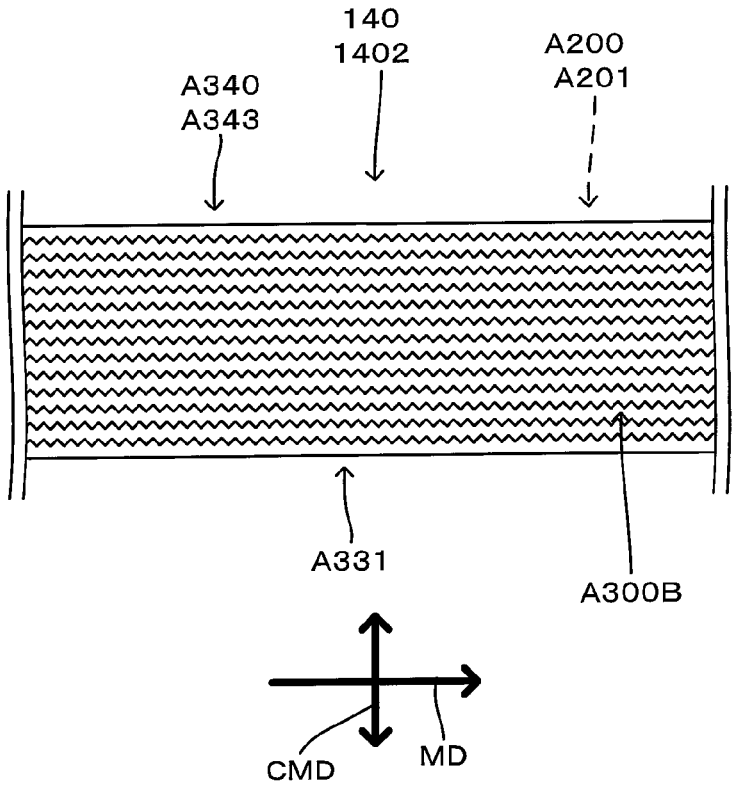
FIG. 41 is a view showing the state of the material in the sheet material feeding part.

FIG. 41 shows the third sheet material A343 fed to the cutting device 141 in the sheet material feeding part 1402. A plurality of the cuts A331 are formed in the third sheet material A343. A region between a pair of the cuts A331 forms a strip A330.

Figure 42:
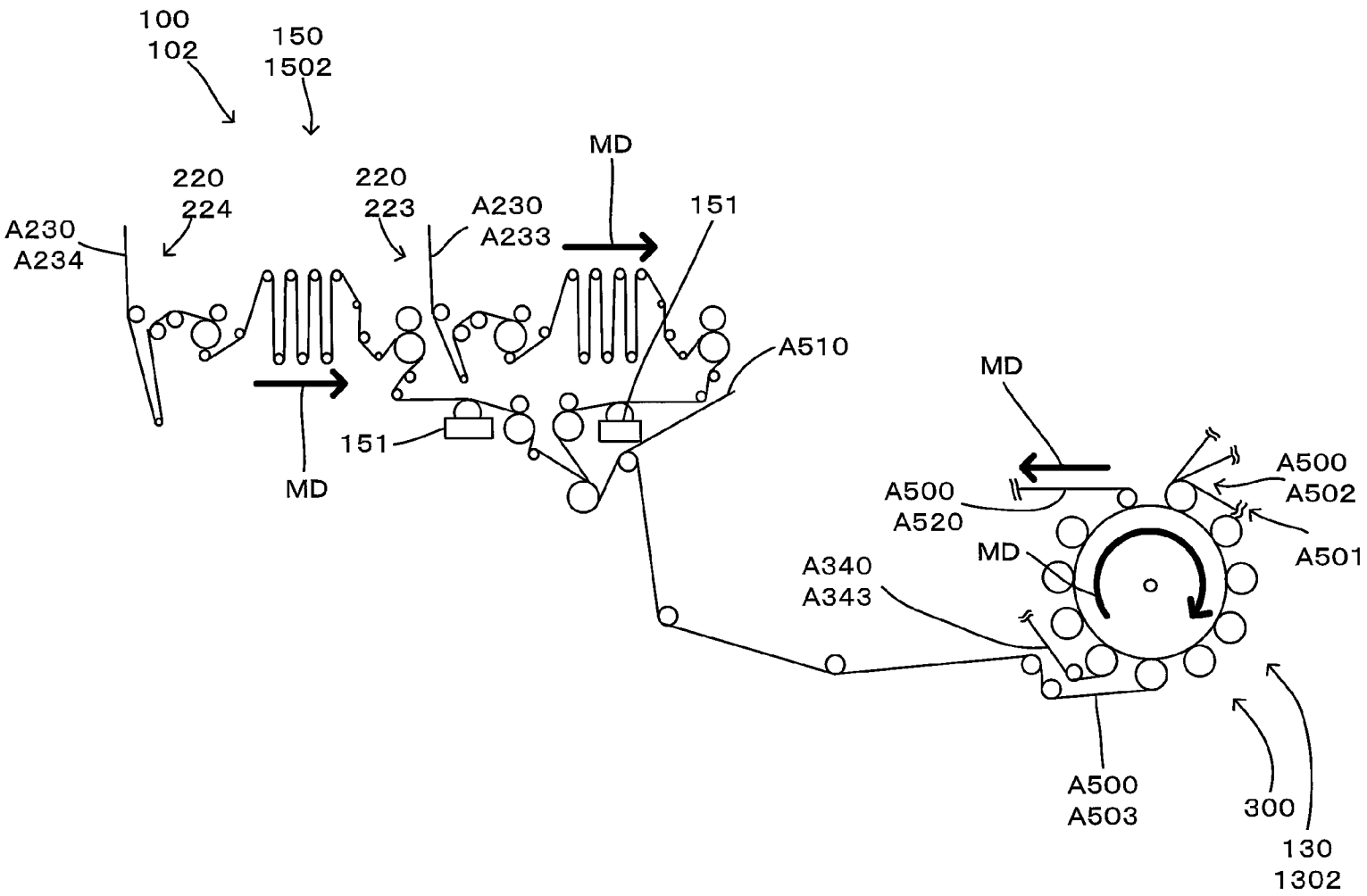
FIG. 42 is an explanatory drawing of a second fiber material feeding part in the second manufacturing device.

FIG. 42 shows the second fiber material feeding part 1502. The second fiber material feeding part 1502 has the fiber material feeding device 220. The fiber material feeding device 220 includes the third fiber material feeding device 223 for feeding the third fiber material A233 and the fourth fiber material feeding device 224 for feeding the fourth fiber material A234.

The third fiber material feeding device 223 conveys the third fiber material A233 in the machine direction MD. The fourth fiber material feeding device 224 conveys the fourth fiber material A234 in the machine direction MD. The third fiber material A233 and the fourth fiber material A234 are superposed to form the laminate A500. The laminate A500 of the third fiber material A233 and the fourth fiber material A234 is defined as the second fiber laminate A503. The second fiber laminate A503 is fed to the bonding part 1302. Further, dust adsorbent oil is supplied to the third fiber material A233 and the fourth fiber material A234 by the oil applicator 151.

Figure 43:
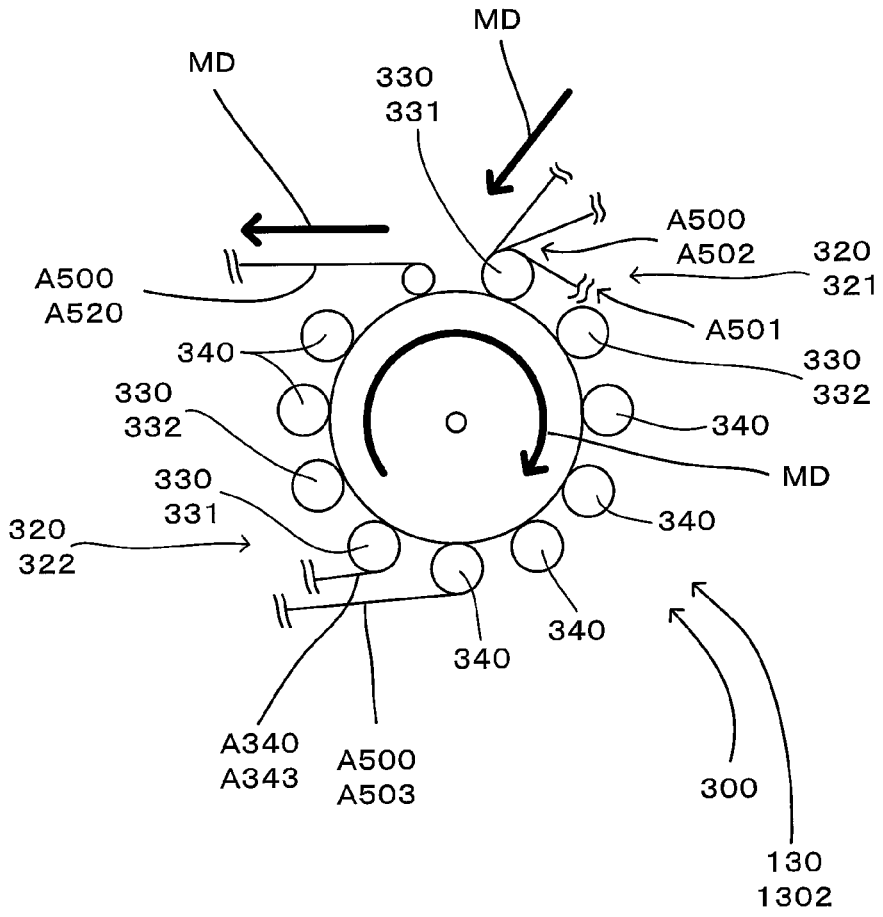
FIG. 43 is an explanatory drawing of a bonding part in the second manufacturing device.

FIG. 43 shows the bonding part 1302. The bonding part 1302 has the single drum roller 310, the first bonding section 321 and the second bonding section 322. The first bonding section 321 and the second bonding section 322 have the first bonded region forming section 331 and the second bonded region forming section 332, respectively.

The sheet laminate A501 and the first fiber laminate A502 are fed between the drum roller 310 and the first bonding section 321. The first fiber laminate A502 is arranged on one side A300A of the first sheet material A341 of the sheet laminate A501. Further, the sheet laminate A501 and the first fiber laminate A502 are bonded together at prescribed regions by the drum roller 310 and the first bonding section 321 in order to form the bonded region 500. The bonded region 500 is defined as the bonded part A320 at which the prescribed regions of the sheet laminate A501 and the first fiber laminate A502 are bonded. The bonded part A320 formed by the drum roller 310 and the first bonding section 321 forms the first bonded part A321 of the first cleaning element A201.

The sheet laminate A501 and the first fiber laminate A502 which are bonded at the bonded part A320 form the intermediate laminate A510. The intermediate laminate A510 is conveyed to the second bonding section 322 in the machine direction MD.

Figure 44:
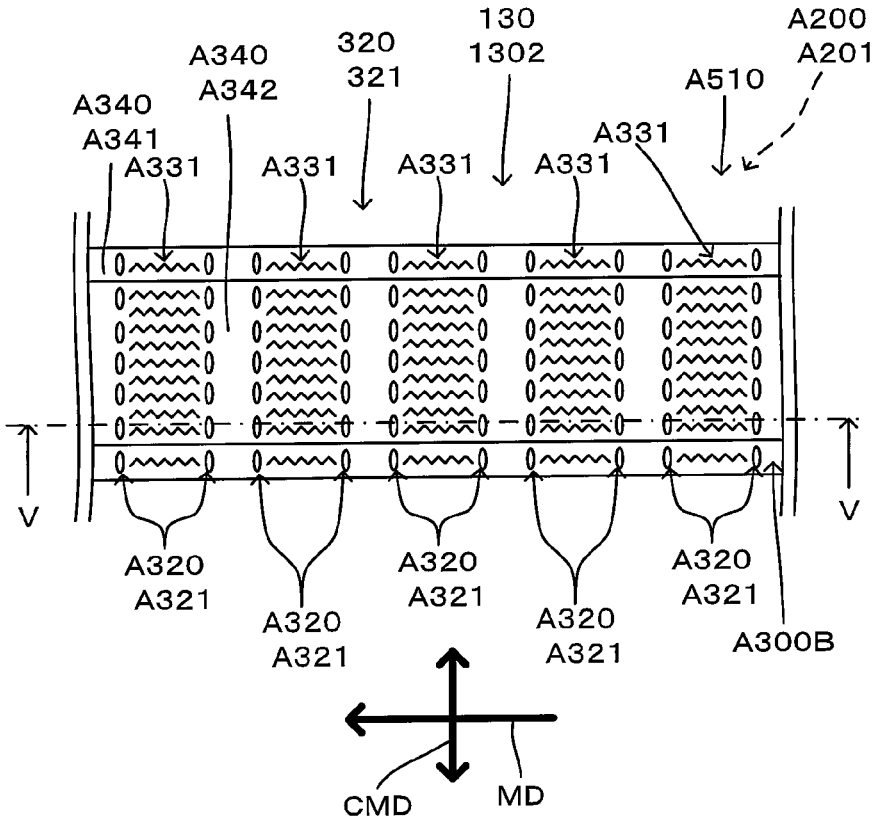
FIG. 44 is a view showing a state of a material in the bonding part.
Figure 45:
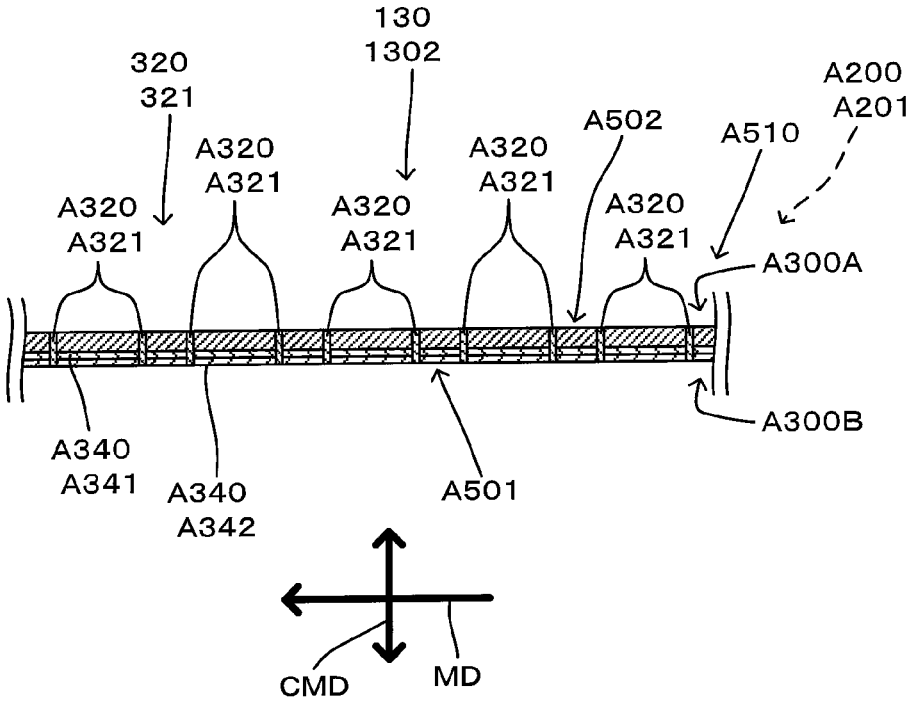
FIG. 45 is a sectional view taken along line V-V in FIG. 44.

FIGS. 44 and 45 show the intermediate laminate A510 having the first bonded part A321 formed by the drum roller 310 and the first bonding section 321. For the sake of convenience of explanation, FIG. 44 shows the intermediate laminate A510 as viewed from the inner diameter side of the drum roller 310. The drum roller 310 is disposed on a lower side as viewed in FIG. 45.

The intermediate laminate 510 is fed between the drum roller 310 and the second bonding section 322 by rotation of the drum roller 310. Further, the second fiber laminate A503 and the third sheet material A343 are fed between the drum roller 310 and the second bonding section 322. The second fiber laminate A503 is arranged on a surface of the first fiber laminate A502 of the intermediate laminate 510, and the third sheet material A343 is arranged on a surface of the second fiber laminate A503 on the side opposite to the first fiber laminate A502.

Further, the bonded region 500 is formed in the prescribed regions of the intermediate laminate A510, the second fiber laminate A503 and the third sheet material A343 by the drum roller 310 and the second bonding section 322. The bonded region 500 is defined as the bonded part A320 at which the prescribed regions of the intermediate laminate A510, the second fiber laminate A503 and the third sheet material A343 are bonded. The bonded part A320 formed by the second bonding part 132 forms the second bonded part A322 of the first cleaning element A201.

The intermediate laminate A510, the second fiber laminate A503 and the third sheet material A343 which are bonded at the bonded part A320 form the final laminate A520. The final laminate A520 is conveyed to the final processing part 1602 in the machine direction MD.

Figure 46:
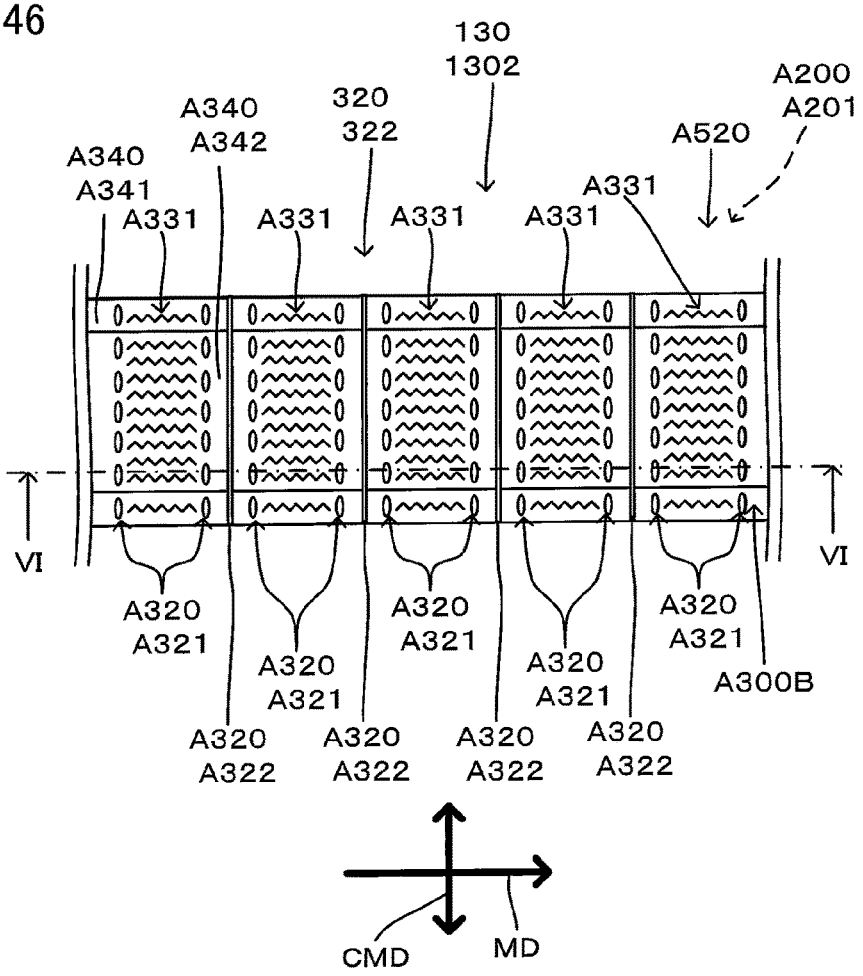
FIG. 46 is a view showing the state of the material in the bonding part.
Figure 47:
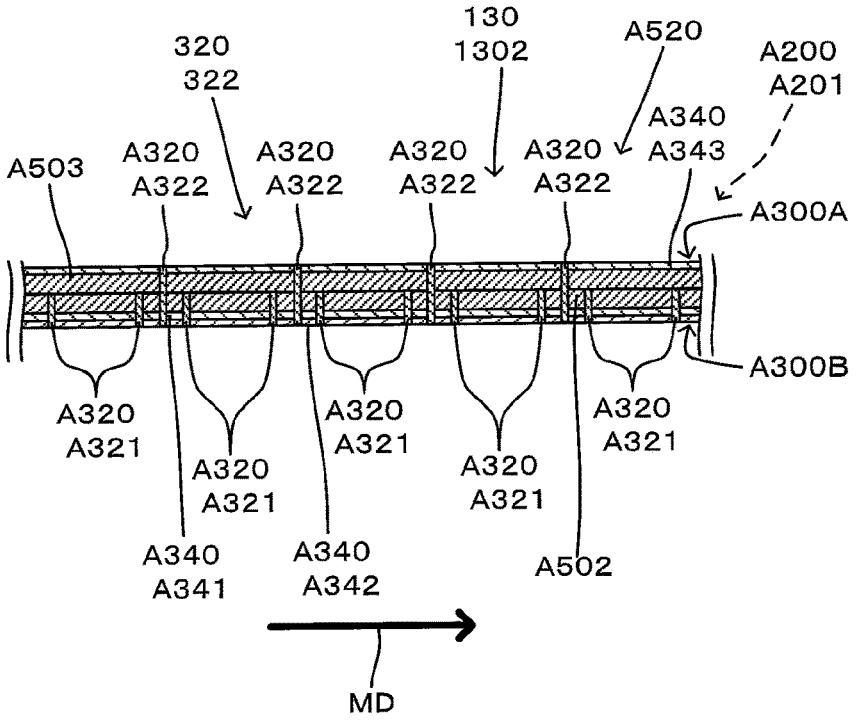
FIG. 47 is a sectional view taken along line VI-VI in FIG. 46.

FIGS. 46 and 47 show the final laminate A520 having the second bonded part A322 formed by the drum roller 310 and the second bonding section 322. For the sake of convenience of explanation, FIG. 46 shows the final laminate A520 as viewed from the inner diameter side of the drum roller 310. The drum roller 310 is disposed on a lower side as viewed in FIG. 47. The holding space A310 is formed between the first sheet material A340 and the second sheet material A342 in a region between the first bonded part A321 and the second bonded part A322.

Figure 48:
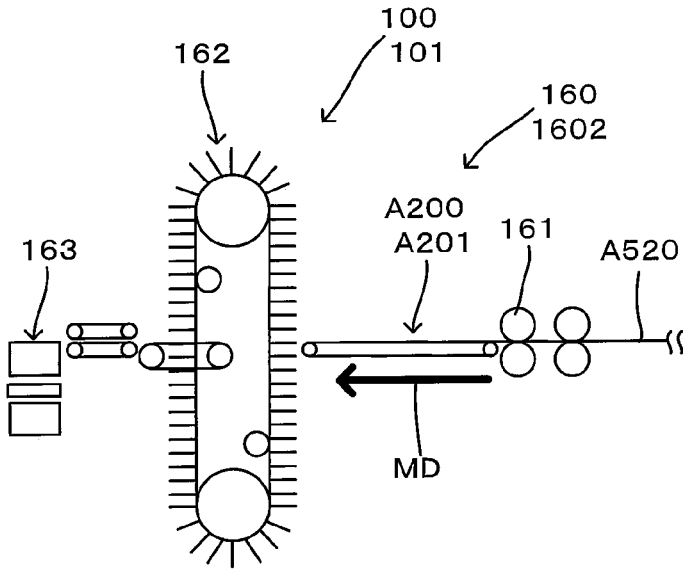
FIG. 48 is an explanatory drawing of a final processing part in the second manufacturing device.

FIG. 48 shows the final processing part 1602. The final processing part 1602 has the final cutting device 161 that cuts the final laminate A520 in the machine transverse direction CMD in order to obtain the first cleaning element A201 from the final laminate A520. The final cutting device 161 further has the counting device 162 for counting the first cleaning elements A201 and the packaging device 163 for packaging the counted first cleaning elements A201.

Figure 49:
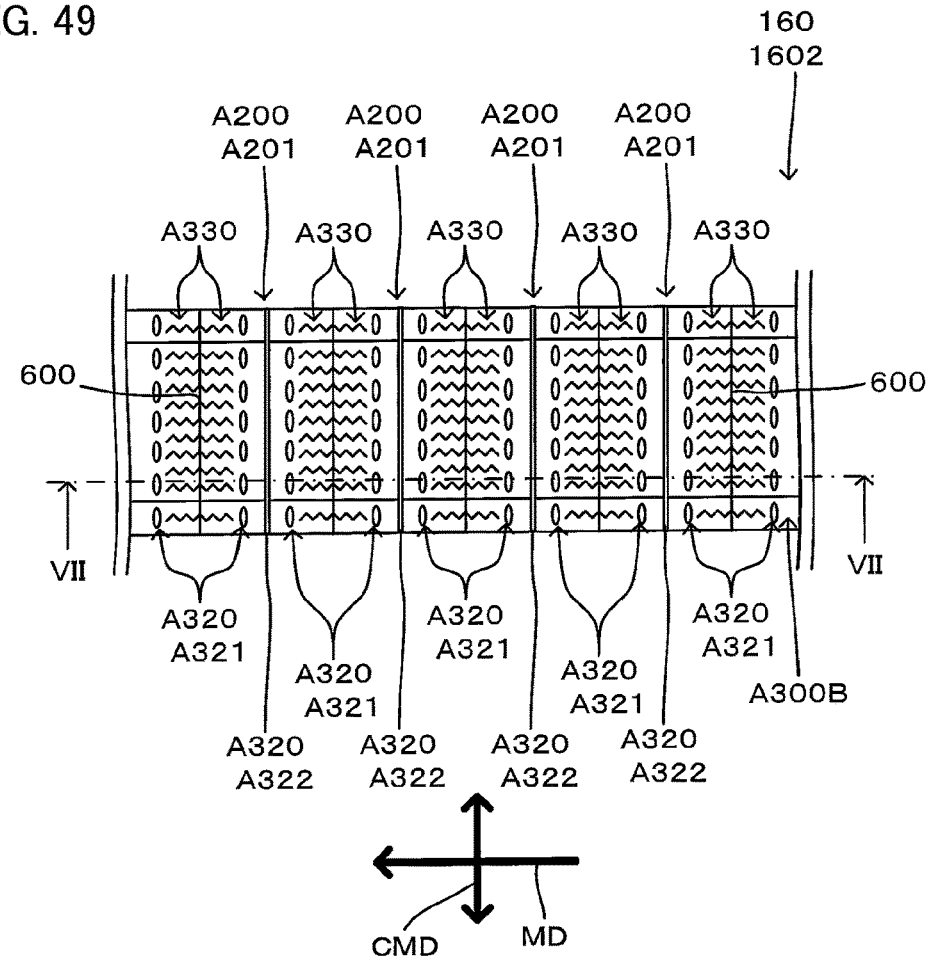
FIG. 49 is a view showing a state of a material in the final processing part.
Figure 50:
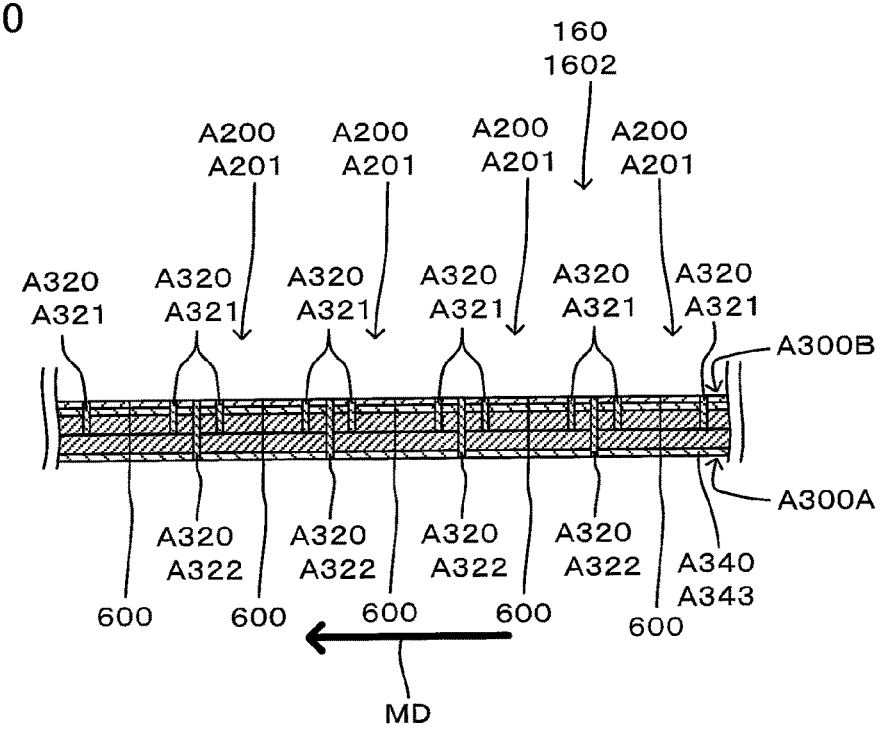
FIG. 50 is a sectional view taken along line VII-VII in FIG. 49.

FIGS. 49 and 50 show the final laminate A520 cut by the final cutting device 161. The final laminate A520 is cut along the cutting parts 600 and forms the first cleaning elements A201.

The second manufacturing device 102 manufactures the first cleaning element A201 through the above-described devices and steps.

(Structure of the Second Cleaning Element)

Figure 51:
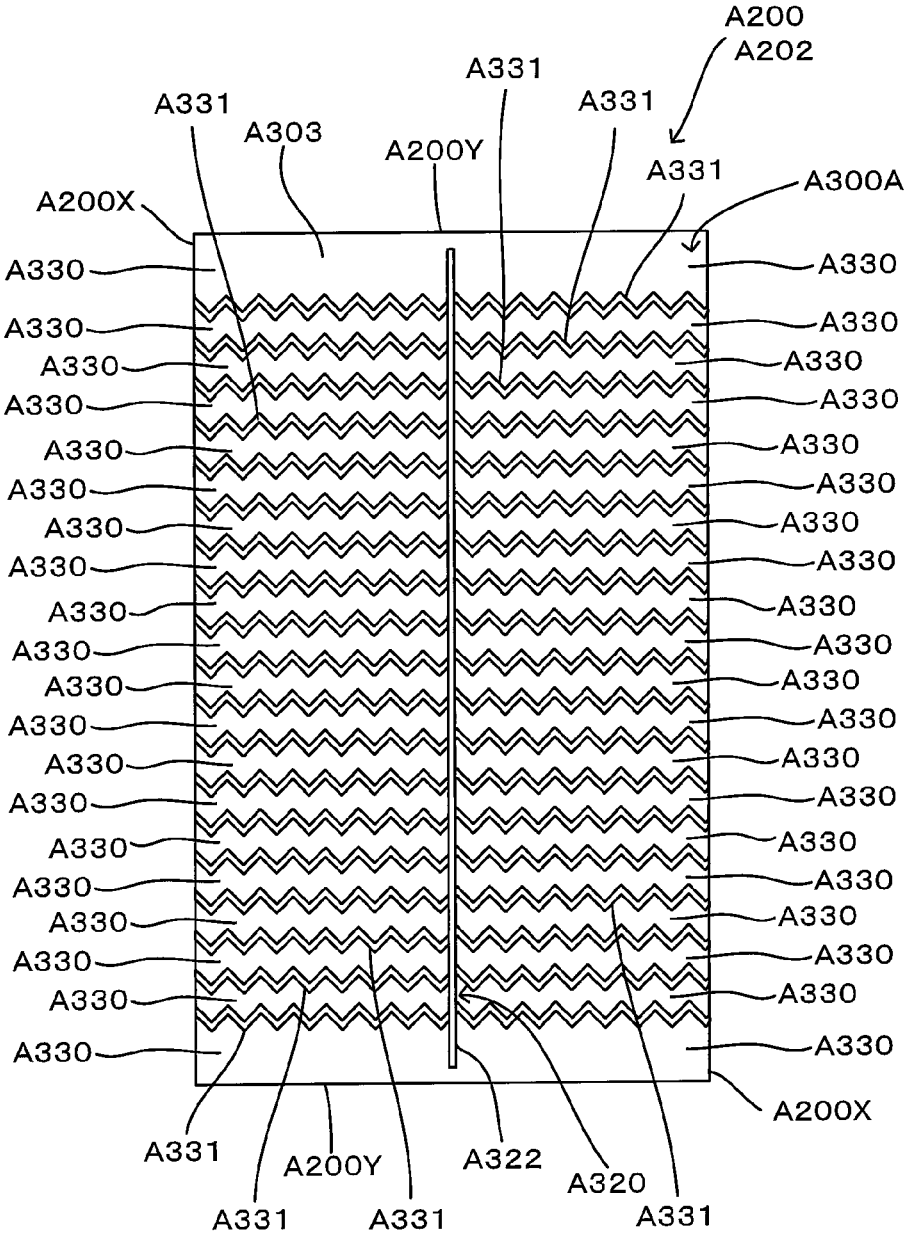
FIG. 51 is a view of a second cleaning element as viewed from one side.
Figure 52:
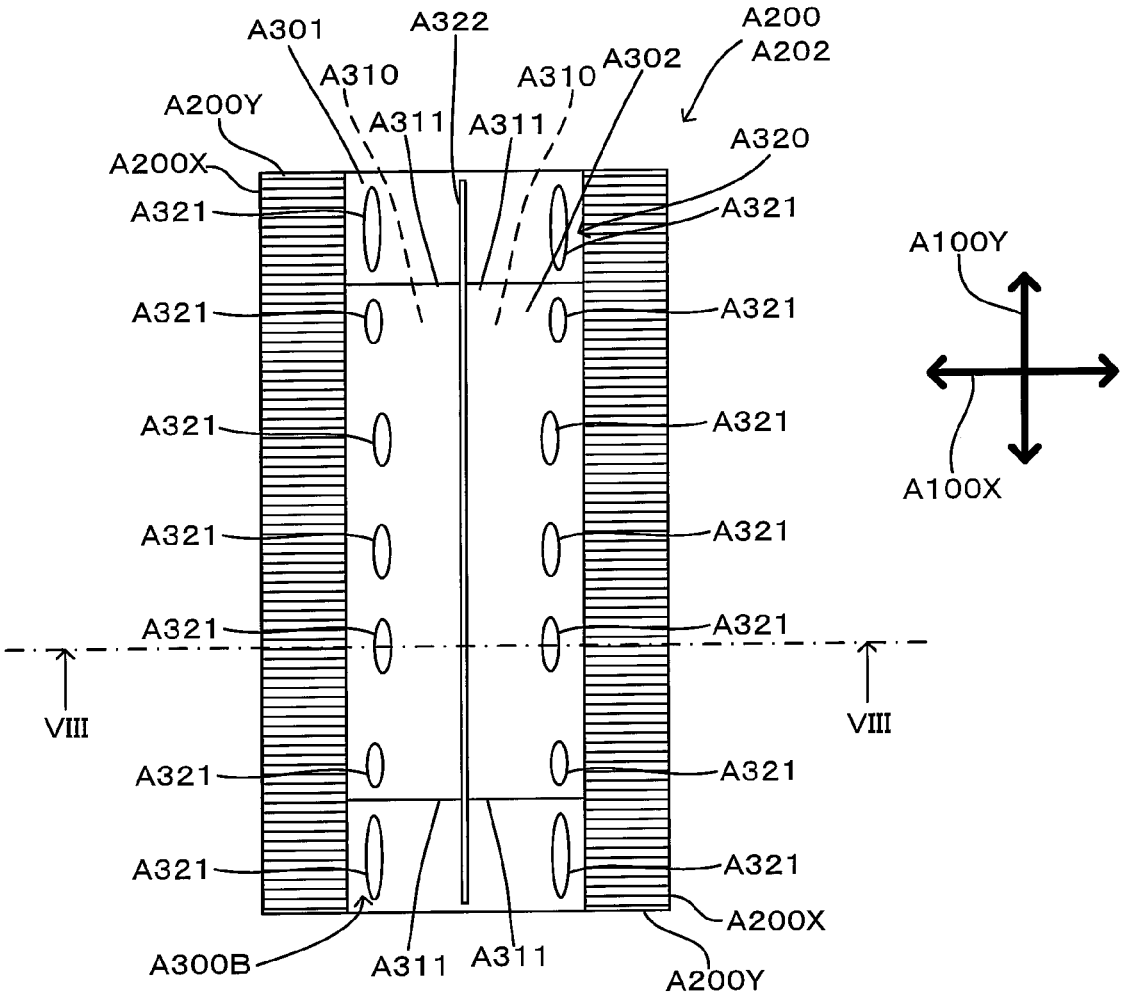
FIG. 52 is a view of the second cleaning element as viewed from the other side.
Figure 53:
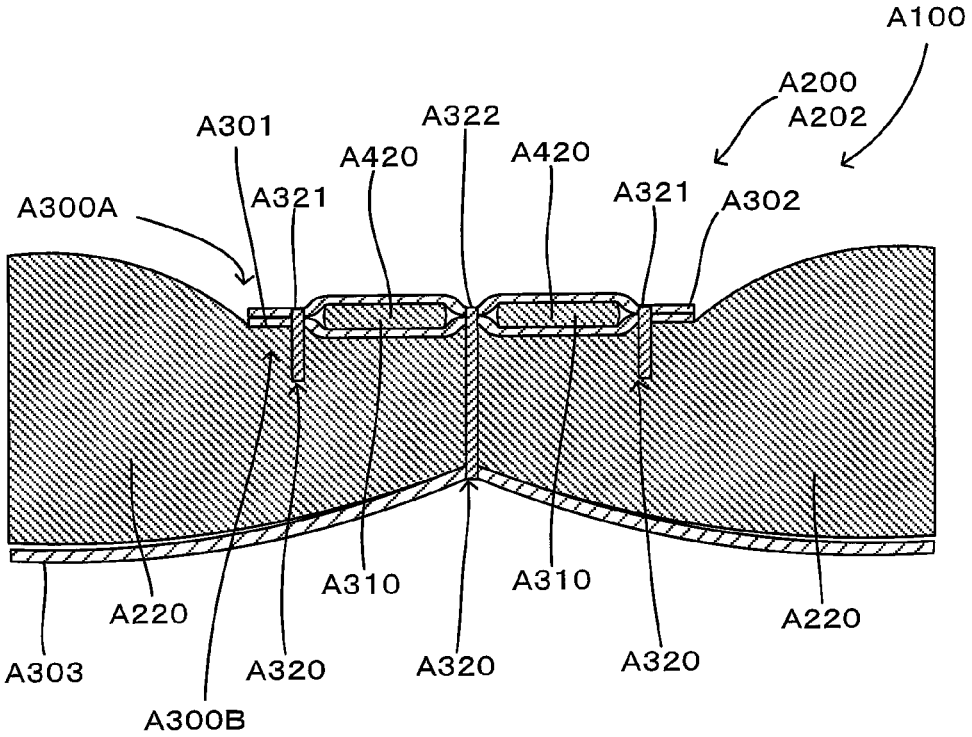
FIG. 53 is a sectional view taken along line VIII-VIII in FIG. 52.
Figure 54:
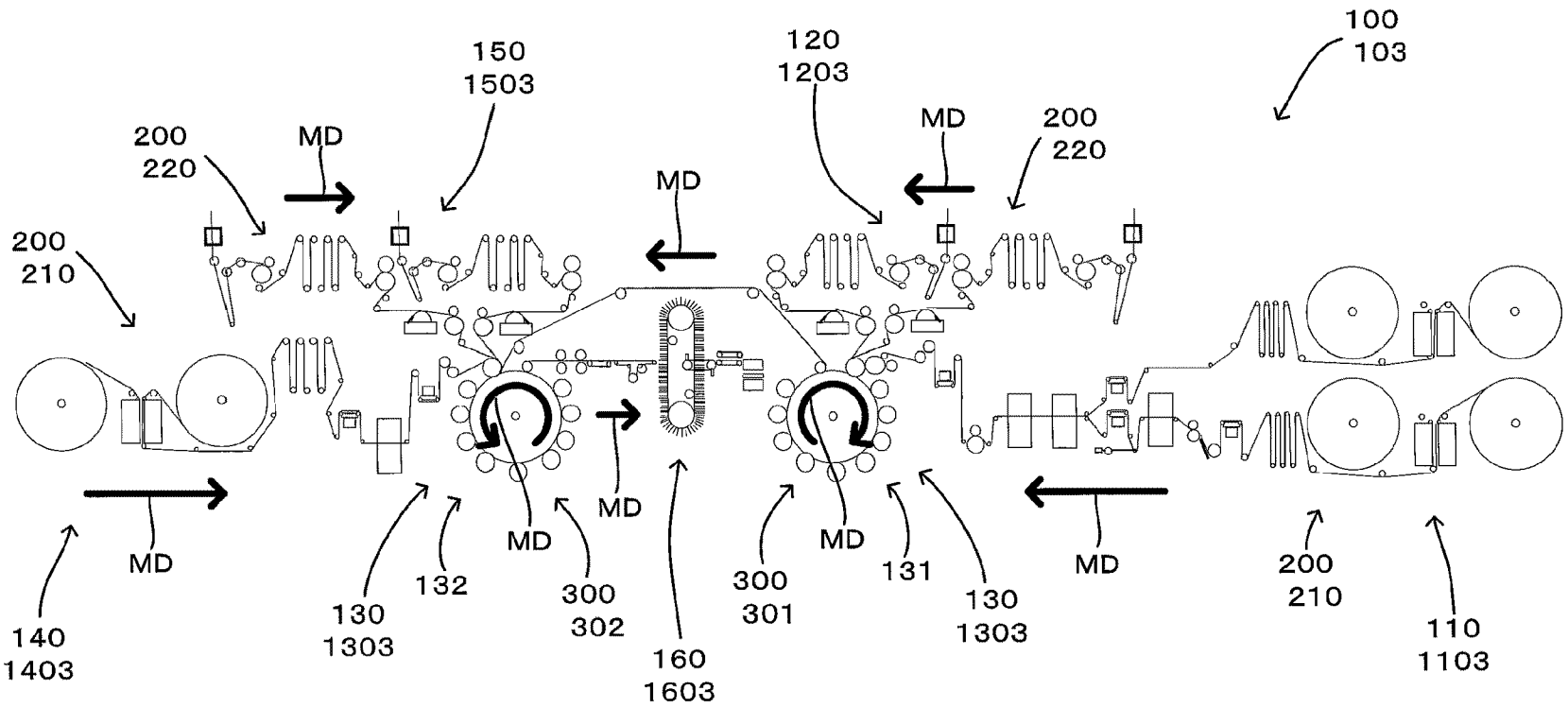
FIG. 54 is an explanatory drawing of a third manufacturing device according to the present invention.
Figure 55:
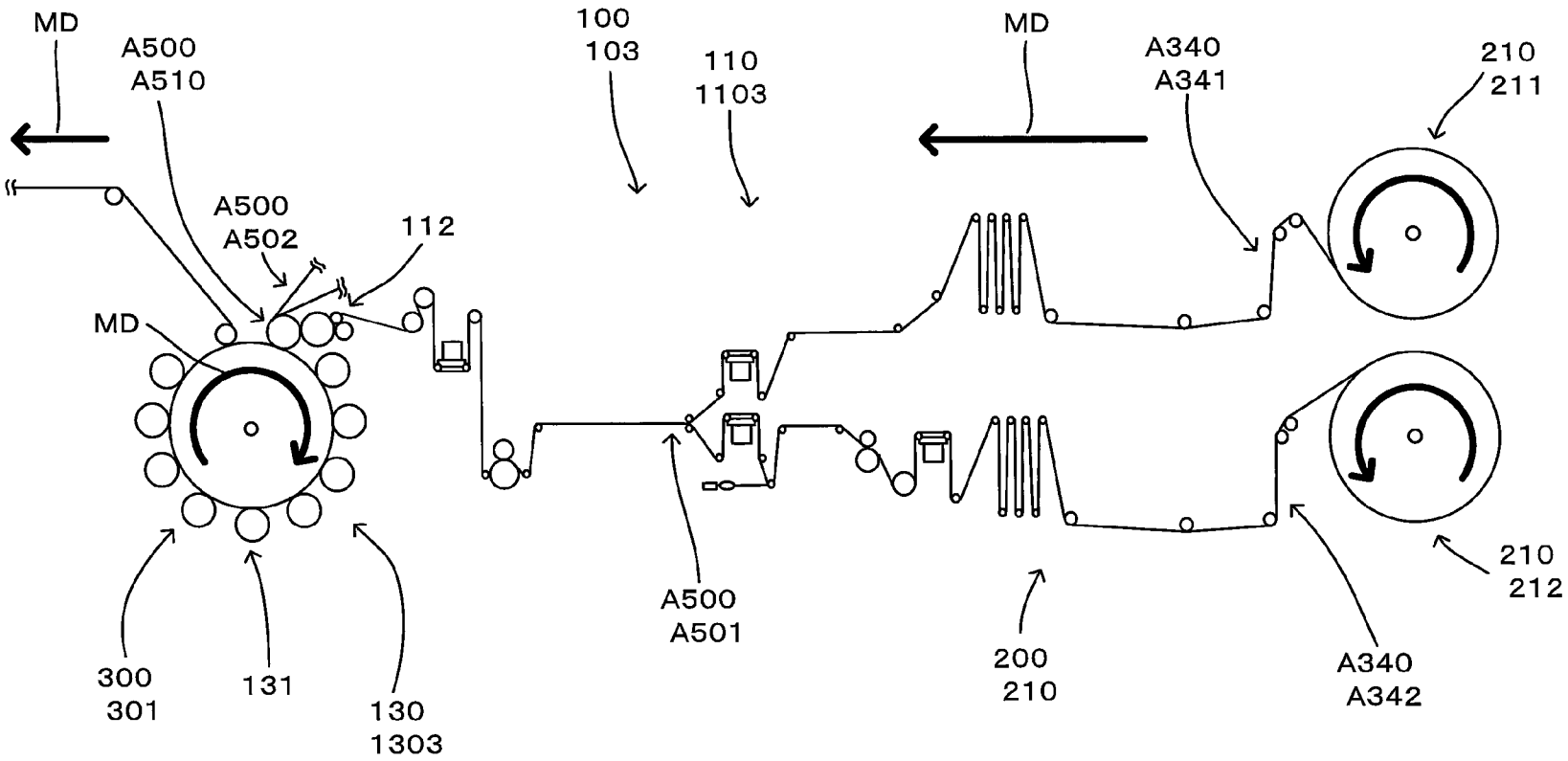
FIG. 55 is an explanatory drawing of a laminate sheet material feeding part in the third manufacturing device.

A structure of the second cleaning element A202 is explained with reference to FIGS. 51 to 53.

The second cleaning element A202 is different in the structures of the first and second sheet parts A301, A302 from the first cleaning element A201. Specifically, in the second cleaning element A202, the first and second sheet parts A301, A302 are shorter than the fiber assembly A220 in the transverse direction A100X.

Specifically, the second cleaning element A202 does not have the first and second sheet parts A301, A302 in regions including ends A200X in the transverse direction A100X. Therefore, when a user performs a cleaning operation by using the cleaning tool A100, the fiber assembly A220 can more easily follow the shape of the object to be cleaned.

(Structure of the Third Manufacturing Device)

The structure of the third manufacturing device 103 is explained with reference to FIGS. 54 to 74. The third manufacturing device 103 manufactures the second cleaning element A202. Further, the third manufacturing device 103 has a bonding part 1303 which includes the first bonding part 131 having the first bonding device 301 and the second bonding part 132 having the second bonding device 302.

The third manufacturing device 103 has a laminate sheet material feeding part 1103 for feeding the first sheet material A341 and the second sheet material A342. The laminate sheet material feeding part 1103 has a device for cutting the first and second sheet materials A341, A342 superposed one on the other, into a prescribed length. Further, the laminate sheet material feeding part 1103 has a device for feeding the cut first and second sheet materials A341, A342 to the bonding part 1303.

The third manufacturing device 103 further has a first fiber material feeding part 1203 for feeding the fiber material A230.

The third manufacturing device 103 further has the first bonding part 131 that bonds the first sheet material A341, the second sheet material A342 and the fiber material A230 fed by the first fiber material feeding part 1203 and thereby forms the intermediate laminate A510.

The third manufacturing device 103 further has a sheet material feeding part 1403 for feeding the third sheet material A343, and a second fiber material feeding part 1503 for feeding the fiber material A230.

The third manufacturing device 103 further has the second bonding part 132 that bonds the intermediate laminate A510, the third sheet material A343 and the fiber material A230 fed by the second fiber material feeding part 1503 and thereby forms the final laminate A520.

The third manufacturing device 103 further has a final processing part 1603 for cutting and packaging the final laminate A520.

Specifically, the process of manufacturing the second cleaning element A202 by the third manufacturing device 103 has steps of superposing the first sheet material A341 and the second sheet material A342, cutting the superposed first and second sheet materials A341, A342 into the prescribed length, and feeding the cut first and second sheet materials A341, A342.

The manufacturing process by the third manufacturing device 103 further has a step of feeding one of the fiber materials A230.

The manufacturing process by the third manufacturing device 103 has a step of bonding the first sheet material A341, the second sheet material A342 and the one fiber material A230 to form the intermediate laminate A510.

The manufacturing process by the third manufacturing device 103 further has a step of feeding the third sheet material A343 and a step of feeding the other fiber material A230.

The manufacturing process by the third manufacturing device 103 further has a step of bonding the intermediate laminate A510, the third sheet material A343 and the other fiber material A230 to form the final laminate A520.

The manufacturing process by the third manufacturing device 103 further has a step of cutting and packaging the final laminate A520.

FIGS. 55 to 59 show the laminate sheet material feeding part 1103. The laminate sheet material feeding part 1103 has the sheet material feeding device 210. The sheet material feeding device 210 includes the first sheet material feeding device 211 for feeding the first sheet material A341, and the second sheet material feeding device 212 for feeding the second sheet material A342.

The first sheet material feeding device 211 conveys the first sheet material A341 in the machine direction MD. The second sheet material feeding device 212 conveys the second sheet material A342 in the machine direction MD. The first sheet material A341 and the second sheet material A342 are superposed to form the laminate A500. The laminate A500 of the first sheet material A341 and the second sheet material A342 is defined as a sheet laminate A501.

Figure 56:
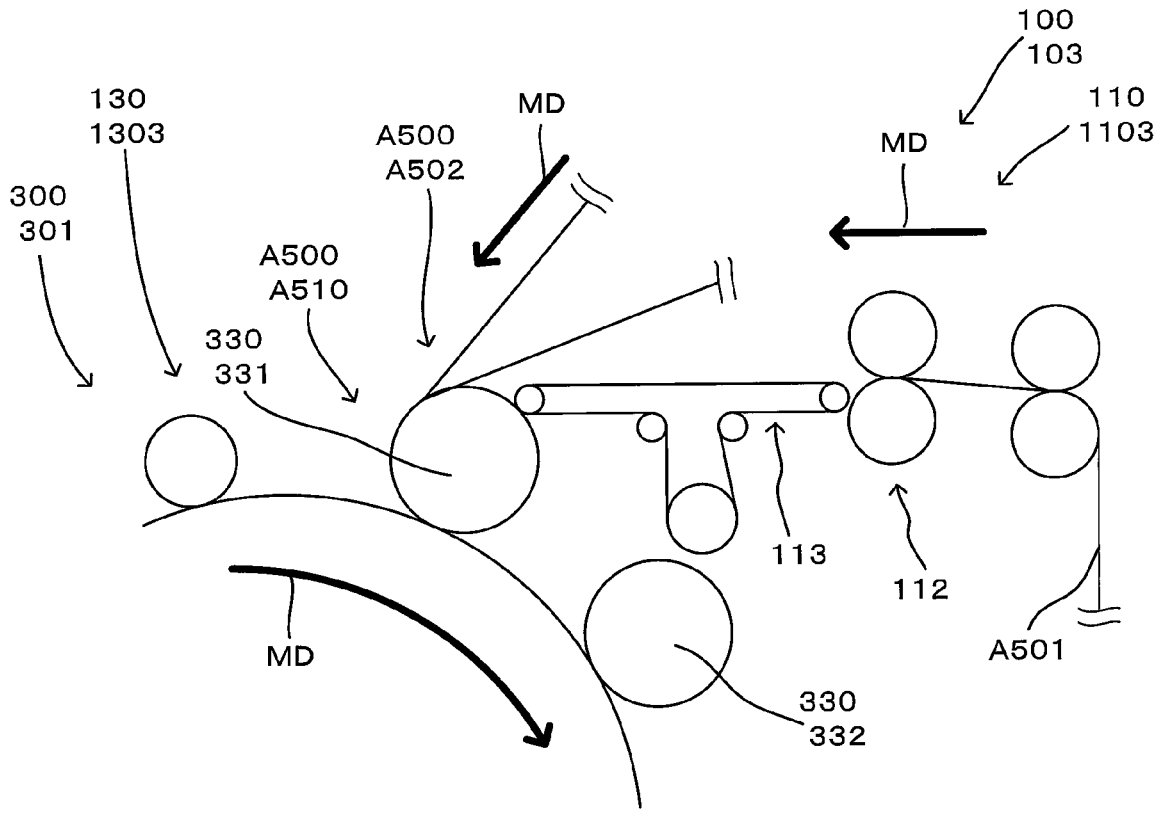
FIG. 56 is an explanatory drawing of the laminate sheet material feeding part in the third manufacturing device.

FIG. 56 shows a sheet laminate cutting device 112 for cutting the sheet laminate A500 and a conveyer device 113 for conveying the cut sheet laminate A500. Further, as the sheet laminate cutting device 112, a well-known device such as a cutter may be used, and as the conveyer device 113, a well-known device such as a belt conveyer may be used.

Figure 57:
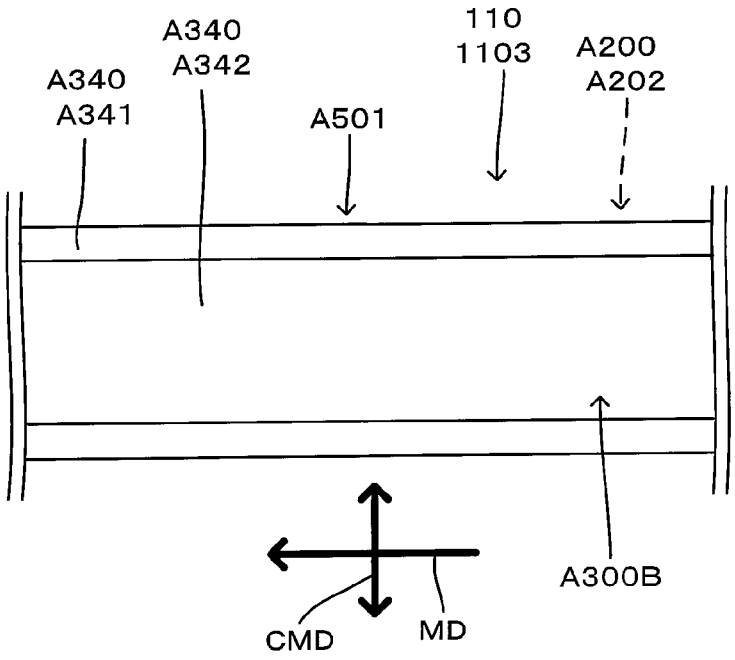
FIG. 57 is a view showing a state of a material in the laminate sheet material feeding part.

FIG. 57 shows the sheet laminate A501 which is not yet fed to the sheet laminate cutting device 112 in the laminate sheet material feeding part 1103.

The second sheet material A342 is formed to be shorter than the first sheet material A341 in the machine transverse direction CMD. Therefore, the second sheet material A342 is not overlapped on the both end regions of the first sheet material A341 in the machine transverse direction CMD.

Figure 58:
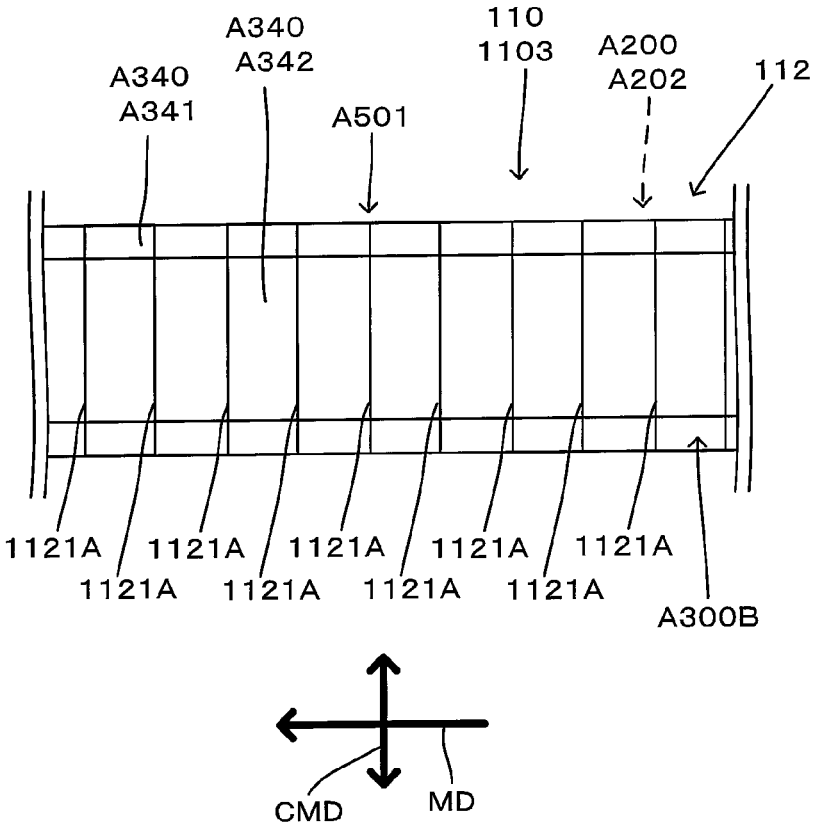
FIG. 58 is a view showing the state of the material in the laminate sheet material feeding part.

FIG. 58 shows the sheet laminate A501 fed to the sheet laminate cutting device 112 in the laminate sheet material feeding part 1103. The sheet laminate A501 is cut in the machine transverse direction CMD by the sheet laminate cutting device 112. At this time, the sheet laminate A501 is cut at prescribed intervals in the machine transverse direction CMD.

Figure 59:
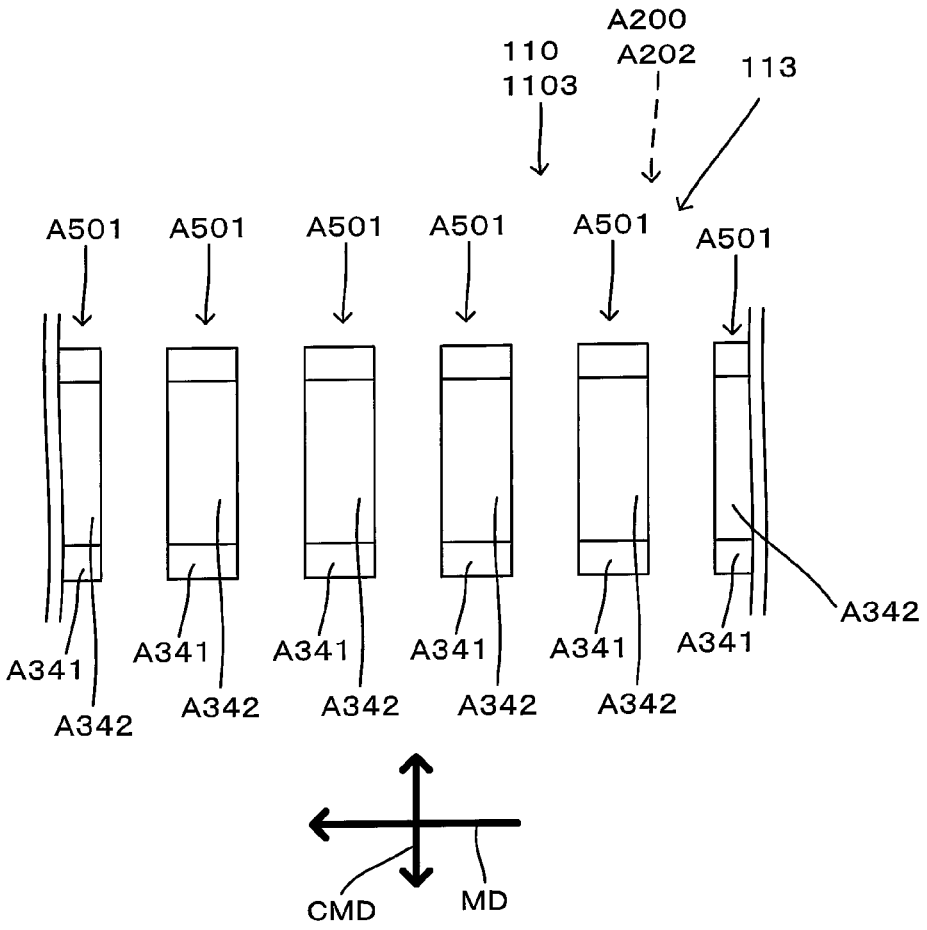
FIG. 59 is a view showing the state of the material in the laminate sheet material feeding part.

FIG. 59 shows the sheet laminates A501 conveyed to the conveyer device 113 in the laminate sheet material feeding part 1103. The sheet laminates A501 are conveyed with prescribed spacing in the machine direction MD. The sheet laminates A501 are fed to the first bonding part 131 in the bonding part 1303 by the conveyer device 113.

Figure 60:
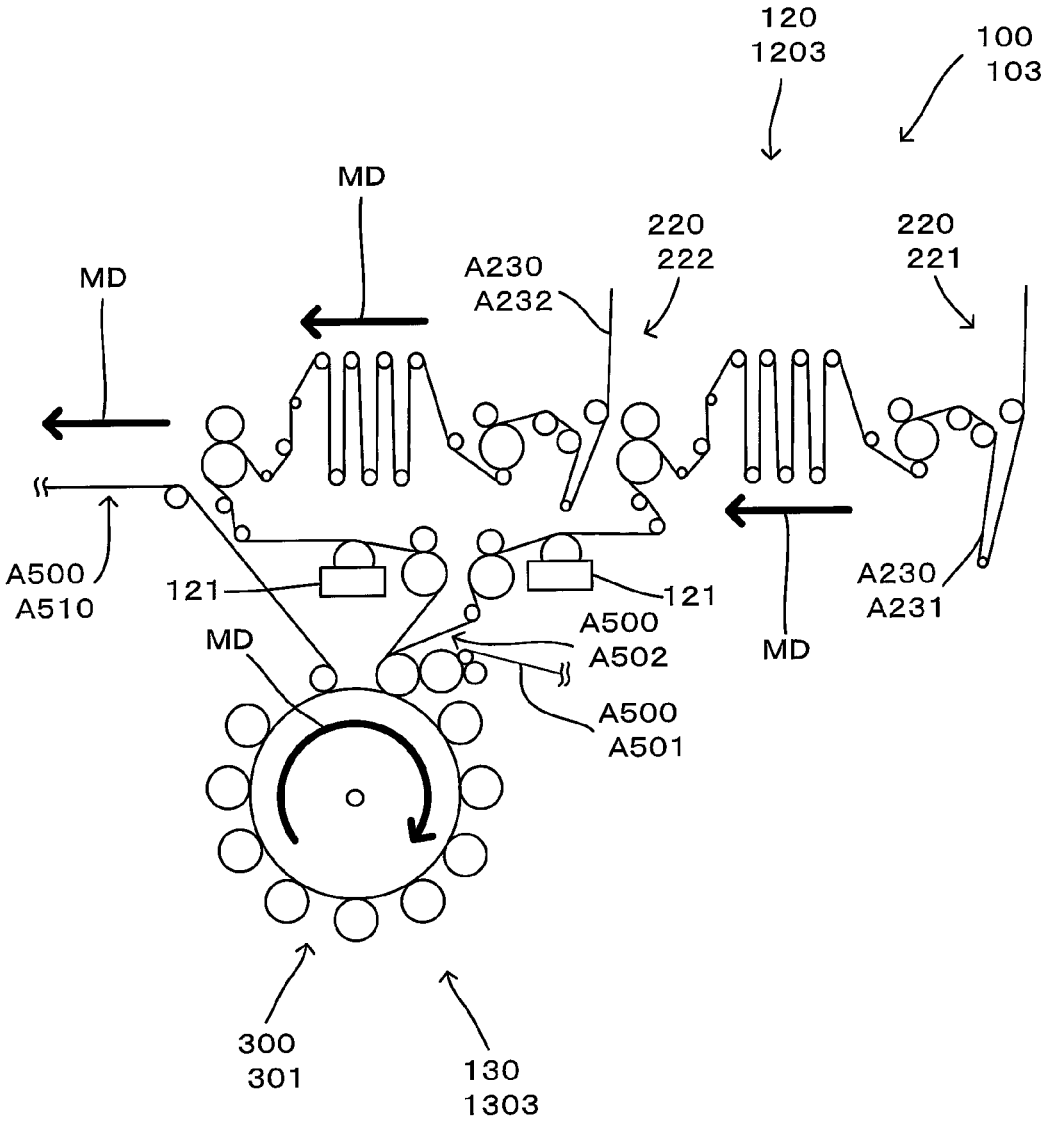
FIG. 60 is an explanatory drawing of a first fiber material feeding part in the third manufacturing device.

FIG. 60 shows the first fiber material feeding part 1203. The first fiber material feeding part 1203 has the fiber material feeding device 220. The fiber material feeding device 220 includes the first fiber material feeding device 221 for feeding the first fiber material A231 and the second fiber material feeding device 222 for feeding the second fiber material A232.

The first fiber material feeding device 221 conveys the first fiber material A231 in the machine direction MD. The second fiber material feeding device 222 conveys the second fiber material A232 in the machine direction MD. The first fiber material A231 and the second fiber material A232 are superposed to form the laminate A500. The laminate A500 of the first fiber material A231 and the second fiber material A232 is defined as the first fiber laminate A502. The first fiber laminate A502 is fed to the first bonding part 131 in the bonding part 1303. Further, dust adsorbent oil is supplied to the first fiber material A231 and the second fiber material A232 by the oil applicator 121.

Further, the fiber material A230 is formed of opened tows. The direction in which the fiber tows extend substantially coincides with the machine direction MD.

Figure 61:
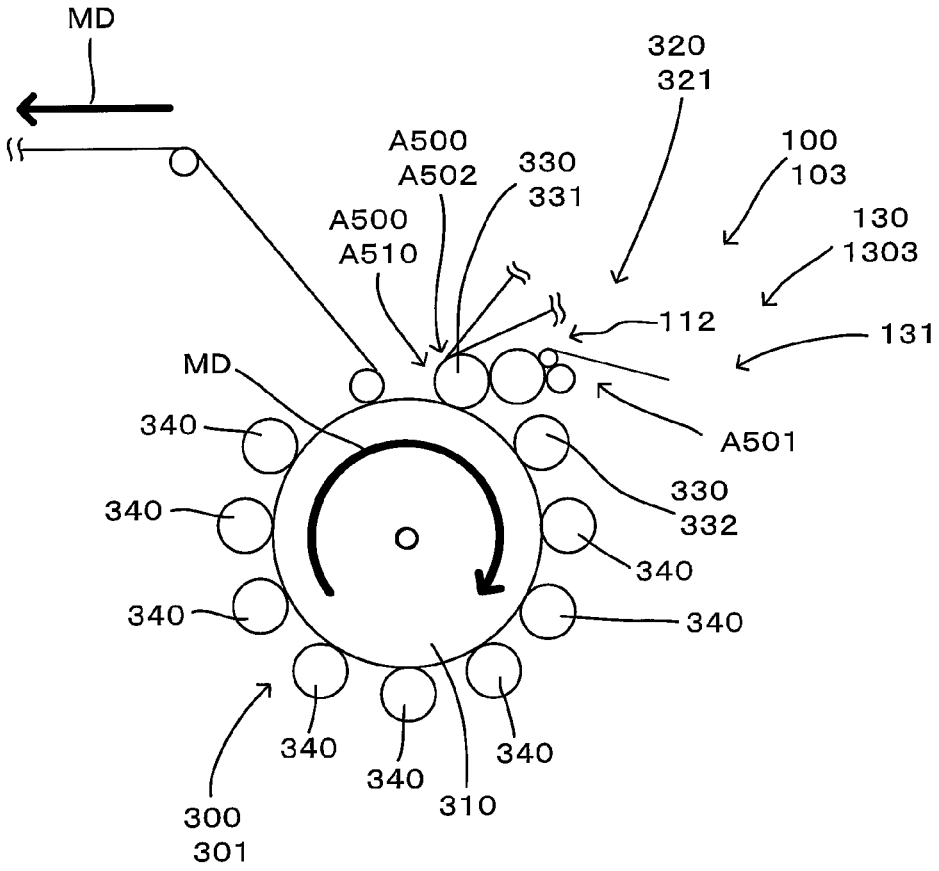
FIG. 61 is an explanatory drawing of a first bonding part in the third manufacturing device.

FIG. 61 shows the first bonding part 131 in the bonding part 1303. The first bonding part 131 has the first bonding device 301. The first bonding device 301 has the drum roller 310 and the bonding section 320. The bonding section 320 has the first bonded region forming section 331 and the second bonded region forming section 332.

The sheet laminates A501 and the first fiber laminate A502 are fed to the first bonding part 131. The first fiber laminate A502 is arranged on the one side A300A of the first sheet material A341 of each of the sheet laminates A501. Further, in the first bonding part 131, the bonded region 500 is formed in the prescribed regions of the sheet laminate A501 and the first fiber laminate A502 by the drum roller 310 and the bonding section 320. The bonded region 500 is defined as the bonded part A320 at which the prescribed regions of the sheet laminate A501 and the first fiber laminate A502 are bonded. The bonded part A320 formed by the first bonding part 131 forms the first bonded part A321 of the second cleaning element A202.

The sheet laminate A501 and the first fiber laminate A502 which are bonded at the bonded part A320 form the intermediate laminate A510. The intermediate laminate A510 is conveyed to the second bonding part 132 in the machine direction MD.

Figure 62:
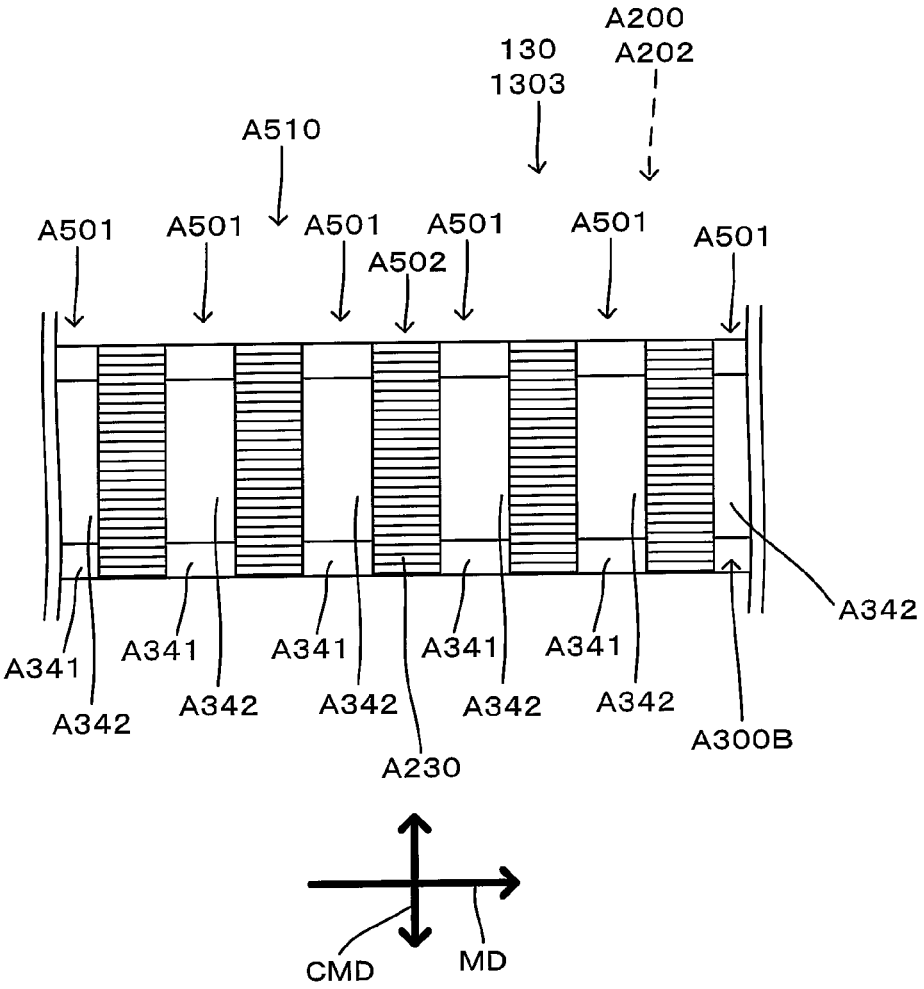
FIG. 62 is a view showing a state of a material in the first bonding part.

FIG. 62 shows a state in which the sheet laminates A501 are superposed on the first fiber laminate A502 in the first bonding part 131. The sheet laminates A501 are arranged at prescribed intervals in the machine direction MD on the first fiber laminate A502.

Figure 63:
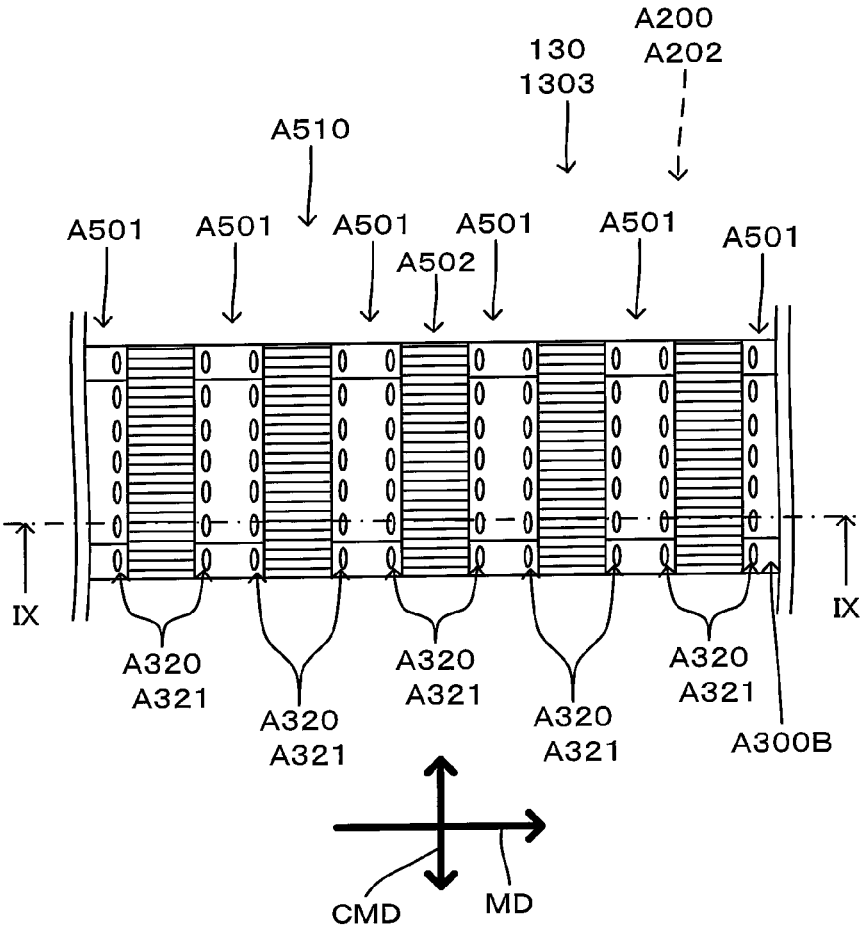
FIG. 63 is a view showing the state of the material in the first bonding part.
Figure 64:
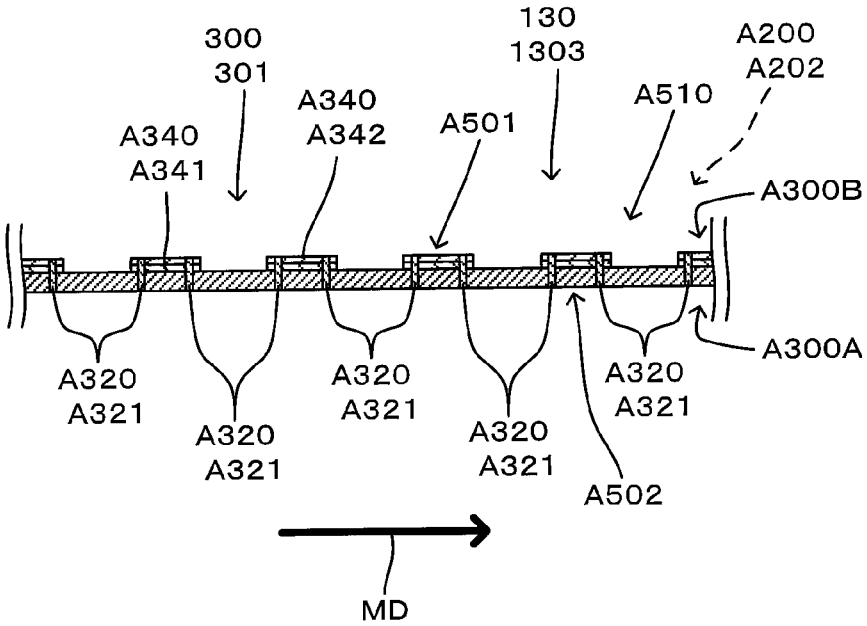
FIG. 64 is a sectional view taken along line XI-XI in FIG. 63.

FIGS. 63 and 64 show the intermediate laminate A501 having the first bonded part A321 formed in the first bonding part 131.

Figure 65:
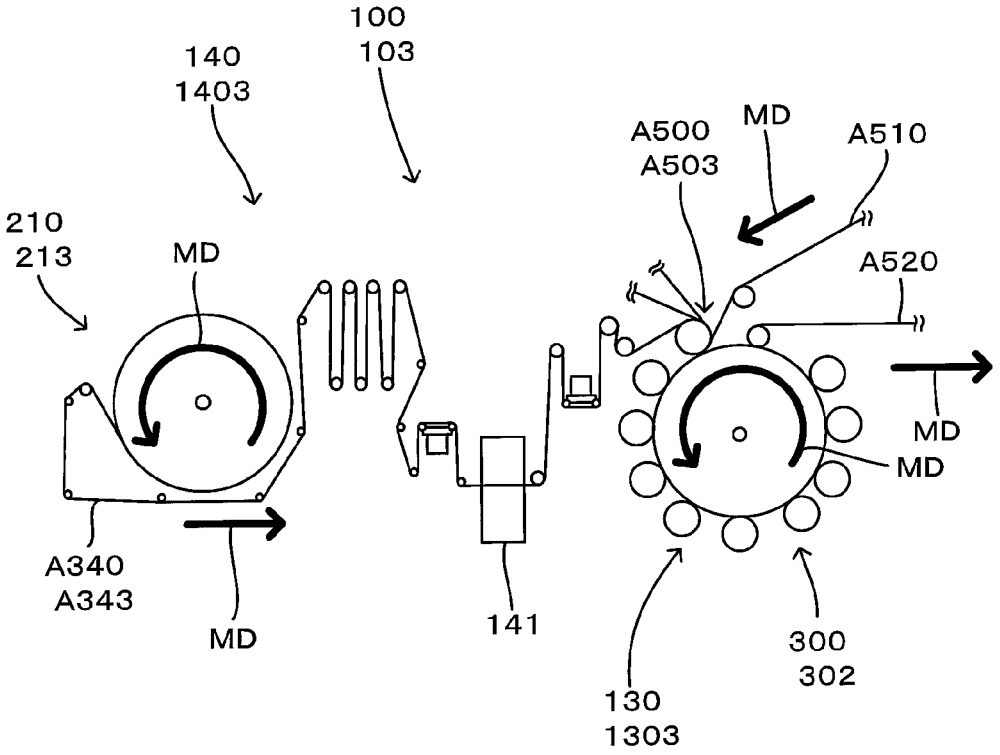
FIG. 65 is an explanatory drawing of a sheet material feeding part in the third manufacturing device.

FIG. 65 shows the sheet material feeding part 1403. The sheet material feeding part 1403 has the sheet material feeding device 210. The sheet material feeding device 210 forms the third sheet material feeding device 213 for feeding the third sheet material A343.

The third sheet material feeding device 213 conveys the third sheet material A343 in the machine direction MD. The cuts A331 are formed in the third sheet material A343 by the cutting device 141, and the third sheet material A343 having the cuts A331 is fed to the second bonding part 132 in the bonding part 1303.

Figure 66:
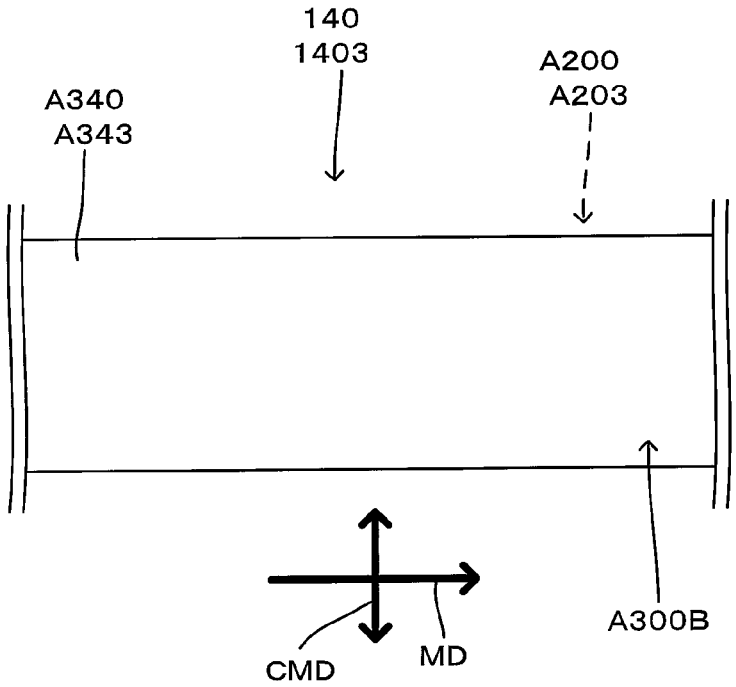
FIG. 66 is a view showing a state of a material in the sheet material feeding part.

FIG. 66 shows the third sheet material A343 which is not yet fed to the cutting device 141 in the sheet material feeding part 1403.

Figure 67:
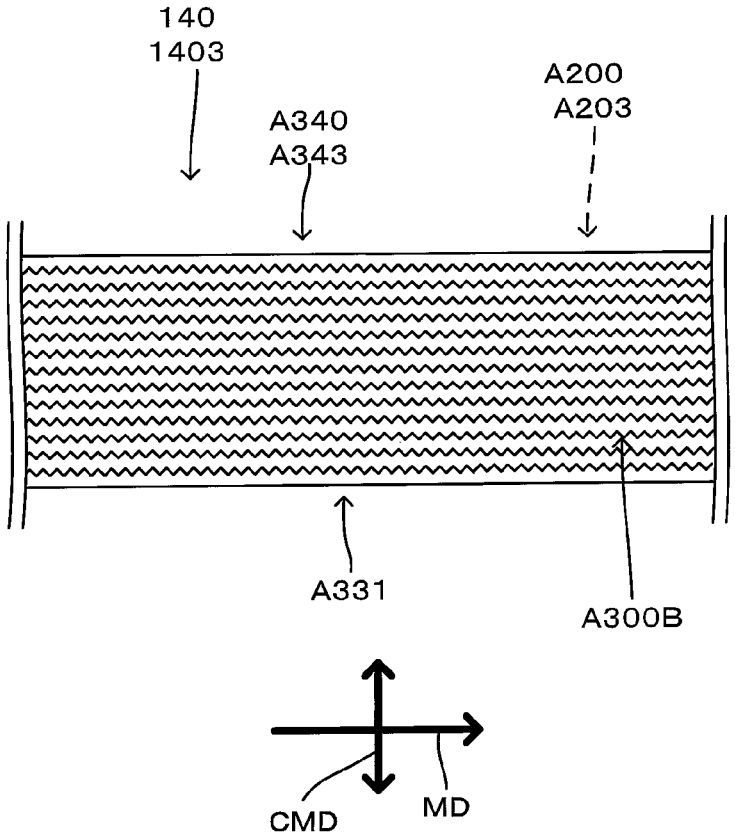
FIG. 67 is a view showing the state of the material in the sheet material feeding part.

FIG. 67 shows the third sheet material A343 fed to the cutting device 141 in the sheet material feeding part 1403. A plurality of the cuts A331 are formed in the third sheet material A343. A region between a pair of the cuts A331 forms a strip A330. Further, as the cutting device 141, a well-known structure such as a cutter may be used.

Figure 68:
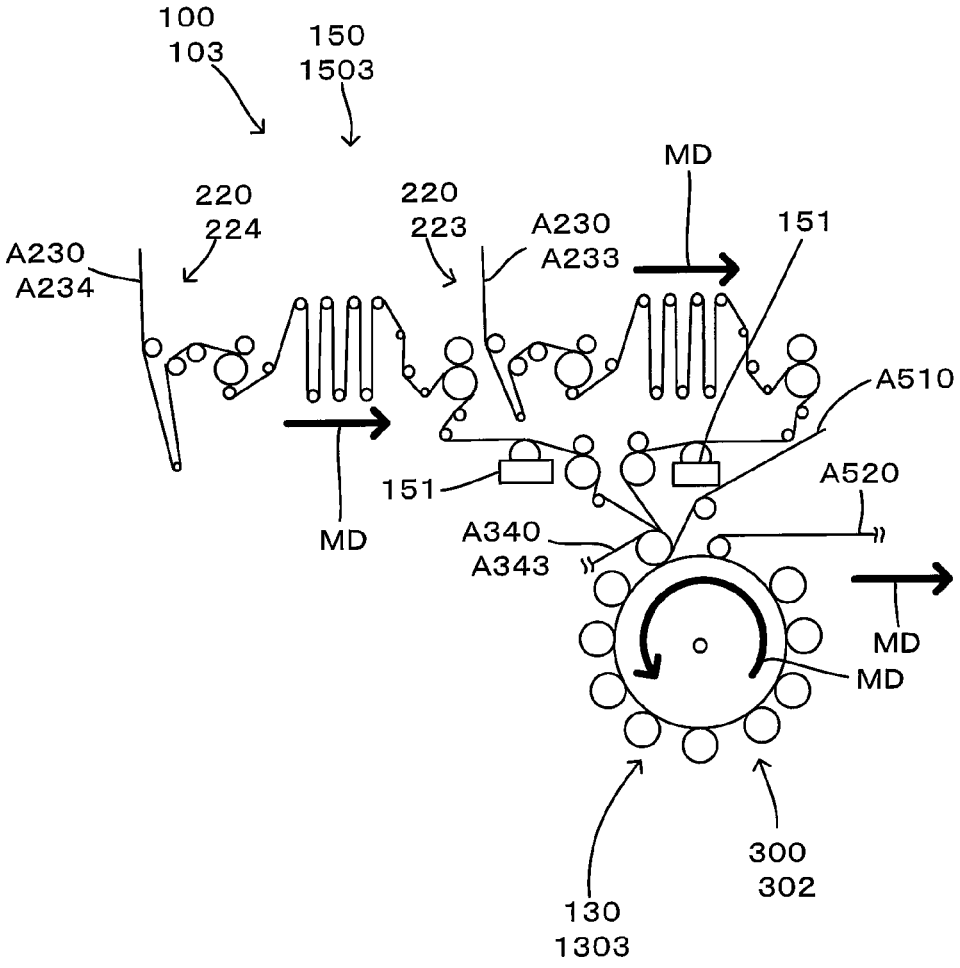
FIG. 68 is an explanatory drawing of a second fiber material feeding part in the third manufacturing device.

FIG. 68 shows the second fiber material feeding part 1503. The second fiber material feeding part 1503 has the fiber material feeding device 220. The fiber material feeding device 220 includes the third fiber material feeding device 223 for feeding the third fiber material A233 and the fourth fiber material feeding device 224 for feeding the fourth fiber material A234.

The third fiber material feeding device 223 conveys the third fiber material A233 in the machine direction MD. The fourth fiber material feeding device 224 conveys the fourth fiber material A234 in the machine direction MD. The third fiber material A233 and the fourth fiber material A234 are superposed to form the laminate A500. The laminate A500 of the third fiber material A233 and the fourth fiber material A234 is defined as the second fiber laminate A503. The second fiber laminate A503 is fed to the second bonding part 132 in the bonding part 1303. Further, dust adsorbent oil is supplied to the third fiber material A233 and the fourth fiber material A234 by the oil applicator 151.

Figure 69:
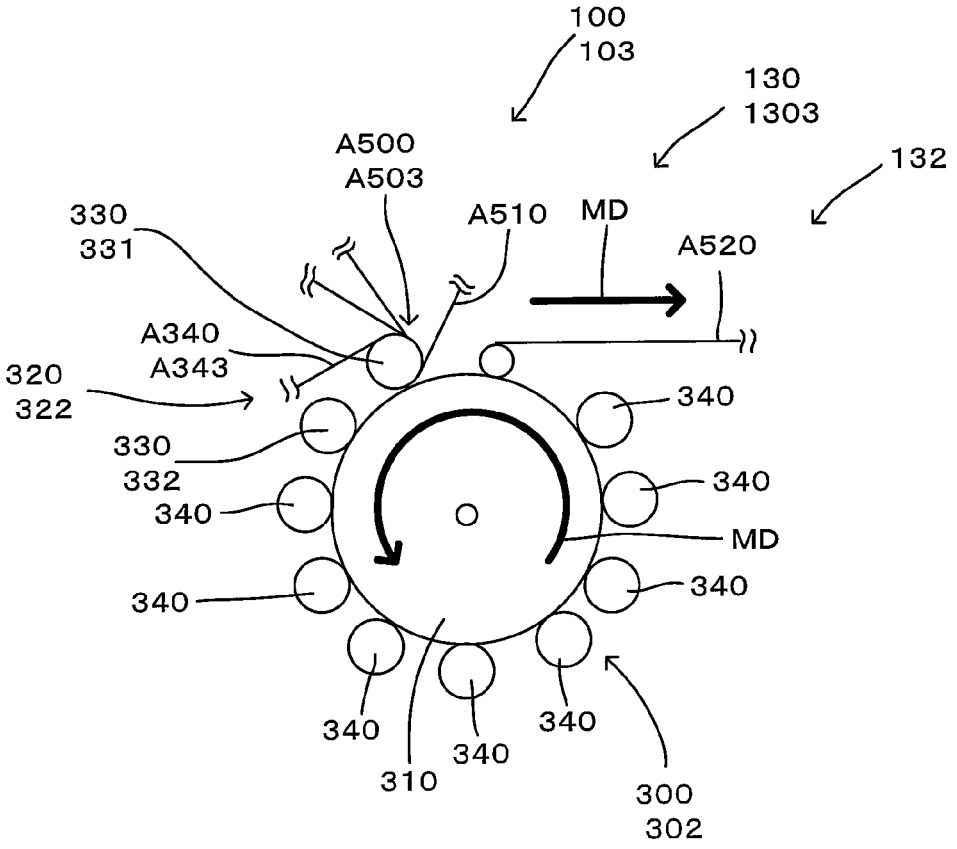
FIG. 69 is an explanatory drawing of a second bonding part in the third manufacturing device.

FIG. 69 shows the second bonding part 132 in the bonding part 1303. The second bonding part 132 has the second bonding device 302. The second bonding device 302 has the drum roller 310 and the bonding section 320. The bonding section 320 has the first bonded region forming section 331 and the second bonded region forming section 332.

The intermediate laminate A510, the second fiber laminate A503 and the third sheet material A343 are fed to the second bonding part 132. The second fiber laminate A503 is arranged on a surface of the first fiber laminate A502 of the intermediate laminate A510. The third sheet material A343 is arranged on a surface of the second fiber laminate A503 on the side opposite to the first fiber laminate A502.

Further, in the second bonding part 132, the bonded region 500 is formed in the prescribed regions of the intermediate laminate A510, the second fiber laminate A503 and the third sheet material A343 by the drum roller 310 and the bonding section 320. The bonded region 500 is defined as the bonded part A320 at which the prescribed regions of the intermediate laminate A510, the second fiber laminate A503 and the third sheet material A343 are bonded. The bonded part A320 formed by the second bonding part 132 forms the second bonded part A322 of the second cleaning element A202.

The intermediate laminate A510, the second fiber laminate A503 and the third sheet material A343 which are bonded at the bonded part A320 form the final laminate A520. The final laminate A520 is conveyed to the final processing part 1603 in the machine direction MD.

Figure 70:
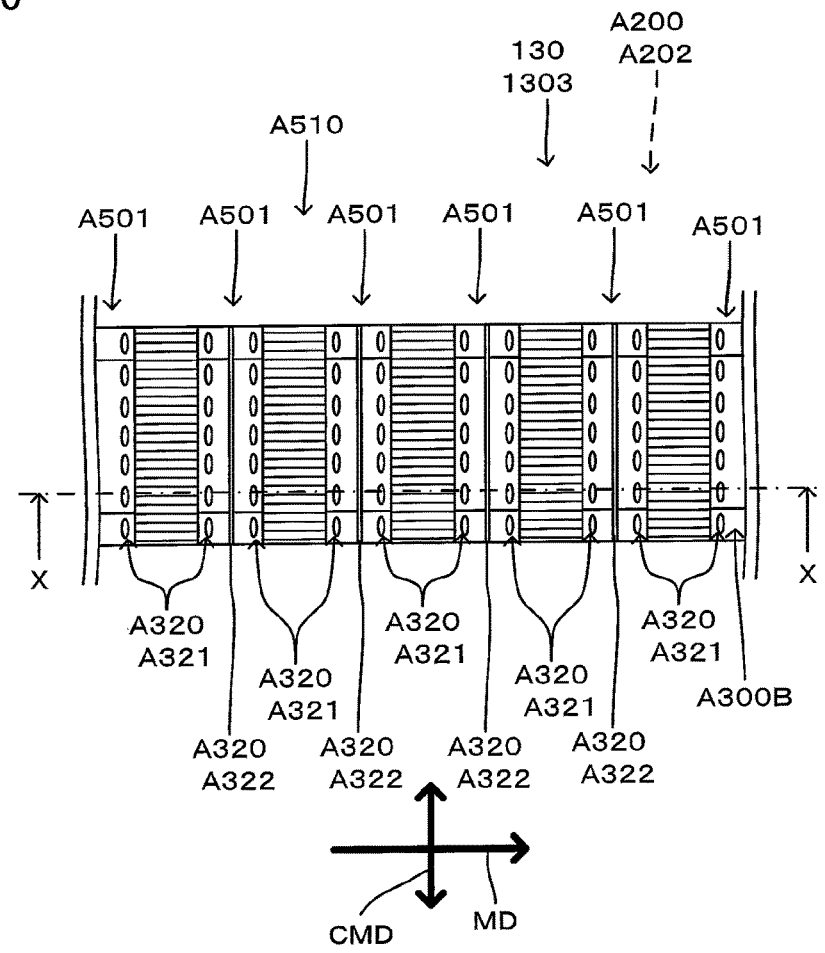
FIG. 70 is a view showing a state of a material in the second bonding part.
Figure 71:
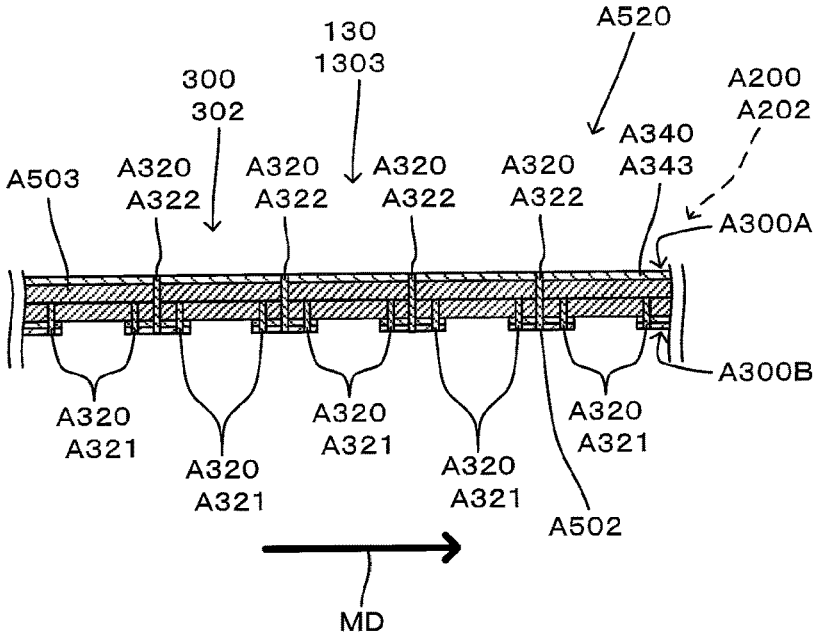
FIG. 71 is a sectional view taken along line X-X in FIG. 70.

FIGS. 70 and 71 show the final laminate A520 having the second bonded part A322 formed in the second bonding part 132. For the sake of convenience of explanation, FIG. 70 shows the final laminate A520 as viewed from the inner diameter side of the drum roller 310. The drum roller 310 is disposed on a lower side as viewed in FIG. 71. The holding space A310 is formed between the first sheet material A340 and the second sheet material A342 in a region between the first bonded part A321 and the second bonded part A322.

Figure 72:
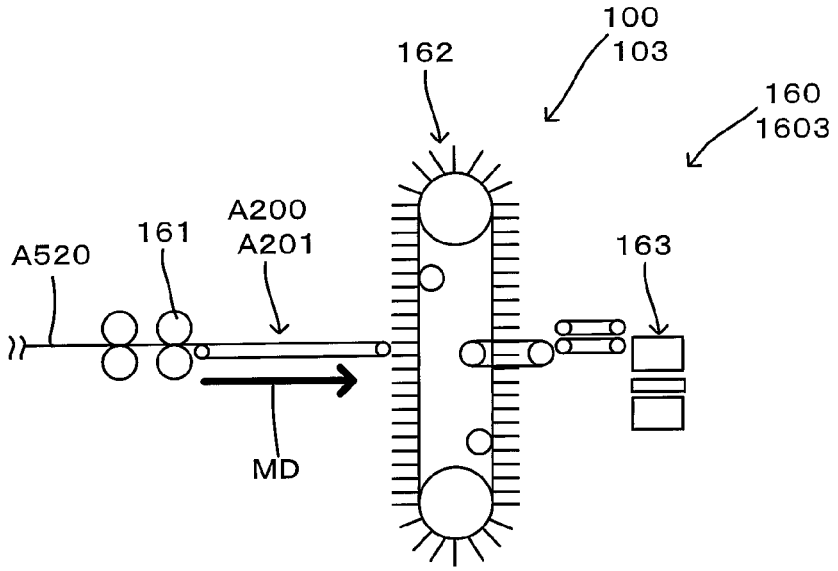
FIG. 72 is an explanatory drawing of a final processing part in the third manufacturing device.

FIG. 72 shows the final processing part 1603. The final processing part 1603 has the final cutting device 161 that cuts the final laminate A520 in the machine transverse direction CMD to obtain the second cleaning element A202 from the final laminate A520. The final processing part 1603 further has the counting device 162 for counting the second cleaning elements A202 and the packaging device 163 for packaging the counted second cleaning elements A202.

Figure 73:
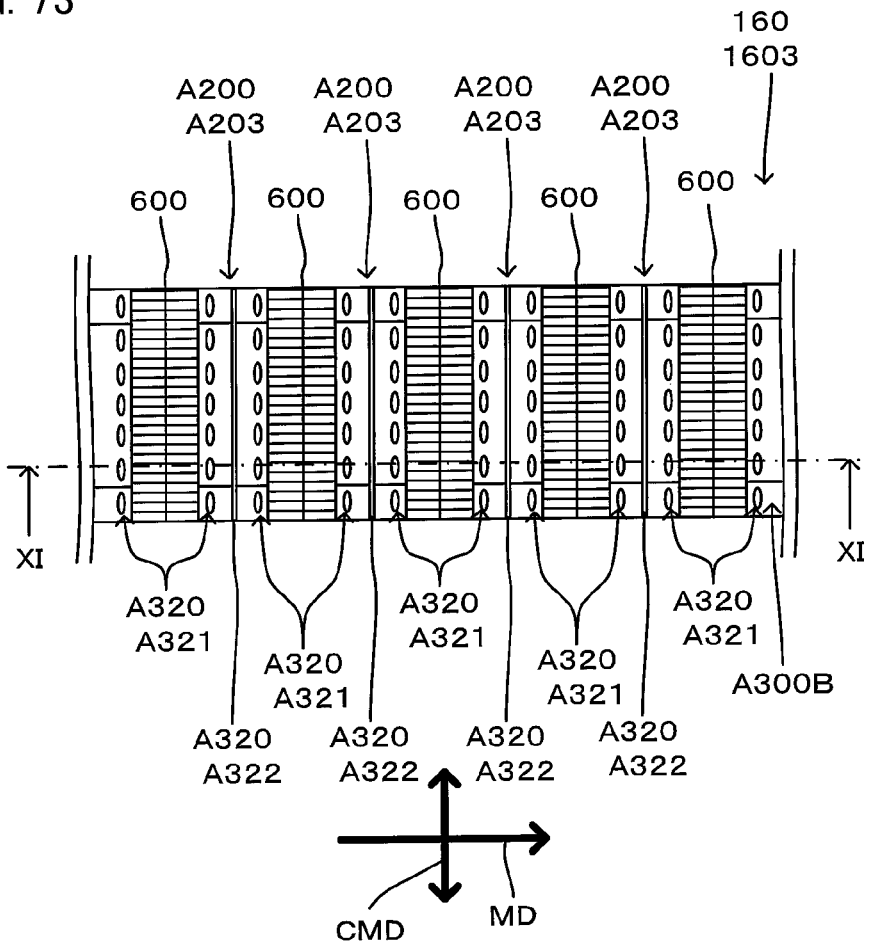
FIG. 73 is a view showing a state of a material in the final processing part.
Figure 74:
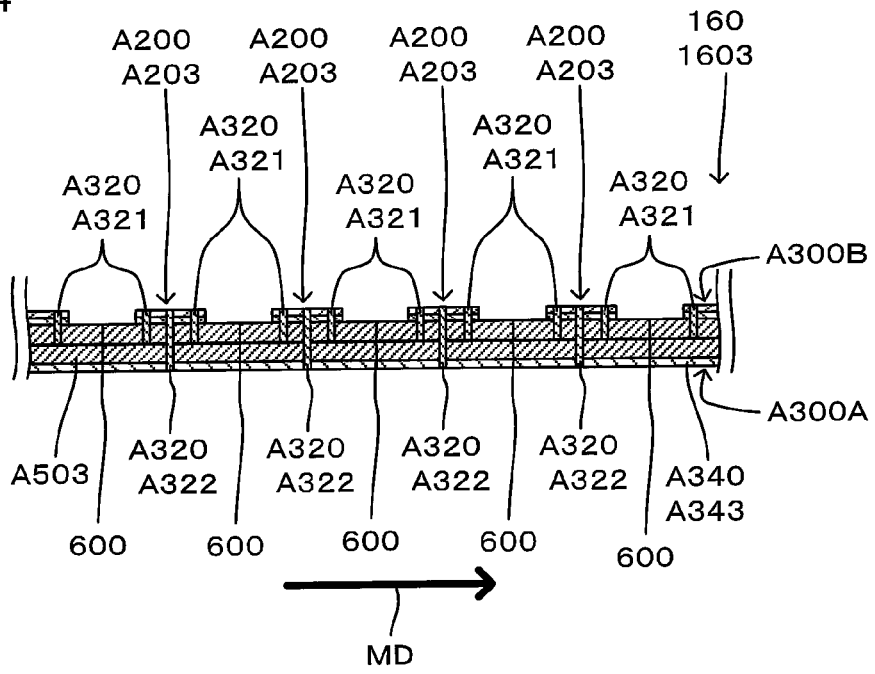
FIG. 74 is a sectional view taken along line XI-XI in FIG. 73.

FIGS. 73 and 74 show the final laminate A520 cut by the final cutting device 161. The final laminate A520 is cut along the cutting parts 600 and forms the second cleaning elements A202.

The third manufacturing device 103 manufactures the second cleaning element A202 through the above-described devices and steps.

(Structure of the Third Cleaning Element)

Figure 75:
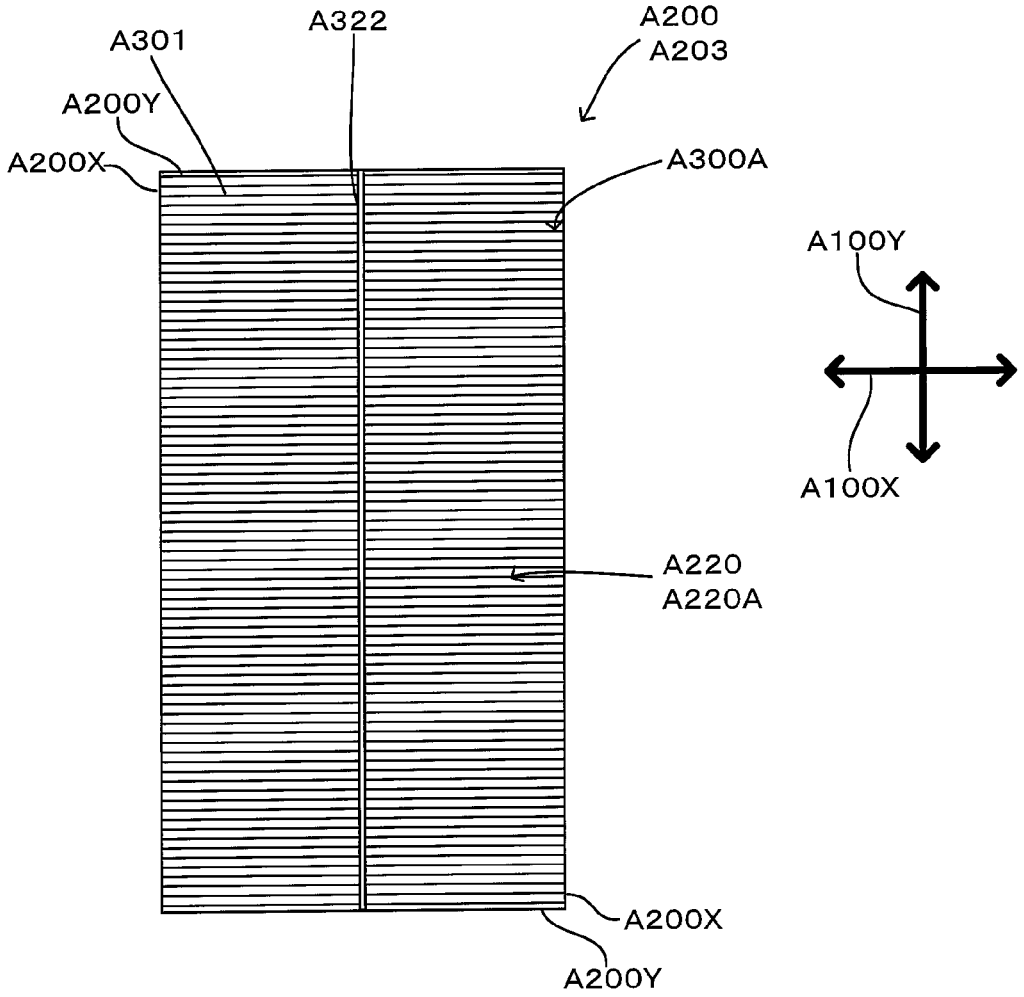
FIG. 75 is a view of a third cleaning element as viewed from one side.
Figure 76:
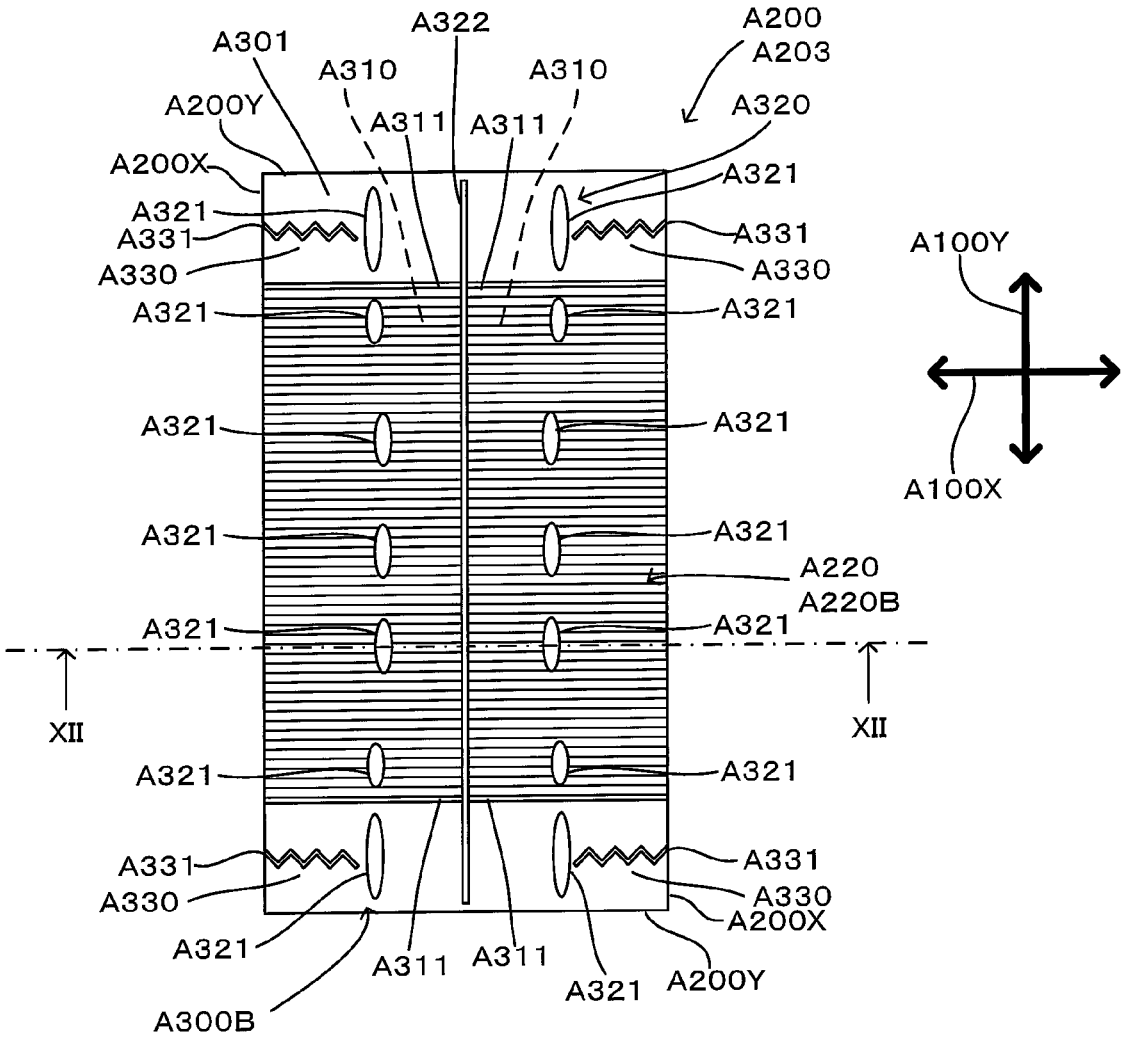
FIG. 76 is a view of the third cleaning element as viewed from the other side.
Figure 77:
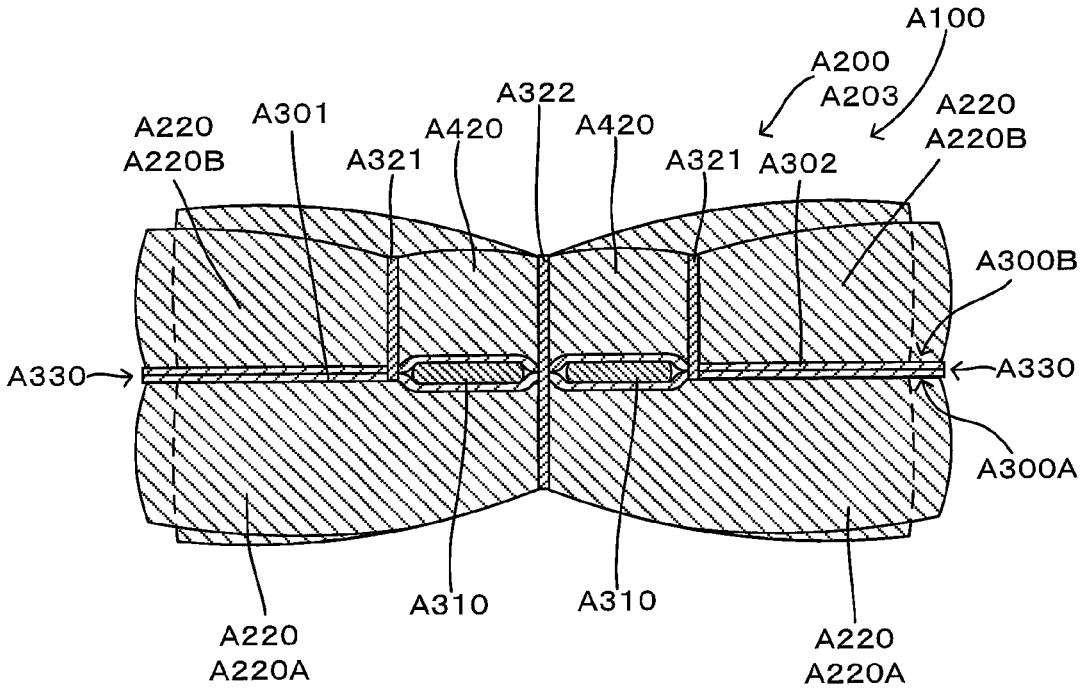
FIG. 77 is a sectional view taken along line XII-XII in FIG. 76.
Figure 78:
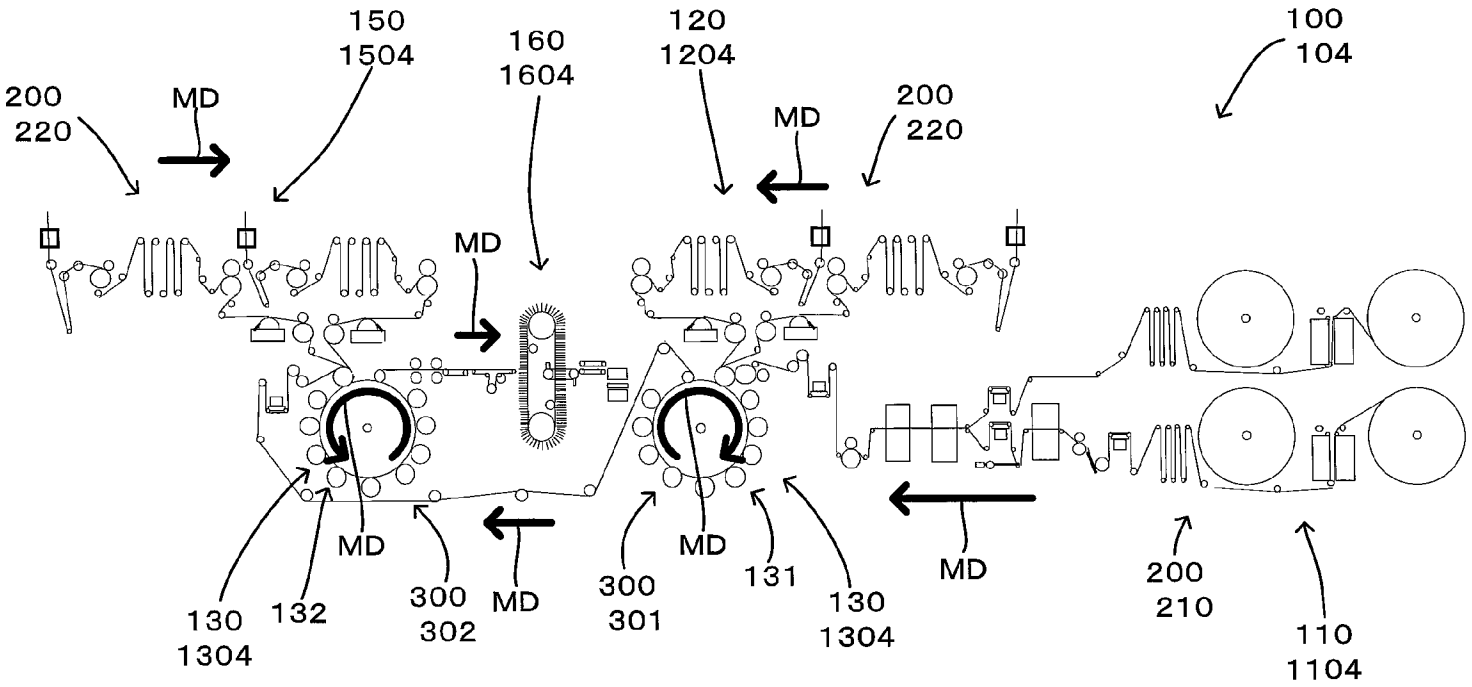
FIG. 78 is an explanatory drawing of a fourth manufacturing device according to the present invention.

A structure of the third cleaning element A203 is explained with reference to FIGS. 75 to 77.

The third cleaning element A203 is different in the structure of the fiber assembly A220 from the first cleaning element A201. Specifically, the fiber assembly A220 is arranged on both one side A300A and the other side A300B of the sheet part A300. The fiber assembly A220 arranged on the one side A300A of the sheet part A300 forms one fiber assembly A220A, while the fiber assembly A220 arranged on the other side A300B of the sheet part A300 forms the other fiber assembly A220B. The other fiber assembly A220B has substantially the same length as the second sheet part A302 in the longitudinal direction A100Y. Further, the other fiber assembly A220B can be formed to be shorter than the second sheet part A302 in the longitudinal direction A100Y. By provision of such a structure, the user can easily recognize the insertion opening A311 when attaching the cleaning element holder A400 to the third cleaning element A203.

Further, the third cleaning element A203 does not have the third sheet part A303.

(Structure of the Fourth Manufacturing Device)

The structure of the fourth manufacturing device 104 is explained with reference to FIGS. 78 to 93. The fourth manufacturing device 104 manufactures the third cleaning element A203. Further, the fourth manufacturing device 104 has a bonding part 1304 which includes the first bonding part 131 having the first bonding device 301 and the second bonding part 132 having the second bonding device 302.

The fourth manufacturing device 104 has a laminate sheet material feeding part 1104 for feeding the first sheet material A341 and the second sheet material A342.

The fourth manufacturing device 104 further has a first fiber material feeding part 1204 for feeding the fiber material A230.

The fourth manufacturing device 104 further has the first bonding part 131 that superposes the fiber material A230 fed by the first fiber material feeding part 1204 on the first sheet material A341 and bonds the first sheet material A341, the second sheet material A342 and the fiber material A230 fed by the first fiber material feeding part 1204 in order to obtain the intermediate laminate A510.

The fourth manufacturing device 104 further has a second fiber material feeding part 1504 for feeding the fiber material A230.

The fourth manufacturing device 104 further has the second bonding part 132 that superposes the fiber material A230 fed by the second fiber material feeding part 1504 on the second sheet material A342 of the intermediate laminate A510 and bonds the intermediate laminate A510 and the fiber material A230 fed by the second fiber material feeding part 1504 in order to obtain the final laminate A520.

The fourth manufacturing device 104 further has a final processing part 1604 for cutting and packaging the final laminate A520.

Specifically, the process of manufacturing the third cleaning element A203 by the fourth manufacturing device 104 has a step of feeding the first sheet material A341 and the second sheet material A342.

The manufacturing process by the fourth manufacturing device 104 further has a step of feeding the one fiber material A230.

The manufacturing process by the fourth manufacturing device 104 further has a step of superposing the one fiber assembly A230 on the first sheet material A341 and bonding the first sheet material A341, the second sheet material A342 and the one fiber material A230, thereby obtaining the intermediate laminate A510.

The manufacturing process by the fourth manufacturing device 104 further has a step of feeding the other fiber material A230.

The manufacturing process by the fourth manufacturing device 104 further has a step of superposing the other fiber assembly A230 on the second sheet material A342 of the intermediate laminate A510 and bonding the intermediate laminate A510 and the other fiber material A230, thereby obtaining the final laminate A520.

The manufacturing process by the fourth manufacturing device 104 further has a step of cutting and packaging the final laminate A520.

Figure 79:
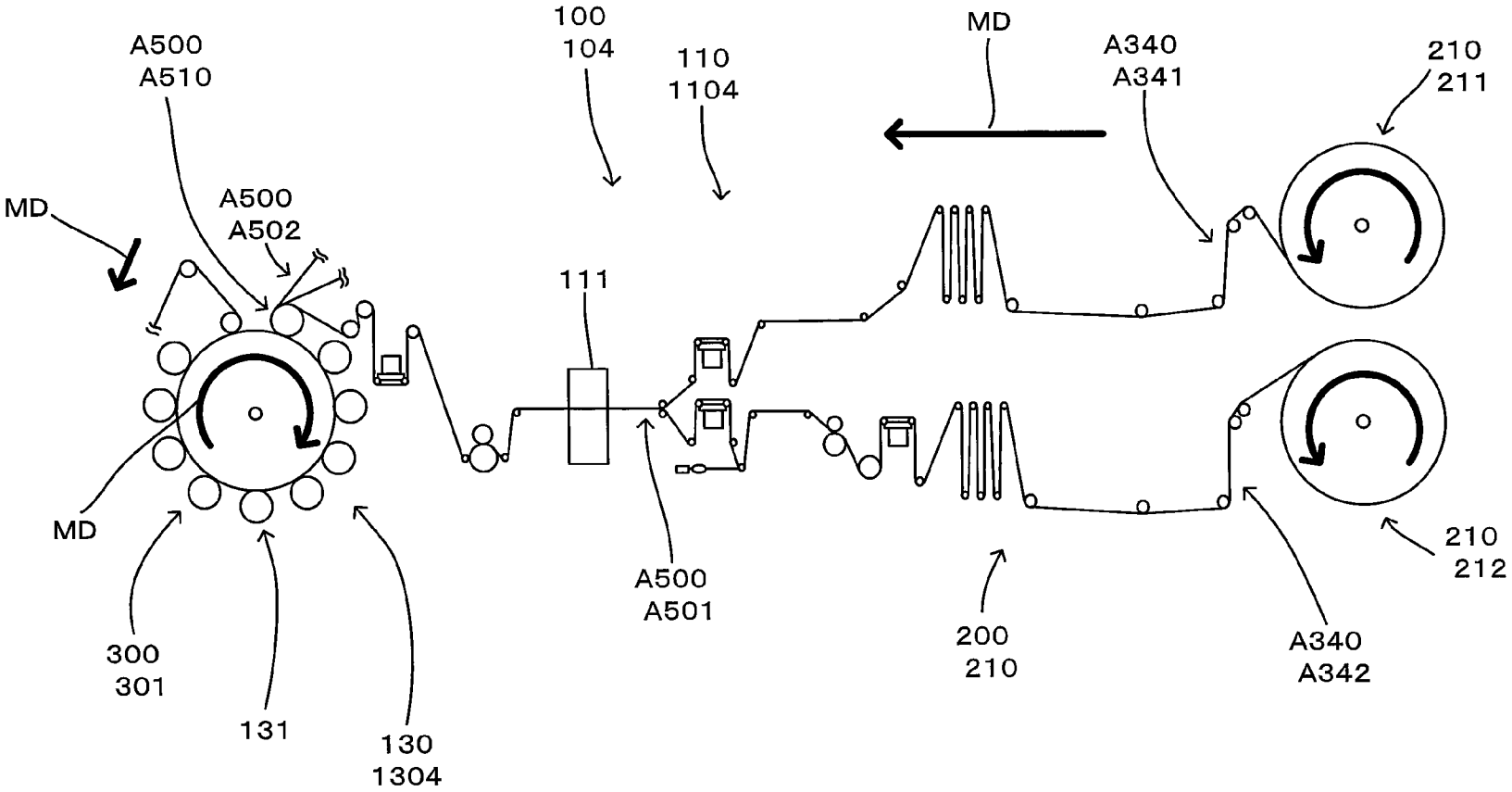
FIG. 79 is an explanatory drawing of a laminate sheet material feeding part in the fourth manufacturing device.

FIG. 79 shows the laminate sheet material feeding part 1104. The laminate sheet material feeding part 1104 has the sheet material feeding device 210. The sheet material feeding device 210 includes the first sheet material feeding device 211 for feeding the first sheet material A341, and the second sheet material feeding device 212 for feeding the second sheet material A342.

The first sheet material feeding device 211 conveys the first sheet material A341 in the machine direction MD. The second sheet material feeding device 212 conveys the second sheet material A342 in the machine direction MD. The first sheet material A341 and the second sheet material A342 are superposed to form the laminate A500. The laminate A500 of the first sheet material A341 and the second sheet material A342 is defined as the sheet laminate A501. The cuts A331 are formed in the sheet laminate A501 by the cutting device 111, and the sheet laminate A501 having the cuts A331 is fed to the first bonding part 131 in the bonding part 1304.

Figure 80:
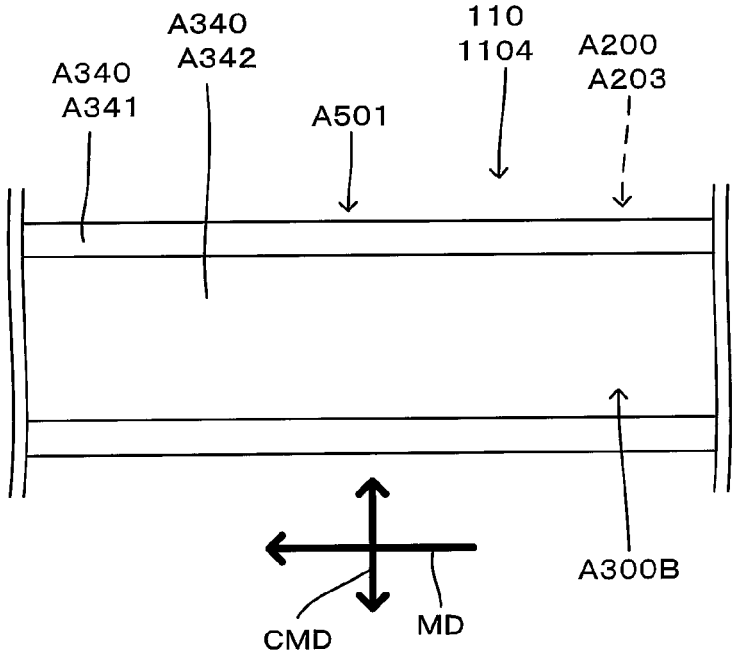
FIG. 80 is a view showing a state of a material in the laminate sheet material feeding part.

FIG. 80 shows the sheet laminate A501 which is not yet fed to the cutting device 111 in the laminate sheet material feeding part 1104. The second sheet material A342 is formed to be shorter than the first sheet material A341 in the machine transverse direction CMD. Therefore, the second sheet material A342 is not overlapped on the both end regions of the first sheet material A341 in the machine transverse direction CMD.

Figure 81:
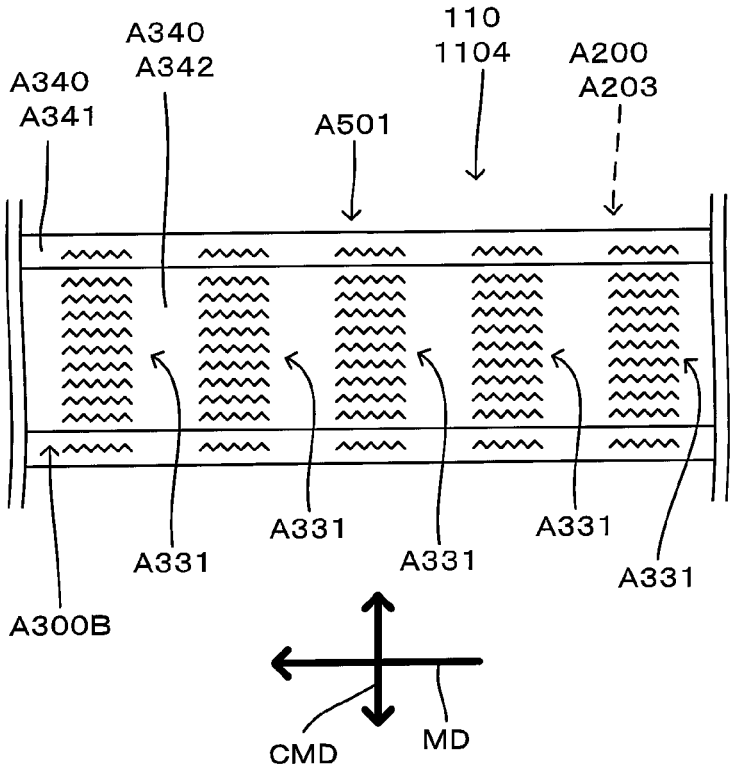
FIG. 81 is a view showing the state of the material in the laminate sheet material feeding part.

FIG. 81 shows the sheet laminate A501 fed to the cutting device 111 in the laminate sheet material feeding part 1104. A plurality of the cuts A331 are formed in the sheet laminate A501. A region between a pair of the cuts A331 forms a strip A330.

Figure 82:
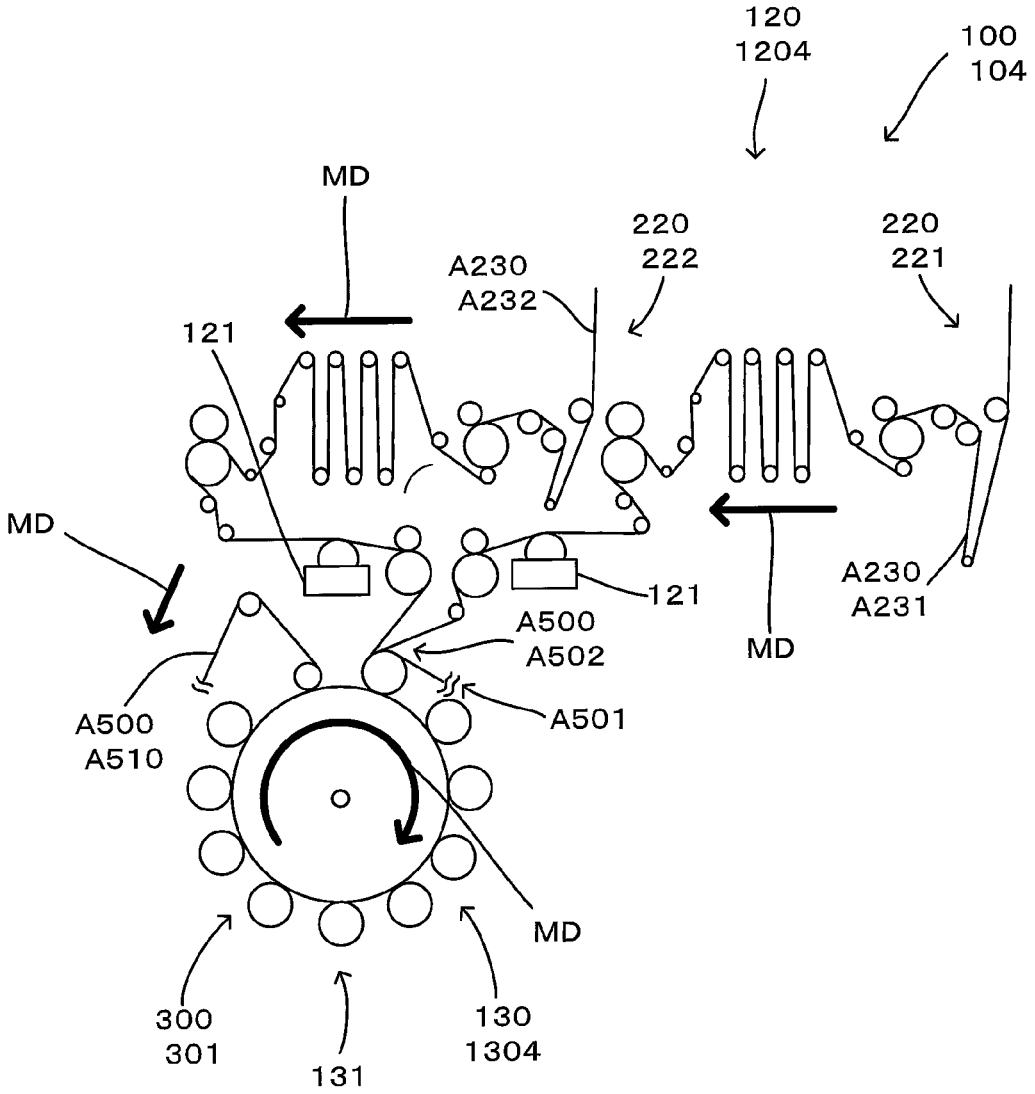
FIG. 82 is an explanatory drawing of a first fiber sheet material feeding part in the fourth manufacturing device.

FIG. 82 shows the first fiber material feeding part 1204. The first fiber material feeding part 1204 has the fiber material feeding device 220. The fiber material feeding device 220 includes the first fiber material feeding device 221 for feeding the first fiber material A231 and the second fiber material feeding device 222 for feeding the second fiber material A232.

The first fiber material feeding device 221 conveys the first fiber material A231 in the machine direction MD. The second fiber material feeding device 222 conveys the second fiber material A232 in the machine direction MD. The first fiber material A231 and the second fiber material A232 are superposed to form the laminate A500. The laminate A500 of the first fiber material A231 and the second fiber material A232 is defined as the first fiber laminate A502. The first fiber laminate A502 is fed to the first bonding part 131 in the bonding part 1304. Further, dust adsorbent oil is supplied to the first fiber material A231 and the second fiber material A232 by the oil applicator 121.

Further, the fiber material A230 is formed of opened tows. The direction in which the fiber tows extend substantially coincides with the machine direction MD.

Figure 83:
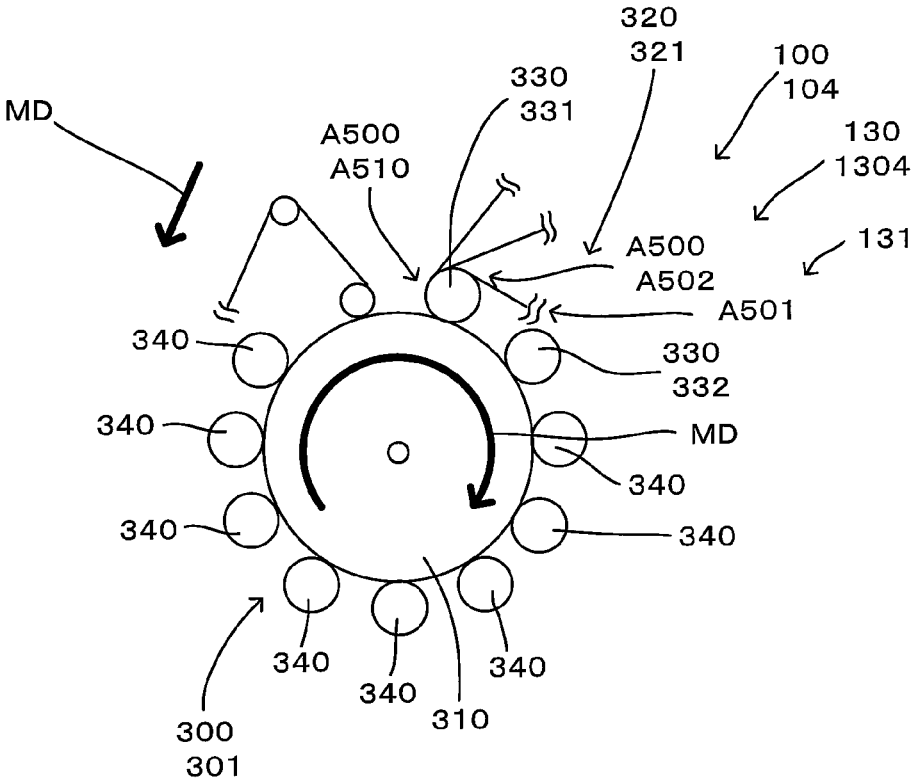
FIG. 83 is an explanatory drawing of a first bonding part in the fourth manufacturing device.

FIG. 83 shows the first bonding part 131 in the bonding part 1304. The first bonding part 131 has the first bonding device 301. The first bonding device 301 has the drum roller 310 and the bonding section 320. The bonding section 320 has the first bonded region forming section 331 and the second bonded region forming section 332.

The sheet laminate A501 and the first fiber laminate A502 are fed to the first bonding part 131. The first fiber laminate A502 is arranged on the one side A300A of the first sheet material A341 of the sheet laminate A501. Specifically, the first fiber laminate A502 is arranged on a surface of the first sheet material A341 on which the second sheet material A342 is not superposed (or on the side opposite to the second sheet material A342). Further, in the first bonding part 131, the bonded region 500 is formed in the prescribed regions of the sheet laminate A501 and the first fiber laminate A502 by the drum roller 310 and the bonding section 320. The bonded region 500 is defined as the bonded part A320 at which the prescribed regions of the sheet laminate A501 and the first fiber laminate A502 are bonded. The bonded part A320 formed by the first bonding part 131 forms the first bonded part A321 of the third cleaning element A203.

The sheet laminate A501 and the first fiber laminate A502 which are bonded at the bonded part A320 form the intermediate laminate A510. The intermediate laminate A510 is conveyed to the second bonding part 132 in the machine direction MD.

Figure 84:
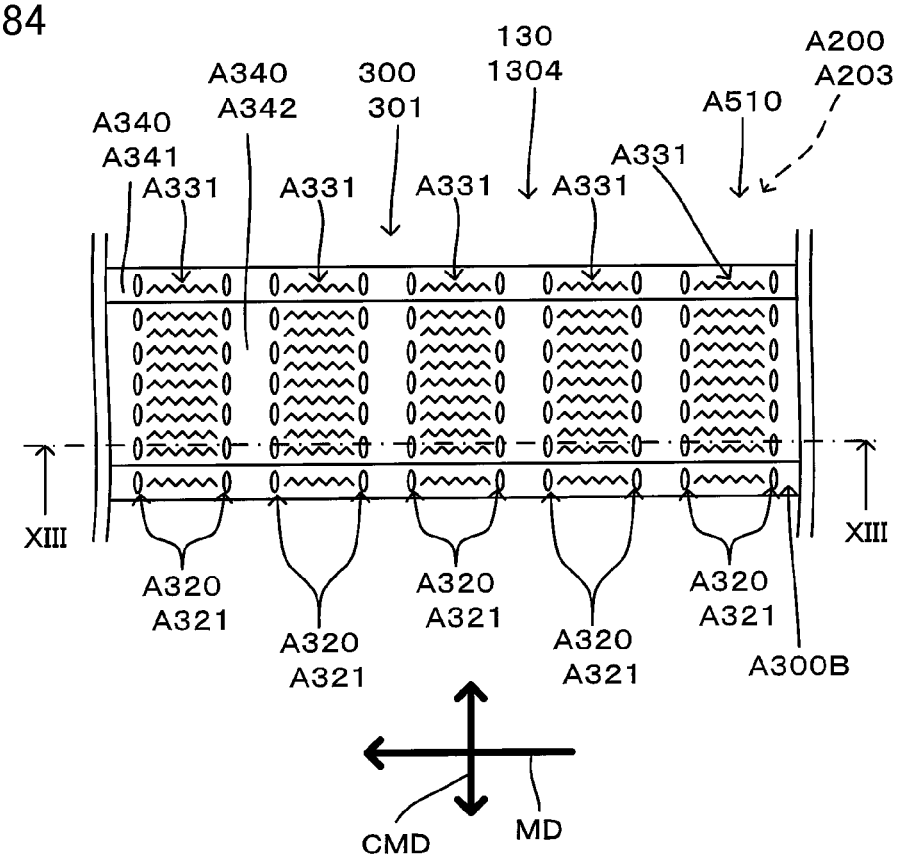
FIG. 84 is a view showing a state of a material in the first bonding part.
Figure 85:
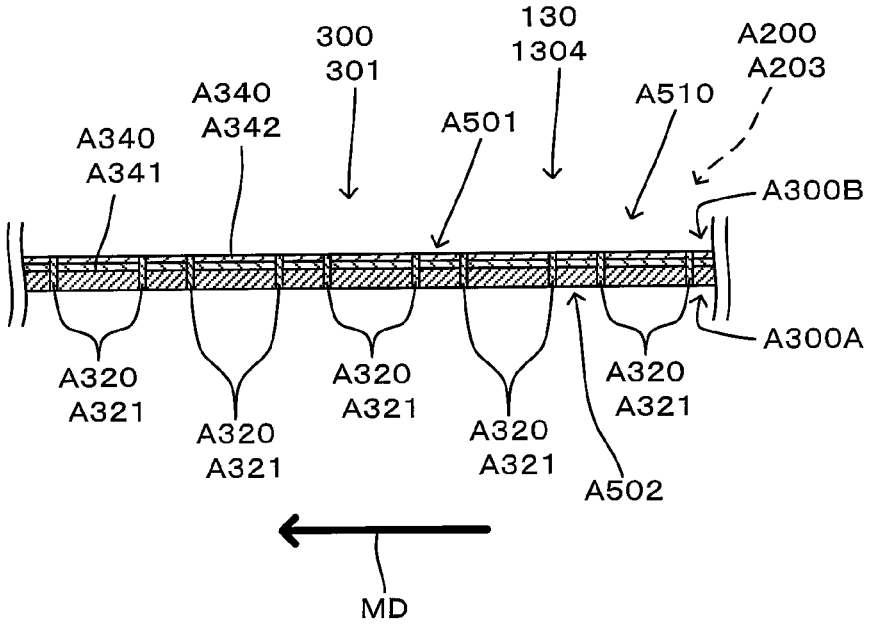
FIG. 85 is a sectional view taken along line XIII-XIII in FIG. 84.

FIGS. 84 and 85 show the intermediate laminate A501 having the first bonded part A321 formed in the first bonding part 131.

Figure 86:
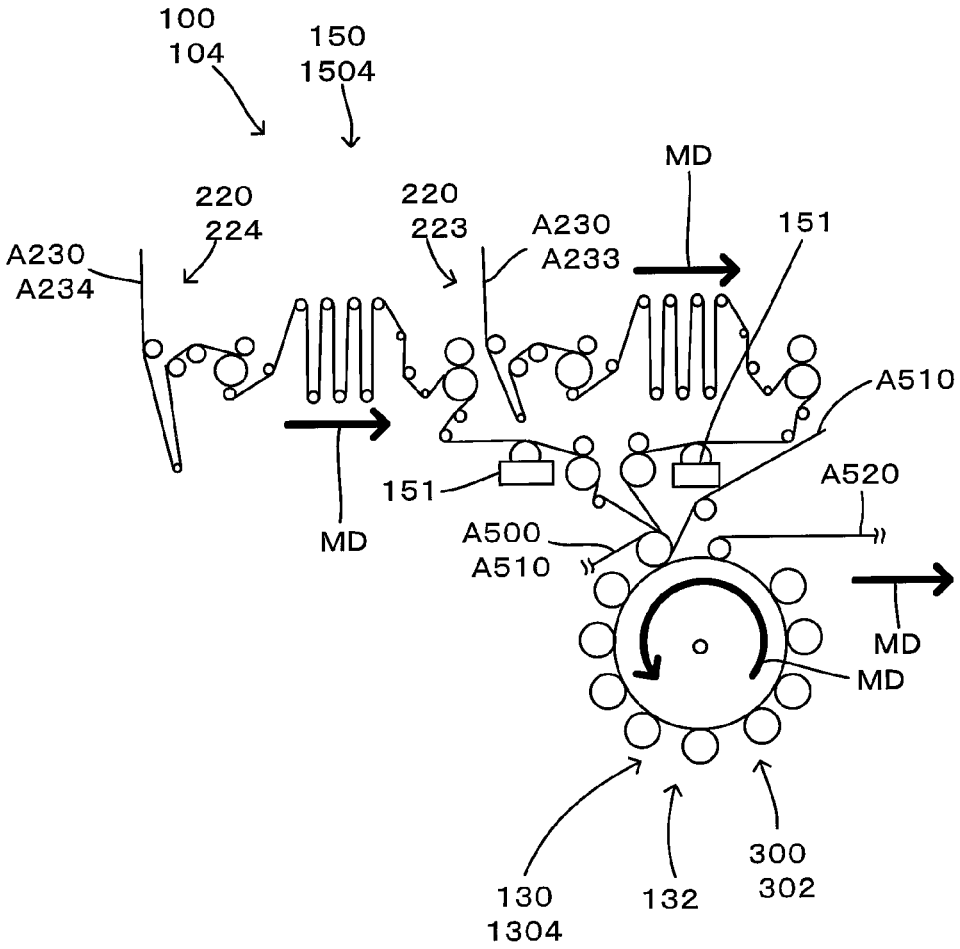
FIG. 86 is an explanatory drawing of a second fiber material feeding part in the fourth manufacturing device.

FIG. 86 shows the second fiber material feeding part 1504. The second fiber material feeding part 1504 has the fiber material feeding device 220. The fiber material feeding device 220 includes the third fiber material feeding device 223 for feeding the third fiber material A233 and the fourth fiber material feeding device 224 for feeding the fourth fiber material A234.

The third fiber material feeding device 223 conveys the third fiber material A233 in the machine direction MD. The fourth fiber material feeding device 224 conveys the fourth fiber material A234 in the machine direction MD. The third fiber material A233 and the fourth fiber material A234 are superposed to form the laminate A500. The laminate A500 of the third fiber material A233 and the fourth fiber material A234 is defined as the second fiber laminate A503. The second fiber laminate A503 is fed to the second bonding part 132 in the bonding part 1304. Further, dust adsorbent oil is supplied to the third fiber material A233 and the fourth fiber material A234 by the oil applicator 151.

Figure 87:
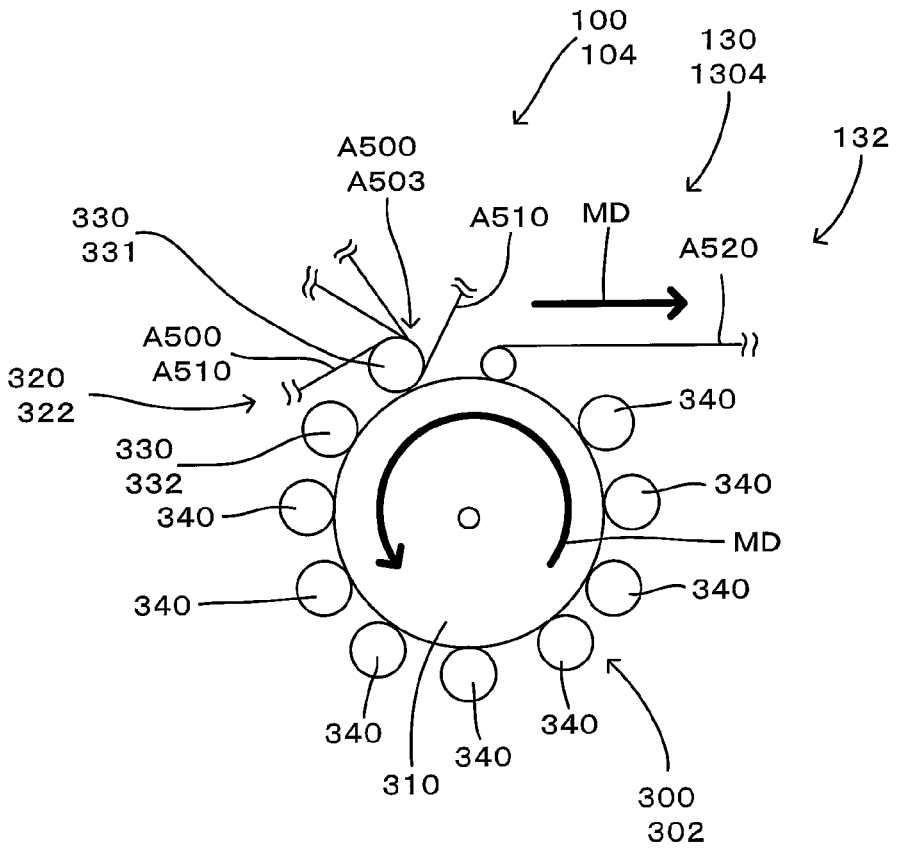
FIG. 87 is an explanatory drawing of a second bonding part in the fourth manufacturing device.

FIG. 87 shows the second bonding part 132 in the bonding part 1304. The second bonding part 132 has the second bonding device 302. The second bonding device 302 has the drum roller 310 and the bonding section 320. The bonding section 320 has the first bonded region forming section 331 and the second bonded region forming section 332.

The intermediate laminate A510, the second fiber laminate A503 and the third sheet material A343 are fed to the second bonding part 132. The second fiber laminate A503 is arranged on the other side A300B of the intermediate laminate A510. Specifically, the second fiber laminate A503 is arranged on the surface of the second sheet material A342 of the intermediate laminate A510. Further, in the second bonding part 132, the bonded region 500 is formed in the prescribed regions of the intermediate laminate A510 and the second fiber laminate A503 by the drum roller 310 and the bonding section 320. The bonded region 500 is defined as the bonded part A320 at which the prescribed regions of the intermediate laminate A510 and the second fiber laminate A503 are bonded. The bonded part A320 formed by the second bonding part 132 forms the second bonded part A322 of the third cleaning element A203.

The intermediate laminate A510 and the second fiber laminate A503 which are bonded at the bonded part A320 form the final laminate A520. The final laminate A520 is conveyed to the final processing part 1604 in the machine direction MD.

Figure 88:
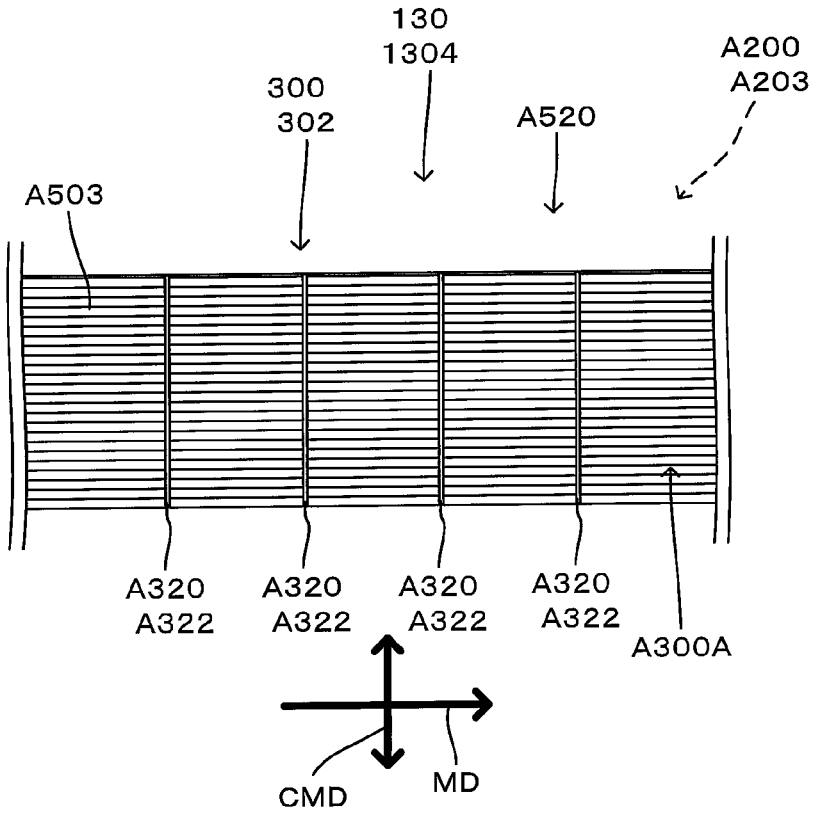
FIG. 88 is a view showing a state of a material in the second bonding part.
Figure 89:
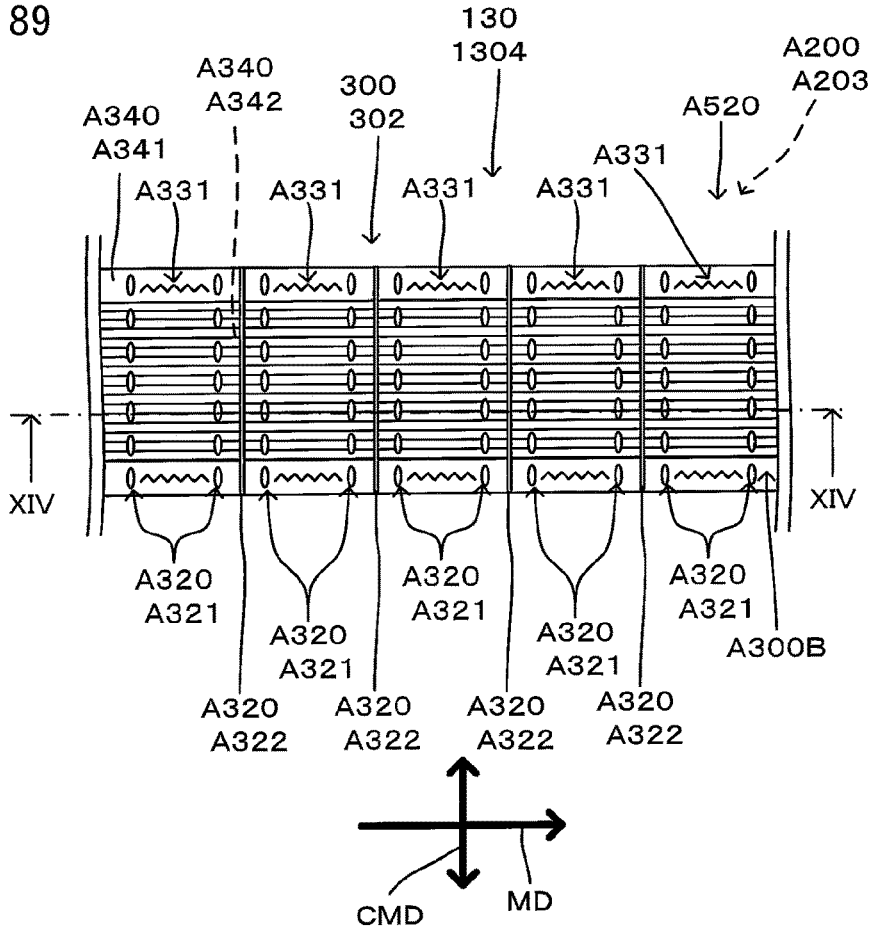
FIG. 89 is a view showing the state of the material in the second bonding part.
Figure 90:
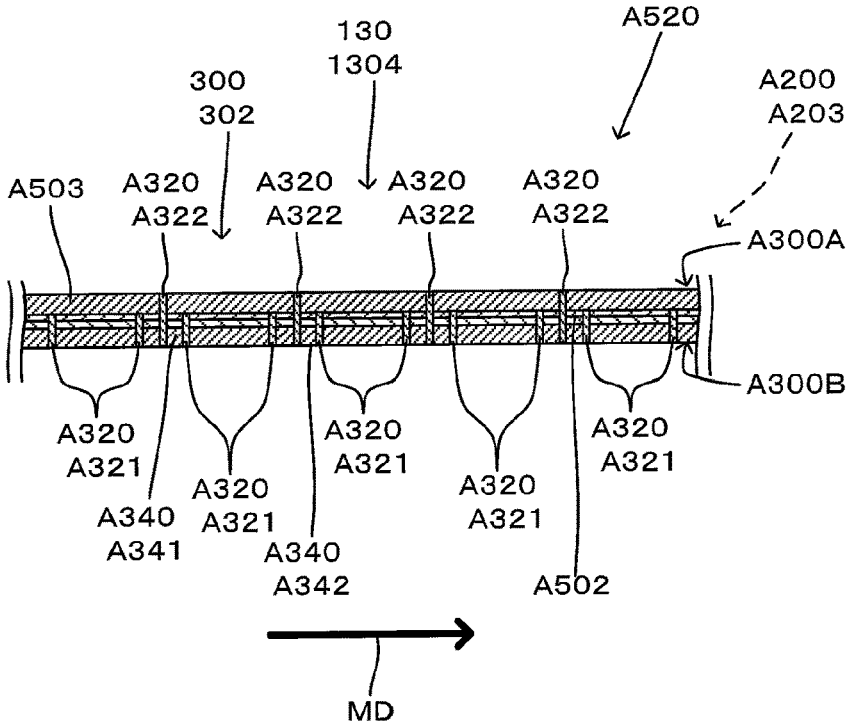
FIG. 90 is a sectional view taken along line XIV-XIV in FIG. 89.

FIGS. 88 to 90 show the final laminate A520 having the second bonded part A322 formed in the second bonding part 132. FIG. 88 shows the final laminate A520 as viewed from the outside of the drum roller 310, and FIG. 89 shows the final laminate A520 as viewed from the inner diameter side of the drum roller 310. The drum roller 310 is disposed on a lower side as viewed in FIG. 90. The holding space A310 is formed between the first sheet material A340 and the second sheet material A342 in a region between the first bonded part A321 and the second bonded part A322.

The second sheet material A342 has substantially the same length as the second fiber laminate A503 in the machine transverse direction CMD.

Figure 91:
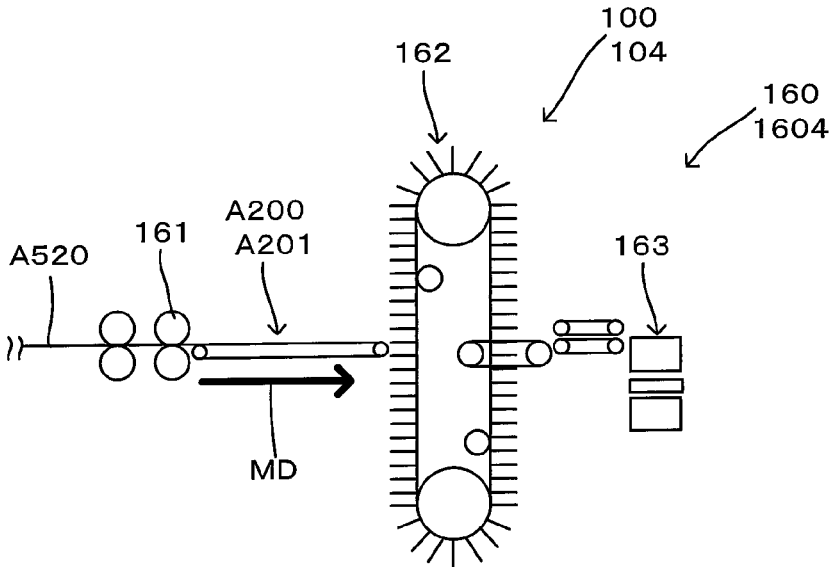
FIG. 91 is an explanatory drawing of a final processing part in the fourth manufacturing device.

FIG. 91 shows the final processing part 1604. The final processing part 1604 has the final cutting device 161 that cuts the final laminate A520 in the machine transverse direction CMD to obtain the third cleaning element A203 from the final laminate A520. The final processing part 1604 further has the counting device 162 for counting the third cleaning elements A203 and the packaging device 163 for packaging the counted third cleaning elements A203.

Figure 92:
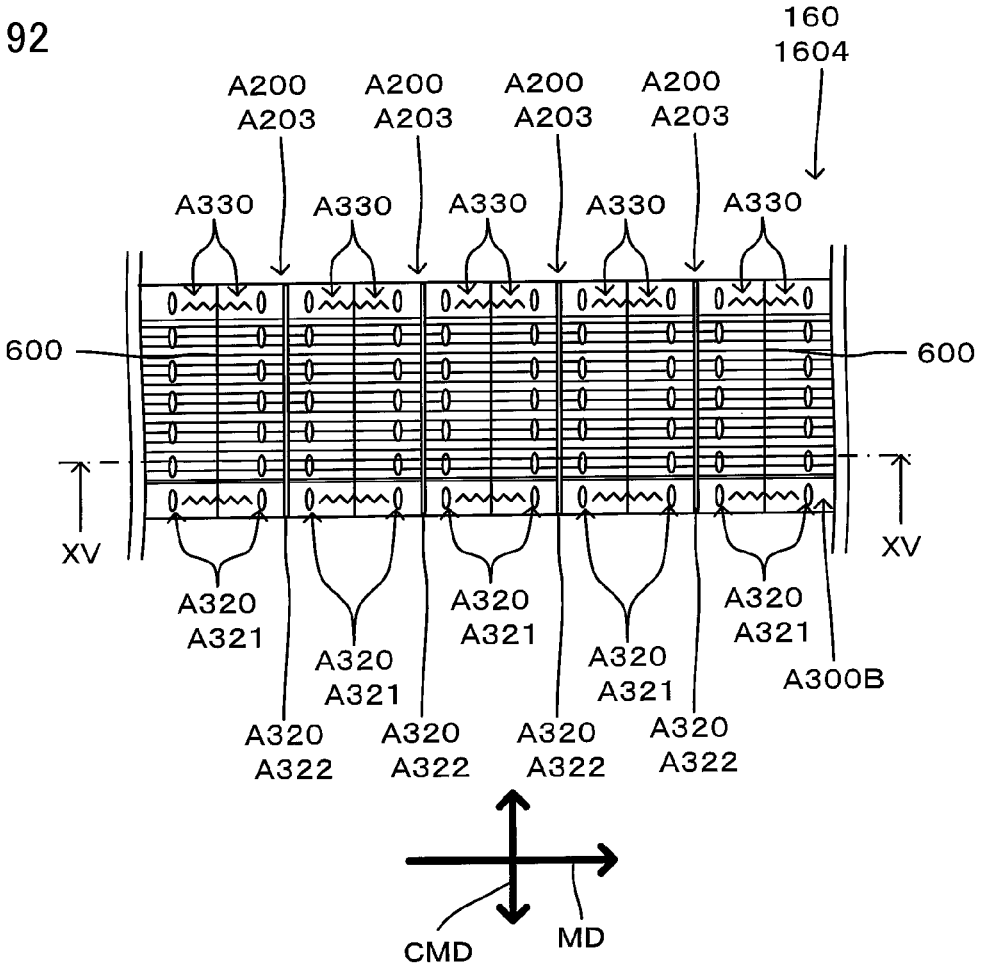
FIG. 92 is a view showing a state of a material in the final processing part.
Figure 93:
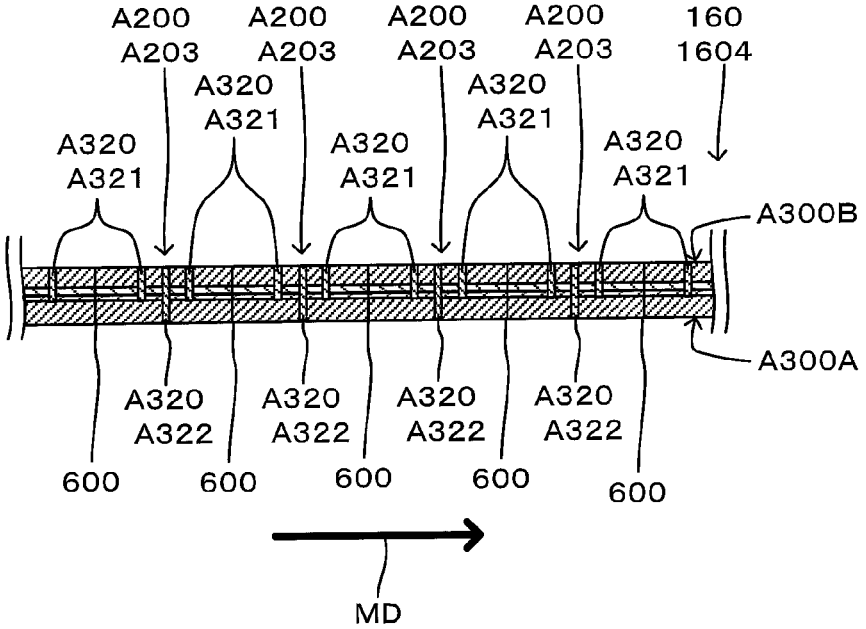
FIG. 93 is a sectional view taken along line XV-XV in FIG. 92.

FIGS. 92 and 93 show the final laminate A520 cut by the final cutting device 161. The final laminate A520 is cut along the cutting parts 600 and forms the third cleaning elements A203.

The fourth manufacturing device 104 manufactures the third cleaning element A203 through the above-described devices and steps.

Embodiments of the cleaning tool, the cleaning element, the manufacturing device and the manufacturing process according to the present invention are not limited to the above-described structures and processes. For example, as for the manufacturing device, the structures of the first to fourth manufacturing devices can be applied in appropriate combinations in order to realize the structure of the cleaning element to be obtained. Further, other manufacturing devices and processes may also be applied.

(Correspondences Between the Features of the Embodiments and the Features of the Invention)

The cleaning element A200, the first cleaning element A201, the second cleaning element A202 and the third cleaning element A203 are an example embodiment that corresponds to the "cleaning sheet" according to the present invention. The cleaning element holder A400 is an example embodiment that corresponds to the "holder" according to the present invention. The cleaning tool A100 is an example embodiment that corresponds to the "cleaning tool" according to the present invention. The band-like element 400 is an example embodiment that corresponds to the "band-like element" according to the present invention. The drum roller 310 is an example embodiment that corresponds to the "drum roller" according to the present invention. The bonding section 320 is an example embodiment that corresponds to the "bonding section" according to the present invention. The bonding device 300 is an example embodiment that corresponds to the "bonding device" according to the present invention. The bonded region 500 is an example embodiment that corresponds to the "bonded region" according to the present invention. The bonded part A320 is an example embodiment that corresponds to the "bonded part" according to the present invention. The embossing roller 330 is an example embodiment that corresponds to the "bonded region forming section" according to the present invention. The sheet material A340 is an example embodiment that corresponds to the "sheet material" according to the present invention. The fiber material A230 is an example embodiment that corresponds to the "fiber material" according to the present invention. The laminate A500 is an example embodiment that corresponds to the "laminate" according to the present invention. The first bonded region forming section 331 is an example embodiment that corresponds to the "first bonded region forming section" according to the present invention. The second bonded region forming section 332 is an example embodiment that corresponds to the "second bonded region forming section" according to the present invention. The first bonded region 501 is an example embodiment that corresponds to the "first bonded region" according to the present invention. The second bonded region 502 is an example embodiment that corresponds to the "second bonded region" according to the present invention. The first bonding device 301 is an example embodiment that corresponds to the "first bonding device" according to the present invention. The second bonding device 302 is an example embodiment that corresponds to the "second bonding device" according to the present invention. The manufacturing device 100, the first manufacturing device 101, the second manufacturing device 102, the third manufacturing device 103 and the fourth manufacturing device 104 are an example embodiment that corresponds to the "manufacturing device" according to the present invention.

In view of the nature of the above-described invention, various features can be provided as follows.

(Aspect 1)

A method of manufacturing a cleaning tool having a cleaning sheet and a holder for holding the cleaning sheet, comprising the steps of:

feeding a plurality of band-like elements for forming the cleaning sheet, superposing the band-like elements, feeding the superposed band-like elements to a bonding device having a drum roller and a bonding section, and forming a bonded region in a prescribed region of the superposed band-like elements by the bonding device.

(Aspect 2)

The manufacturing method as defined in aspect 1, wherein the bonding section has a bonded region forming section.

(Aspect 3)

The manufacturing method as defined in aspect 1 or 2, wherein:

the bonding section has a first bonded region forming section and a second bonded region forming section, the first bonded region forming section forms a first bonded region in the prescribed region of the superposed band-like elements, and the second bonded region forming section forms a second bonded region in the prescribed region of the superposed band-like elements.

(Aspect 4)

The manufacturing method as defined in aspect 3, wherein the first bonded region and the second bonded region overlap with each other.

(Aspect 5)

The manufacturing method as defined in aspect 3, wherein the first bonded region and the second bonded region do not overlap with each other.

(Aspect 6)

The manufacturing method as defined in aspect 3 or 4, wherein the first bonded region has a different area from the second bonded region.

(Aspect 7)

The manufacturing method as defined in aspect 3 or 4, wherein the first bonded region has the same area as the second bonded region.

(Aspect 8)

The manufacturing method as defined in aspects 1 to 7, wherein the bonding device has a plurality of such bonding sections for a single such drum roller.

(Aspect 9)

The manufacturing method as defined in aspects 1 to 8, wherein the bonding device includes a first bonding device and a second bonding device.

(Aspect 10)

The manufacturing method as defined in aspects 1 to 9, wherein the band-like elements each comprise a sheet material formed of nonwoven fabric.

(Aspect 11)

The manufacturing method as defined in aspects 1 to 9, wherein the band-like elements each comprise a fiber material formed of filaments.

(Aspect 12)

The manufacturing method as defined in aspect 10, wherein the superposed band-like elements comprise a plurality of such sheet materials.

(Aspect 13)

The manufacturing method as defined in aspect 11, wherein the superposed band-like elements comprise a plurality of such fiber materials.

(Aspect 14)

The manufacturing method as defined in aspects 10 and 11, wherein the superposed band-like elements comprise the sheet material and the fiber material.

(Aspect 15)

The manufacturing method as defined in aspects 12 to 14, wherein the superposed band-like elements form a laminate.

(Aspect 16)

The manufacturing method as defined in aspect 15, wherein the bonding device forms the bonded region in the laminate, thereby forming a bonded part at which the band-like elements forming the laminate are bonded together.

(Aspect 17)

The manufacturing method as defined in aspect 15 or 16, wherein the laminate includes a first laminate and a second laminate.

(Aspect 18)

The manufacturing method as defined in aspect 17, wherein the first bonding device forms the bonded part in the first laminate and the second bonding device forms the bonded part in the first laminate and the second laminate.

(Aspect 19)

The manufacturing method as defined in aspects 1 to 18, wherein the cleaning sheet has a sheet part and a fiber assembly.

(Aspect 20)

The manufacturing method as defined in aspect 19, wherein the sheet part is formed by cutting the sheet material.

(Aspect 21)

The manufacturing method as defined in aspect 19, wherein the fiber assembly is formed by cutting the fiber material.

(Aspect 22)

The manufacturing method as defined in aspects 19 to 21, wherein the cleaning sheet is configured such that the sheet part is formed to be shorter than the fiber assembly in a prescribed direction.

(Aspect 23)

The manufacturing method as defined in aspects 19 to 22, wherein the cleaning sheet is configured such that the fiber assembly is arranged on both sides of the sheet part.

(Aspect 24)

A device for manufacturing a cleaning tool having a cleaning sheet and a holder for holding the cleaning sheet, comprising:

a device for feeding a plurality of band-like elements for forming the cleaning sheet, a device for superposing the band-like elements, and a bonding device having a drum roller and a bonding section, wherein:

the bonding device forms a bonded region in a prescribed region of the superposed band-like elements.

(Aspect 25)

The manufacturing method as defined in aspects 1 to 24, wherein:

the bonding device includes the first bonding device and the second bonding device, the method comprising the steps of:

feeding a first sheet material and a second sheet material, feeding one of fiber materials, bonding the first sheet material, the second sheet material and the one fiber material by the first bonding device, thereby forming an intermediate laminate, feeding a third sheet material, feeding the other fiber material, and bonding the intermediate laminate, the third sheet material and the other fiber material by the second bonding device, thereby forming a final laminate.

(Aspect 26)

The manufacturing method as defined in aspects 1 to 24, wherein:

the bonding device has the single drum roller, the first bonding section and the second bonding section, the method comprising the steps of:

feeding a first sheet material and a second sheet material, feeding one of fiber materials, feeding a third sheet material, feeding the other fiber material, bonding the first sheet material, the second sheet material and the one fiber material by the drum roller and the first bonding section, thereby forming an intermediate laminate, and bonding the intermediate laminate, the third sheet material and the other fiber material by the drum roller and the second bonding section, thereby forming a final laminate.

(Aspect 27)

The manufacturing method as defined in aspects 1 to 24, wherein:

the bonding device includes the first bonding device and the second bonding device, the method comprising the steps of:

superposing the first and second sheet materials, cutting the superposed first and second sheet materials into a prescribed length and feeding the cut first and second sheet materials, feeding one of fiber materials, bonding the first sheet material, the second sheet material and the one fiber material, thereby forming an intermediate laminate, feeding a third sheet material, feeding the other fiber material, and bonding the intermediate laminate, the third sheet material and the other fiber material, thereby forming a final laminate.

(Aspect 28)

The manufacturing method as defined in aspects 1 to 24, wherein:

the bonding device includes the first bonding device and the second bonding device, the method comprising the steps of:

feeding first and second sheet materials, feeding one of fiber materials, superposing the one fiber material on the first sheet material and bonding the first sheet material, the second sheet material and the one fiber material, thereby forming an intermediate laminate, feeding the other fiber material, and superposing the other fiber material on the second sheet material of the intermediate laminate and bonding the intermediate laminate and the other fiber material, thereby forming a final laminate.

The invention claimed is:

1. A method of manufacturing a cleaning tool having a cleaning sheet and a holder for holding the cleaning sheet, the method comprising:

feeding a plurality of band-shaped elements for forming the cleaning sheet, superposing non-bonded band-shaped elements of the plurality of band-shaped elements, feeding the superposed non-bonded band-shaped elements to a bonding device having a single drum roller and a bonding section, and forming a bonded region in a prescribed region of the superposed non-bonded band-shaped elements by the bonding device, wherein the non-bonded band-shaped elements include a first band-shaped element and a second band-shaped element, the bonding section has a first bonded region forming section and a second bonded region forming section, the bonding device includes first and second bonding devices positioned on the single drum roller, the first bonding device configures the first bonded region forming section that forms a first bonded region in the prescribed region of the superposed first and second band-shaped elements, to bond the first band-shaped element to the second band-shaped element to obtain a third band-shaped element, the non-bonded band-shaped elements further include a fourth band-shaped element, and the second bonding device configures the second bonded region forming section that forms a second bonded region in the prescribed region of the superposed third and fourth band-shaped elements, to bond the third band-shaped element to the fourth band-shaped element.

2. The method as defined in claim 1, wherein the first bonded region and the second bonded region overlap with each other.

3. The method as defined in claim 1, wherein the first bonded region and the second bonded region do not overlap with each other.

4. The method as defined in claim 1, wherein the first bonded region has a different area from the second bonded region.

5. The method as defined in claim 1, wherein the first bonded region has the same area as the second bonded region.

6. The method as defined in claim 1, wherein the bonding device has a plurality of bonding sections on the single drum roller.

7. The method as defined in claim 1, wherein the plurality of band-shaped elements each comprises a sheet material formed of nonwoven fabric.

8. The method as defined in claim 7, wherein the superposed non-bonded band-shaped elements comprise a plurality of the sheet materials.

9. The method as defined in claim 1, wherein the plurality of band-shaped elements each comprises a fiber material formed of filaments.

10. The method as defined in claim 9, wherein the superposed non-bonded band-shaped elements comprise a plurality of the fiber materials.

11. The method as defined in claim 1, wherein the superposed non-bonded band-shaped elements comprise at least one sheet material formed of nonwoven fabric, and at least one fiber material formed of filaments.

12. The method as defined in claim 1, wherein the cleaning sheet has a sheet part and a fiber assembly, at least one sheet material formed of nonwoven fabric, and at least one fiber material formed of filaments.

13. The method as defined in claim 12, wherein the sheet part is formed by cutting the sheet material.

14. The method as defined in claim 12, wherein the fiber assembly is formed by cutting the fiber material.

15. The method as defined in claim 12, wherein the cleaning sheet is configured such that the sheet part is formed to be shorter than the fiber assembly in a prescribed direction.

16. The method as defined in claim 12, wherein the cleaning sheet is configured such that the fiber assembly is arranged on both sides of the sheet part.

17. The method as defined in claim 1, wherein first and second bonding devices include first and second rollers, respectively, and the first roller is positioned upstream of the second roller in a machine direction, the single drum roller rotating in the machine direction.

18. The method as defined in claim 17, wherein the first band-shaped element and the second band-shaped element are bonded together between the first roller and the single drum roller to obtain the third band-shaped element, the third band-shaped element is fed, along the single drum roller, from the first roller to the second roller in the machine direction, and the third band-shaped element and the fourth band-shaped element are bonded together at the second bonded region between the second roller and the single drum roller.

19. A method of manufacturing a cleaning tool having a cleaning sheet and a holder for holding the cleaning sheet, the method comprising:

feeding a plurality of band-shaped elements for forming the cleaning sheet, the plurality of band-shaped elements including first and second band-shaped elements;

superposing the first and second band-shaped elements;

feeding the superposed first and second band-shaped elements to a single drum roller and a first bonded region forming section positioned on the single drum roller;

bonding the superposed first and second band-shaped elements together at a first bonded region in a prescribed region of the superposed first and second band-shaped elements by the single drum roller and the first bonded region forming section to obtain a third band-shaped element;

superposing a fourth band-shaped element onto the third band-shaped element; and bonding the superposed third and fourth band-shaped elements together at a second bonded region in a prescribed region of the superposed third and fourth band-shaped elements by the single drum roller and a second bonded region forming section downstream of the first bonded region forming section and positioned on the single drum roller.

* * * * *